US007656371B2

(12) United States Patent
Shimizu et al.

(10) Patent No.: US 7,656,371 B2
(45) Date of Patent: Feb. 2, 2010

(54) LIGHT EMITTING APPARATUS, LED LIGHTING, LED LIGHT EMITTING APPARATUS, AND CONTROL METHOD OF LIGHT EMITTING APPARATUS

(75) Inventors: Yoshinori Shimizu, Tokushima (JP); Ryuhei Tsuji, Tokushima (JP); Tomoaki Inuzuka, Tokushima (JP); Masayuki Taru, Tokushima (JP); Katsunori Mitani, Tokushima (JP); Harumi Sakuragi, Tokushima (JP); Yasuhiro Kunisaki, Tokushima (JP)

(73) Assignee: Nichia Corporation, Anan-Shi (JP)

( * ) Notice: Subject to any disclaimer, the term of this patent is extended or adjusted under 35 U.S.C. 154(b) by 559 days.

(21) Appl. No.: 10/566,216

(22) PCT Filed: Jul. 26, 2004

(86) PCT No.: PCT/JP2004/010623

§ 371 (c)(1),
(2), (4) Date: Jan. 27, 2006

(87) PCT Pub. No.: WO2005/011006

PCT Pub. Date: Feb. 3, 2005

(65) Prior Publication Data

US 2007/0120496 A1 May 31, 2007

(30) Foreign Application Priority Data

Jul. 28, 2003 (JP) ..... 2003-280679

(51) Int. Cl.
*G09G 3/32* (2006.01)

(52) U.S. Cl. ..... 345/83; 345/690; 315/309; 315/169.3

(58) Field of Classification Search ..... 345/82–84, 345/106, 105, 204, 690, 101; 315/309, 169.3
See application file for complete search history.

(56) References Cited

U.S. PATENT DOCUMENTS 4,604,753 A * 8/1986 Sawai ..... 372/36

(Continued)

FOREIGN PATENT DOCUMENTS

EP 1 176 849 A2 1/2002

(Continued)

OTHER PUBLICATIONS

Sheu et al., "White-Light Emission From Near UV InGaN-GaN LED Chip Precoated With Blue/Green/Red Phosphors", IEEE Photonics Technology Letters, vol. 15, No. 1, Jan. 2003.*

*Primary Examiner*—Amr Awad
*Assistant Examiner*—Liliana Cerullo
(74) *Attorney, Agent, or Firm*—Birch, Stewart, Kolasch & Birch, LLP

(57) ABSTRACT

A light emitting apparatus comprises at least two light emitting elements with different chromaticities; and a light emitting element controller that controls light emitted from the light emitting apparatus so as to be a desired chromaticity. The light emitting element controller controls the light emitting elements based on a predetermined function of light emitting element temperature variation. Accordingly, it is possible to provide a light emitting apparatus that, even if the temperature varies, has a stable desired chromaticity without chromaticity variation. In addition, since control is performed based on a property function of wavelength fluctuation due to light emitting element temperature variation, it is possible to provide more reliable reproduction characteristics, and a desired chromaticity.

17 Claims, 38 Drawing Sheets

U.S. PATENT DOCUMENTS

| | | | | |
|---|---|---|---|---|
| 6,359,918 | B1 * | 3/2002 | Bielas | 372/38.01 |
| 6,411,046 | B1 * | 6/2002 | Muthu | 315/309 |
| 6,628,249 | B1 * | 9/2003 | Kamikawa et al. | 345/44 |
| 7,067,995 | B2 * | 6/2006 | Gunter et al. | 315/312 |
| 2002/0097000 | A1 * | 7/2002 | Muthu et al. | 315/169.3 |
| 2002/0175632 | A1 * | 11/2002 | Takeguchi | 315/169.1 |
| 2003/0011553 | A1 * | 1/2003 | Ozaki | 345/89 |
| 2003/0016198 | A1 * | 1/2003 | Nagai et al. | 345/83 |
| 2003/0063462 | A1 | 4/2003 | Shimizu et al. | |
| 2003/0076056 | A1 * | 4/2003 | Schuurmans | 315/291 |

FOREIGN PATENT DOCUMENTS

| | | | |
|---|---|---|---|
| JP | 64-48472 | A | 2/1989 |
| JP | 4-196368 | A | 7/1992 |
| JP | 2000-112429 | A | 4/2000 |
| JP | 2002-170999 | A | 6/2002 |
| WO | WO-97/48134 | A1 | 12/1997 |
| WO | WO-00/001046 | A1 | 1/2000 |
| WO | WO-2004/047498 | A1 | 6/2004 |

* cited by examiner

FIG.2
(a)
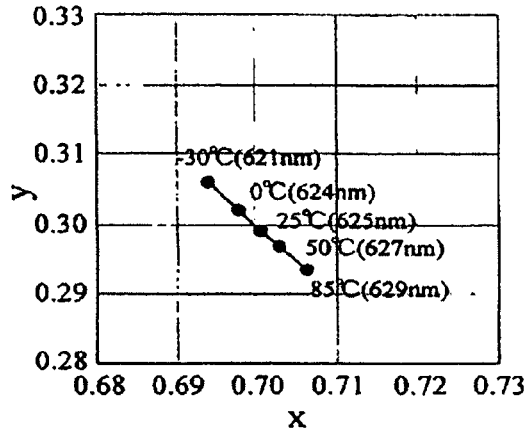
(b)
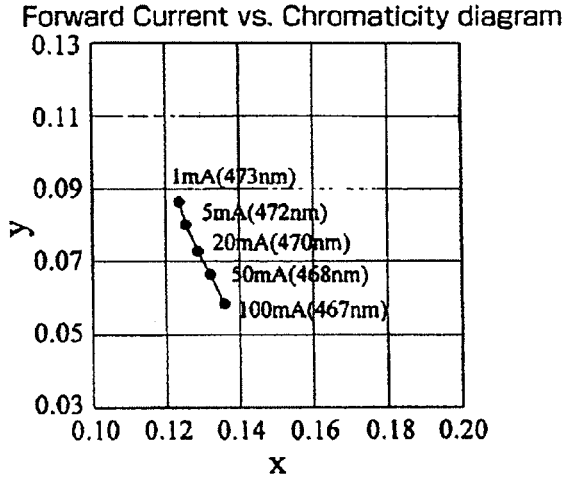
FIG.3
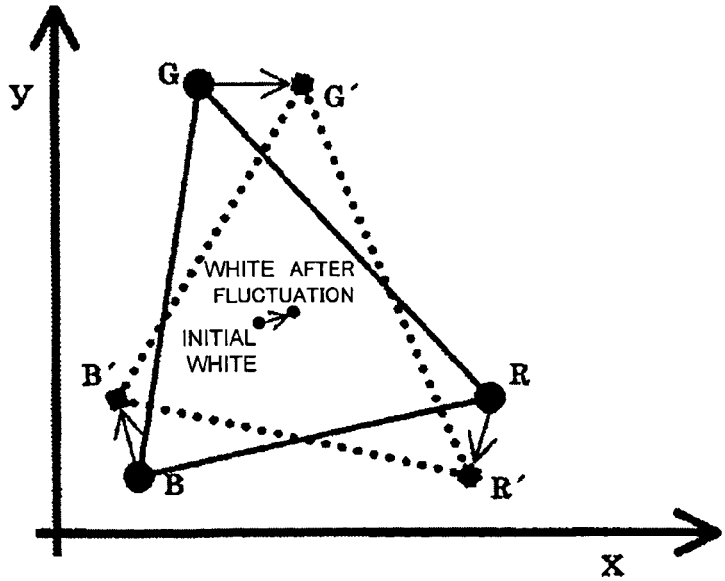

FIG. 5
RGB Backlight Ambient Temp.-If Property
White Balance: x=0. 31、y=0. 31
Red=10mA
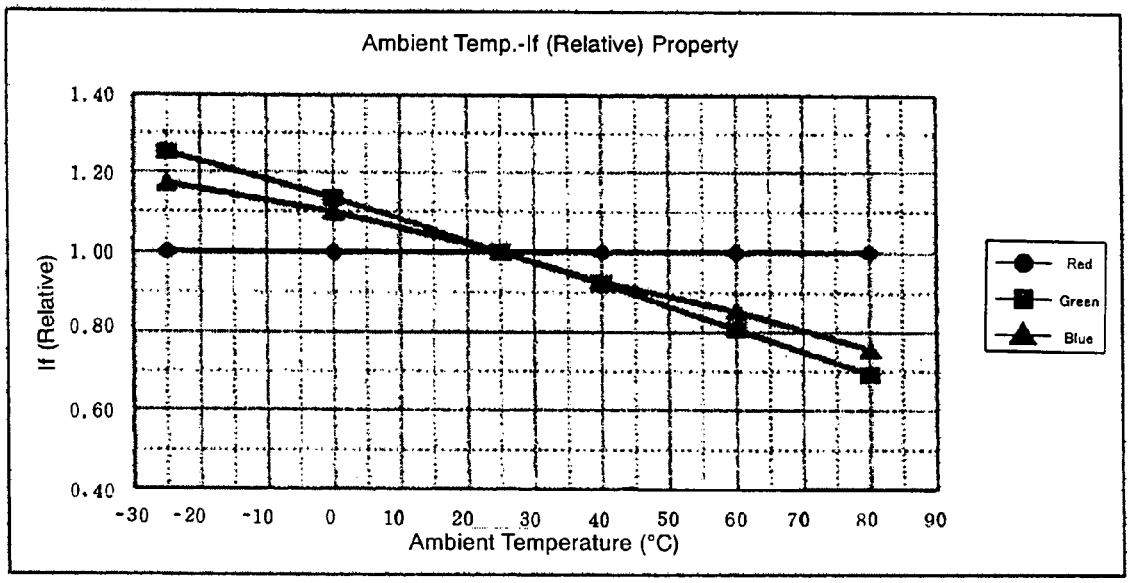
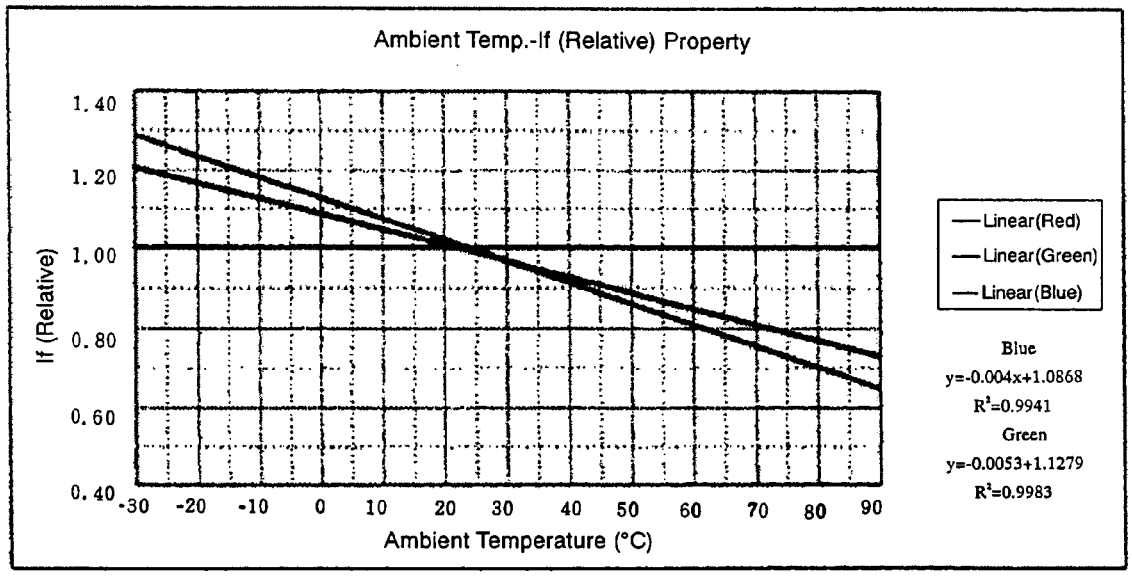

FIG. 6
RGB Backlight Ambient Temp.-If Property
White Balance: x=0. 31, y=0. 31
Red=15mA
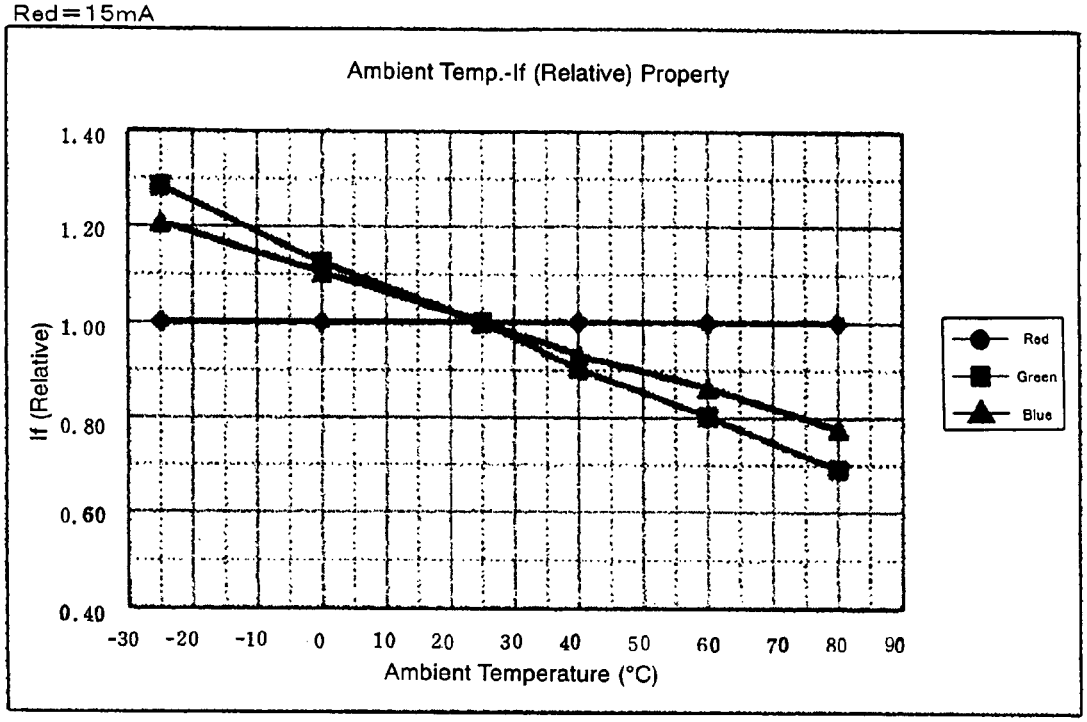
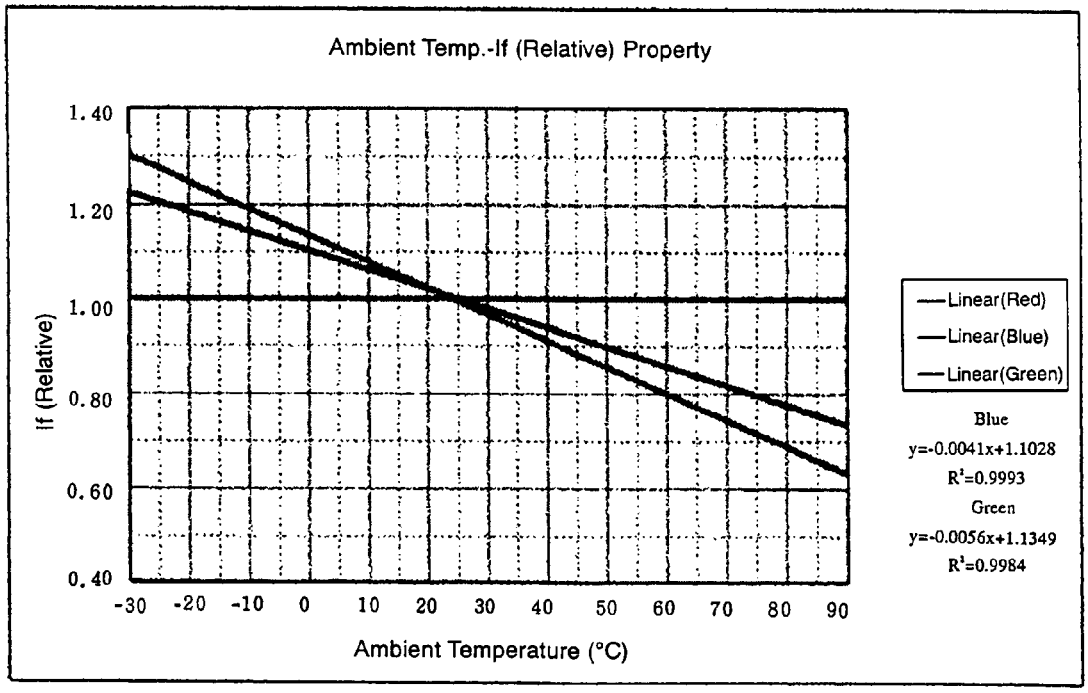

FIG. 7
RGB Backlight Ambient Temp.-If Property
White Balance: x=0. 31、y=0. 31
Red=20mA
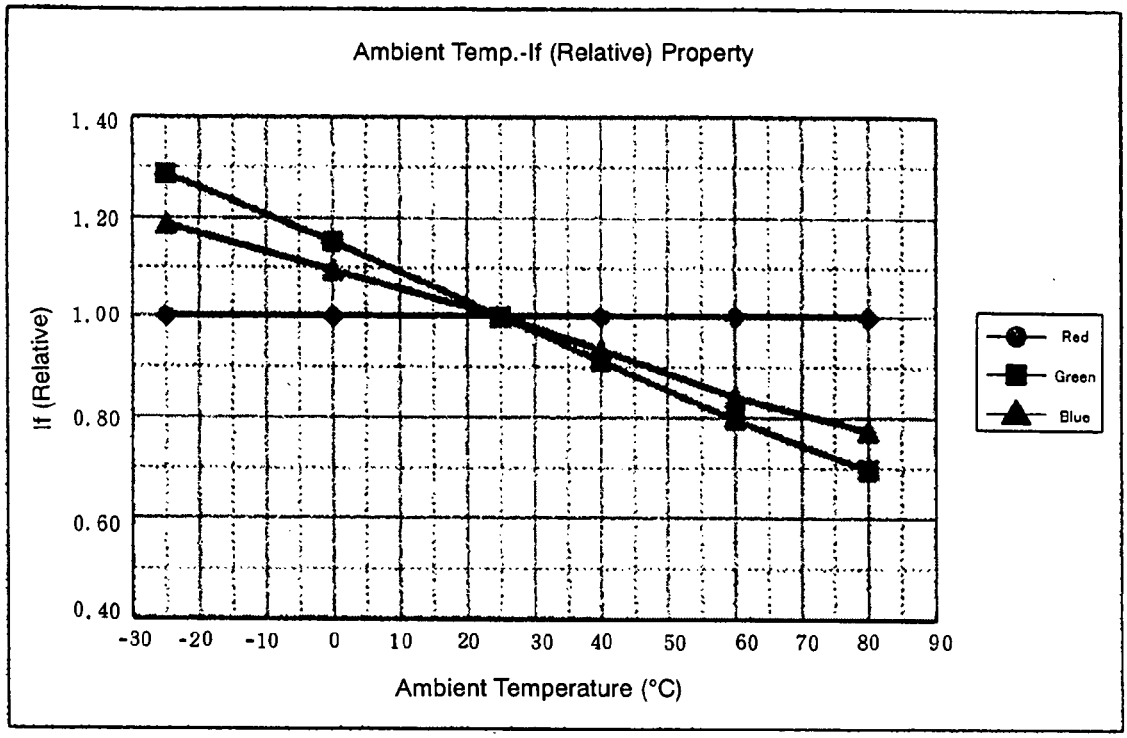
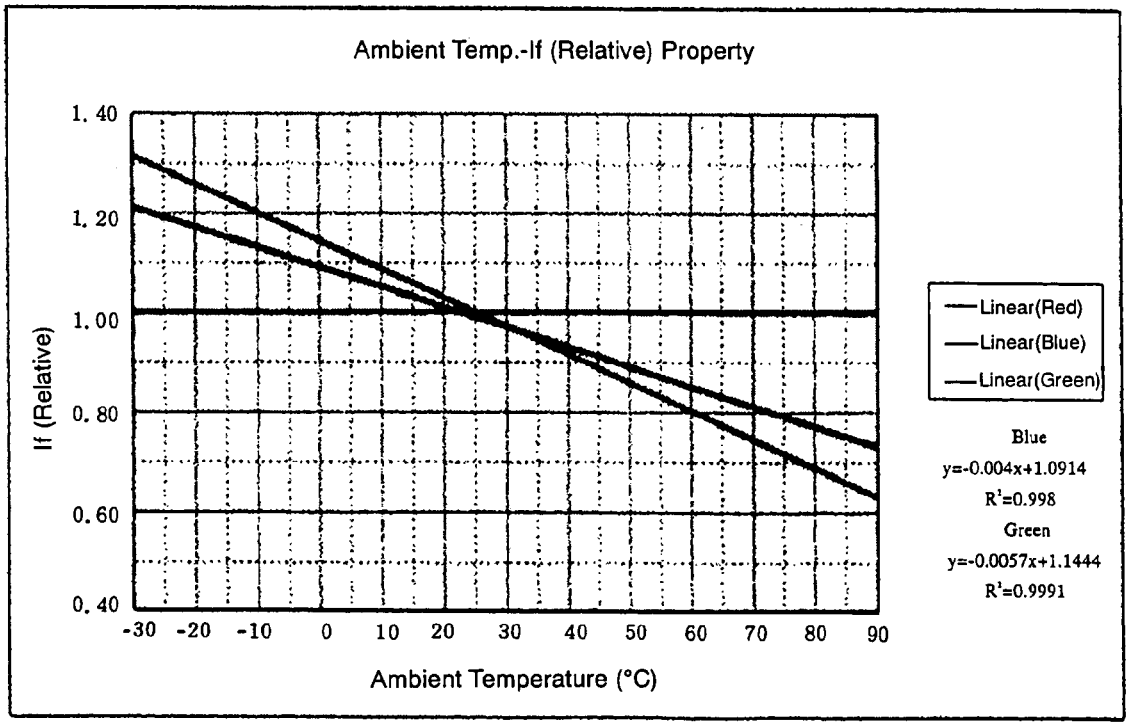

FIG. 8
RGB Backlight Ambient Temp.-If Property
White Balance: x=0. 31、y=0. 31
Red=25mA
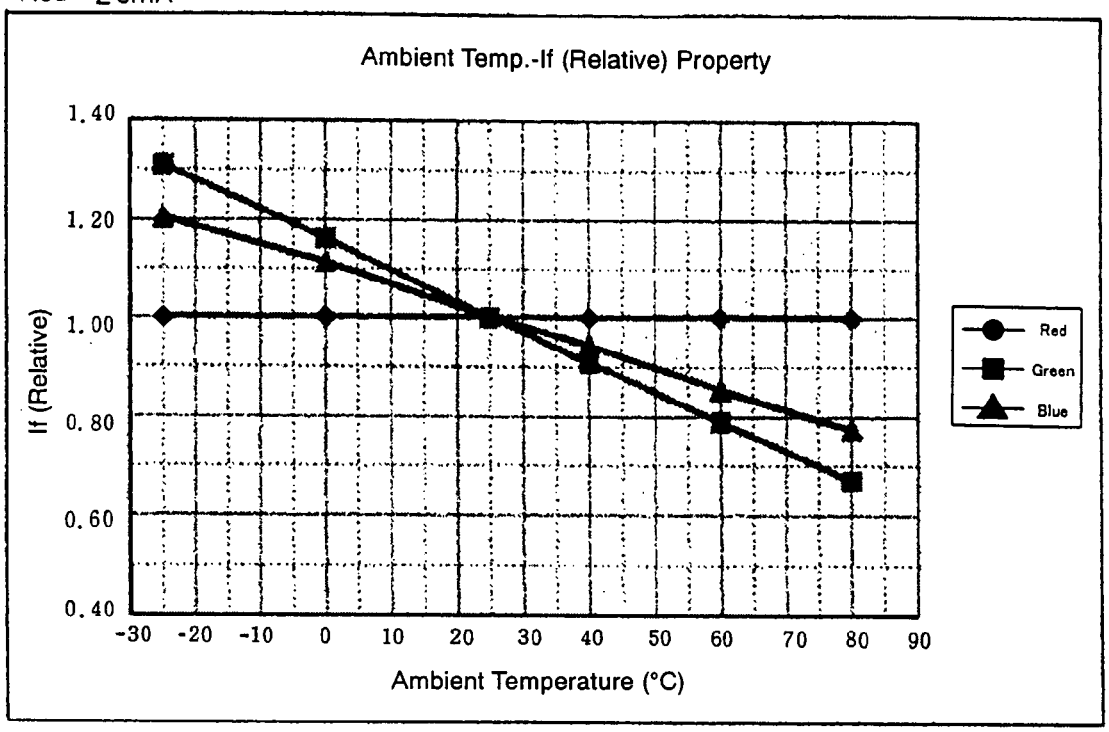
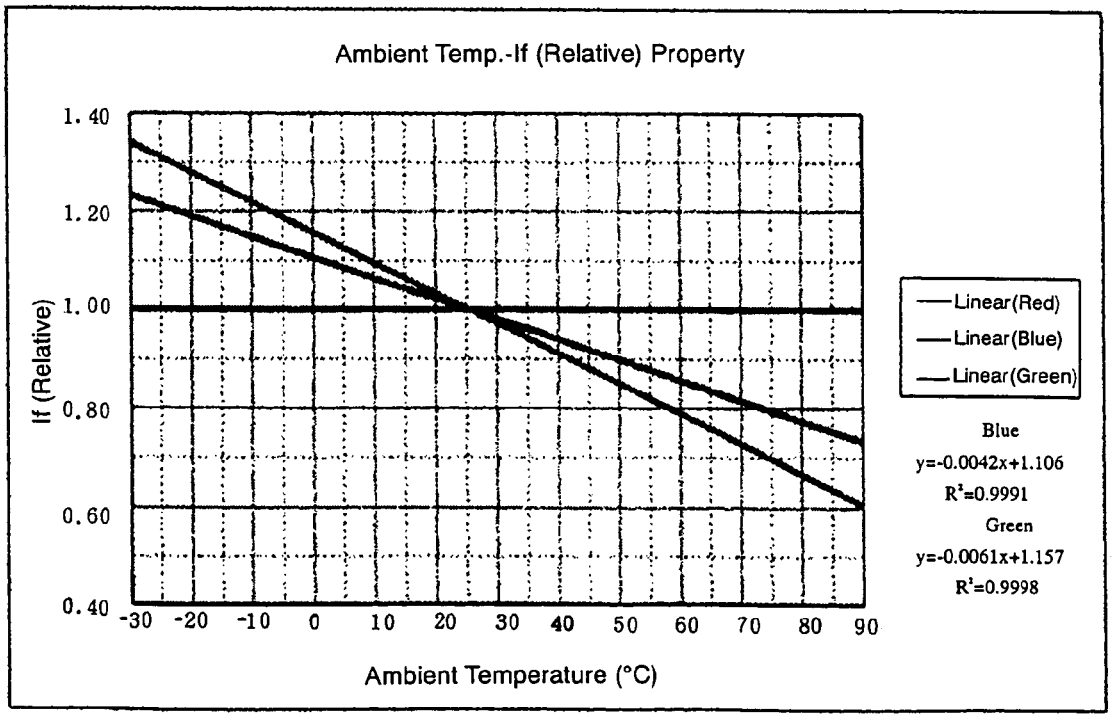

FIG. 10

RGB Backlight Ambient Temp.-White Bal. Property

White Balance: x=0. 31、y=0. 31

Red=10mA

| Ta(°C) | Luminance (cd/m²) | Relative Luminance | x | y | If(mA) | | | If (Relative Value) | | |
|---|---|---|---|---|---|---|---|---|---|---|
| | | | | | Red | Green | Blue | Red | Green | Blue |
| -25 | 1433 | 1.269 | 0.3103 | 0.3101 | 10 | 6.5 | 4.9 | 1.000 | 1.250 | 1.171 |
| 0 | 1281 | 1.136 | 0.3095 | 0.3093 | 10 | 5.9 | 4.5 | 1.000 | 1.135 | 1.098 |
| 25 | 1129 | 1.000 | 0.3094 | 0.3091 | 10 | 5.2 | 4.1 | 1.000 | 1.000 | 1.000 |
| 40 | 1032 | 0.914 | 0.3104 | 0.3108 | 10 | 4.8 | 3.8 | 1.000 | 0.923 | 0.927 |
| 60 | 895.3 | 0.793 | 0.3093 | 0.3091 | 10 | 4.2 | 3.5 | 1.000 | 0.808 | 0.854 |
| 80 | 761.5 | 0.674 | 0.3109 | 0.3102 | 10 | 3.8 | 3.1 | 1.000 | 0.692 | 0.756 |

Red=15mA

| Ta(°C) | Luminance (cd/m²) | Relative Luminance | x | y | If(mA) | | | If (Relative Value) | | |
|---|---|---|---|---|---|---|---|---|---|---|
| | | | | | Red | Green | Blue | Red | Green | Blue |
| -25 | 1947 | 1.218 | 0.3099 | 0.3099 | 15 | 10.4 | 7.0 | 1.000 | 1.284 | 1.207 |
| 0 | 1726 | 1.139 | 0.3099 | 0.3093 | 15 | 9.1 | 6.4 | 1.000 | 1.123 | 1.103 |
| 25 | 1516 | 1.000 | 0.3100 | 0.3109 | 15 | 8.1 | 5.8 | 1.000 | 1.000 | 1.000 |
| 40 | 1394 | 0.920 | 0.3103 | 0.3101 | 15 | 7.3 | 5.5 | 1.000 | 0.901 | 0.931 |
| 60 | 1229 | 0.811 | 0.3093 | 0.3095 | 15 | 6.5 | 5.0 | 1.000 | 0.802 | 0.862 |
| 80 | 1054 | 0.702 | 0.3103 | 0.3097 | 15 | 5.6 | 4.5 | 1.000 | 0.691 | 0.776 |

Red=20mA

| Ta(°C) | Luminance (cd/m²) | Relative Luminance | x | y | If(mA) | | | If (Relative Value) | | |
|---|---|---|---|---|---|---|---|---|---|---|
| | | | | | Red | Green | Blue | Red | Green | Blue |
| -25 | 2296 | 1.266 | 0.3101 | 0.3101 | 20 | 14.4 | 8.9 | 1.000 | 1.286 | 1.171 |
| 0 | 2050 | 1.130 | 0.3101 | 0.3107 | 20 | 12.9 | 8.2 | 1.000 | 1.152 | 1.093 |
| 25 | 1814 | 1.000 | 0.3097 | 0.3097 | 20 | 11.2 | 7.5 | 1.000 | 1.000 | 1.000 |
| 40 | 1697 | 0.938 | 0.3095 | 0.3098 | 20 | 10.2 | 7.0 | 1.000 | 0.911 | 0.933 |
| 60 | 1509 | 0.832 | 0.3105 | 0.3108 | 20 | 8.9 | 6.3 | 1.000 | 0.795 | 0.840 |
| 80 | 1320 | 0.728 | 0.3095 | 0.3103 | 20 | 7.8 | 5.8 | 1.000 | 0.696 | 0.773 |

Red=25mA

| Ta(°C) | Luminance (cd/m²) | Relative Luminance | x | y | If(mA) | | | If (Relative Value) | | |
|---|---|---|---|---|---|---|---|---|---|---|
| | | | | | Red | Green | Blue | Red | Green | Blue |
| -25 | 2805 | 1.285 | 0.3100 | 0.3096 | 25 | 18.6 | 10.6 | 1.000 | 1.310 | 1.205 |
| 0 | 2471 | 1.132 | 0.3099 | 0.3099 | 25 | 16.5 | 9.8 | 1.000 | 1.162 | 1.114 |
| 25 | 2183 | 1.000 | 0.3104 | 0.3105 | 25 | 14.2 | 8.8 | 1.000 | 1.000 | 1.000 |
| 40 | 2022 | 0.926 | 0.3099 | 0.3097 | 25 | 12.9 | 8.3 | 1.000 | 0.908 | 0.943 |
| 60 | 1794 | 0.822 | 0.3104 | 0.3102 | 25 | 11.2 | 7.5 | 1.000 | 0.789 | 0.852 |
| 80 | 1521 | 0.897 | 0.3101 | 0.3099 | 25 | 9.5 | 6.8 | 1.000 | 0.559 | 0.773 |

FIG. 11
RGB Backlight Ambient Temp.-If Property
White Balance: x=0. 29、y=0. 29
Red=10mA
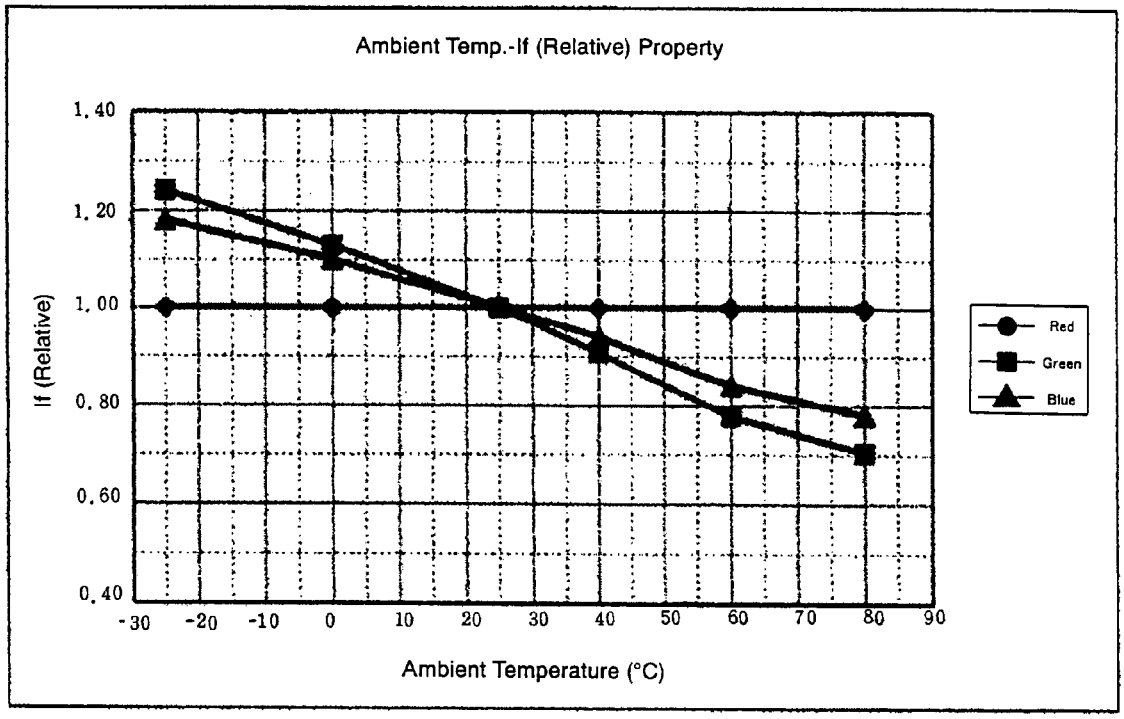
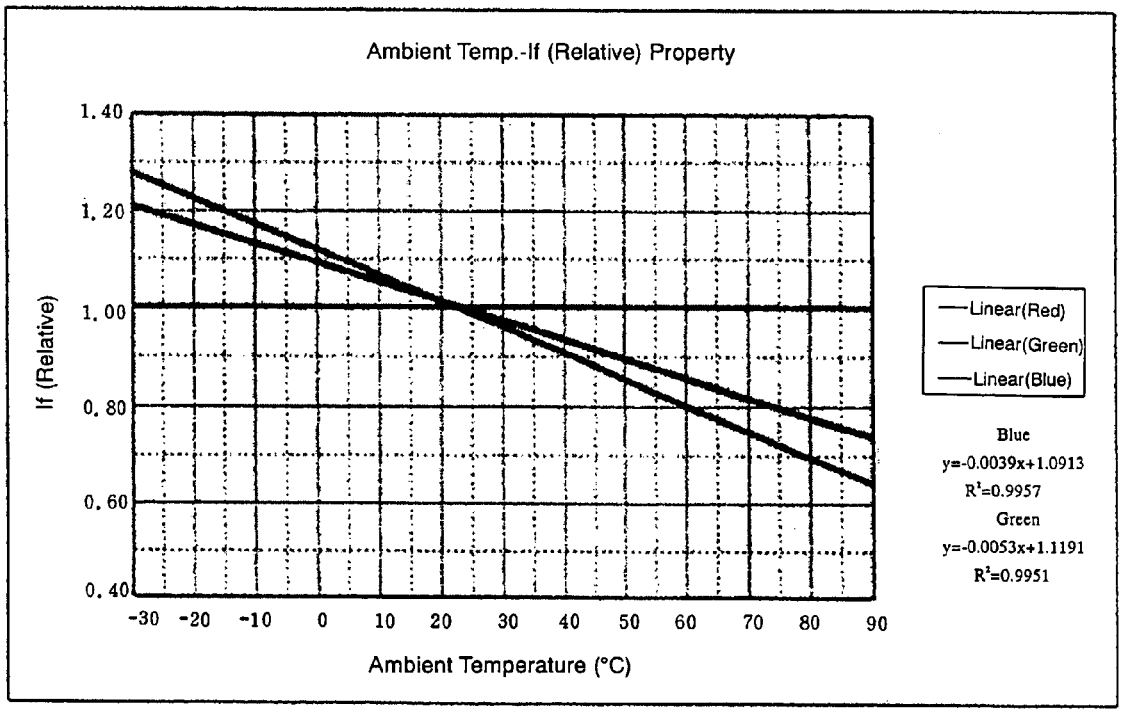

FIG. 12
RGB Backlight Ambient Temp.-If Property
White Balance: x=0. 29、y=0. 29
Red=15mA
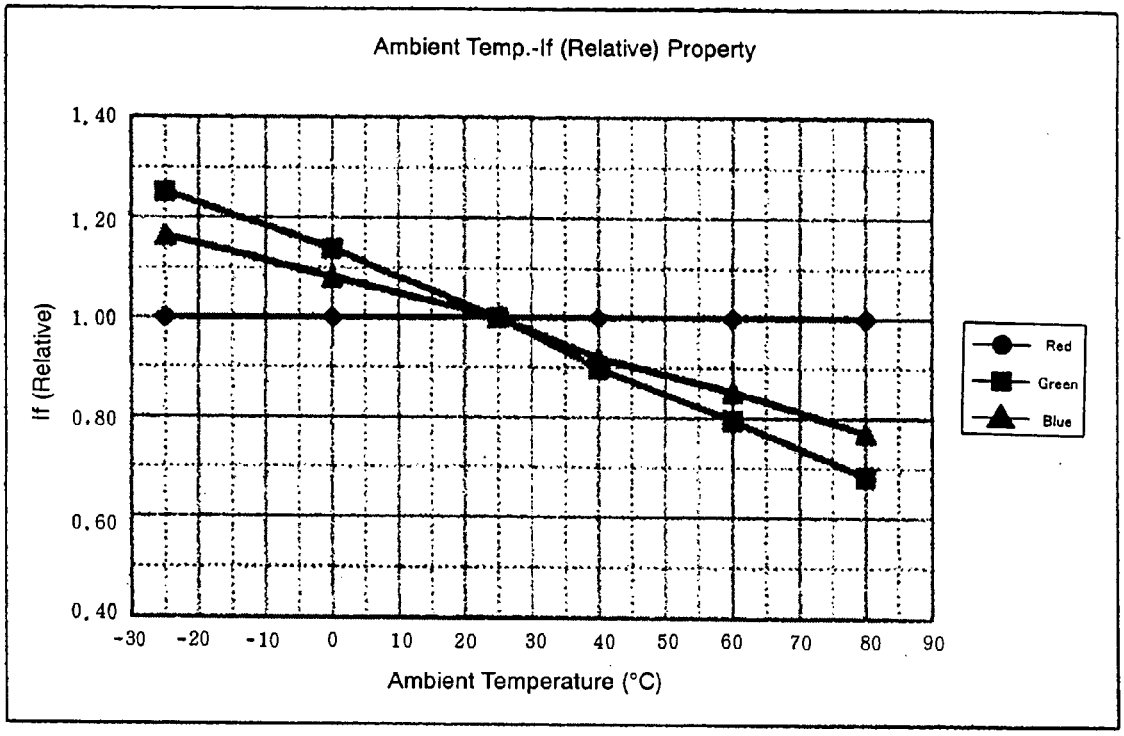
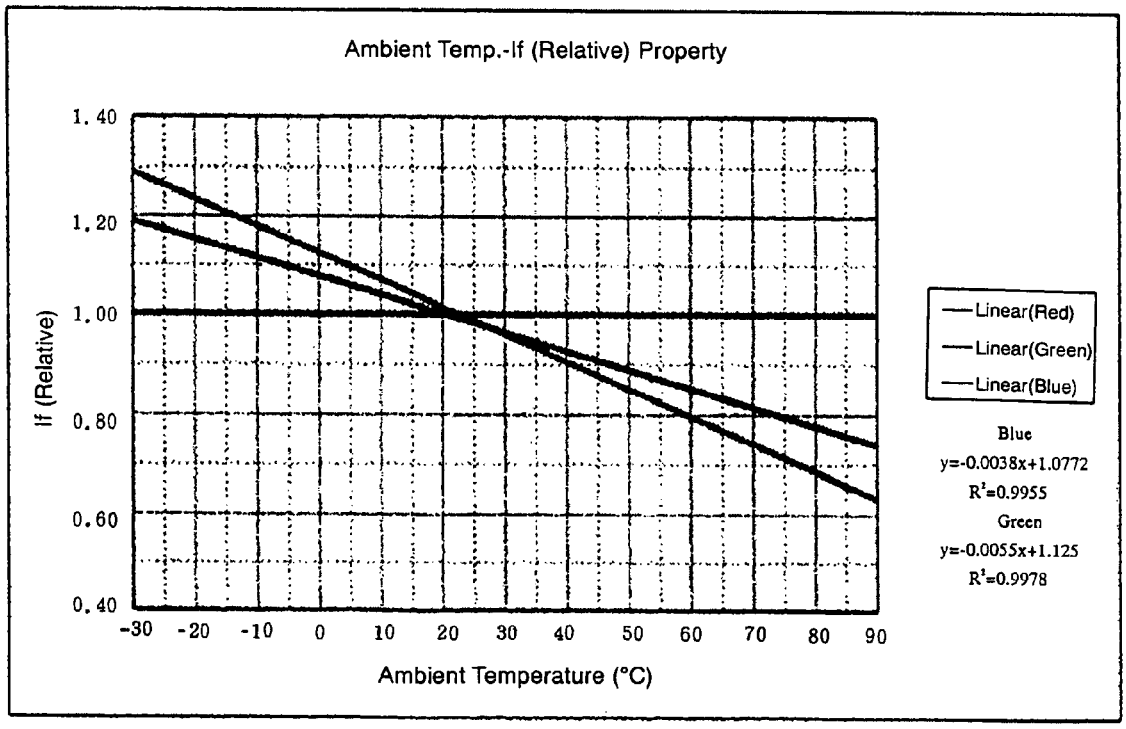

FIG. 13
RGB Backlight Ambient Temp.-If Property
White Balance: x=0. 29、y=0. 29
Red=20mA
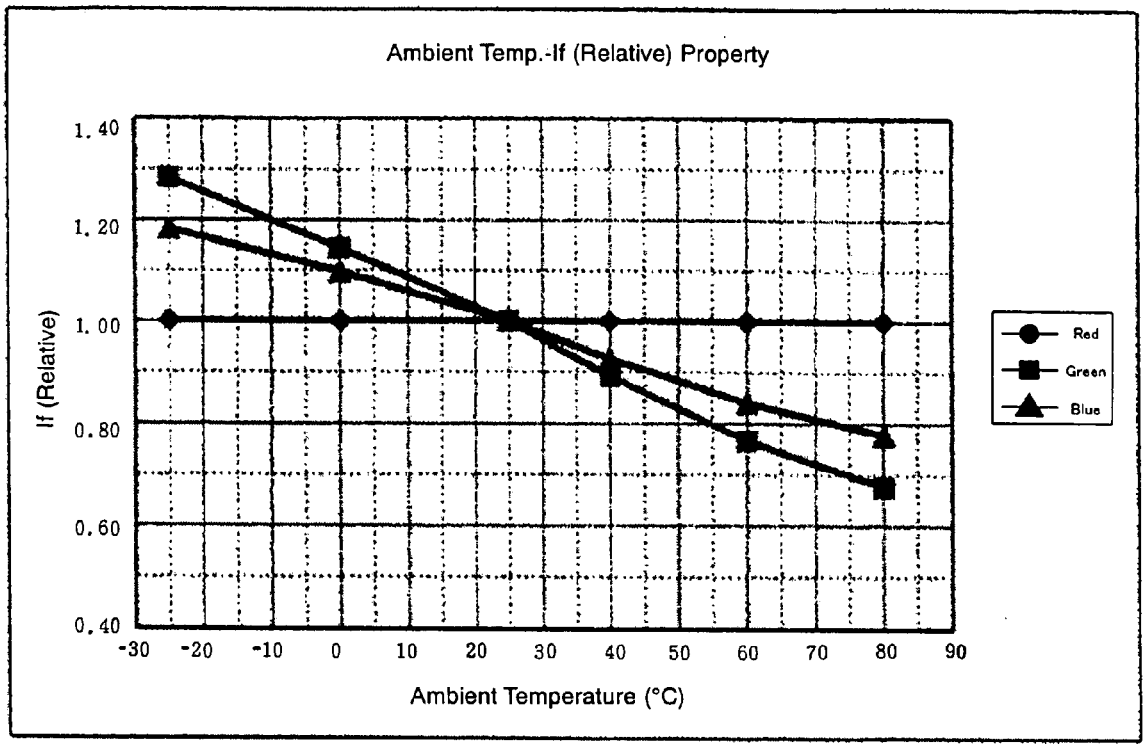
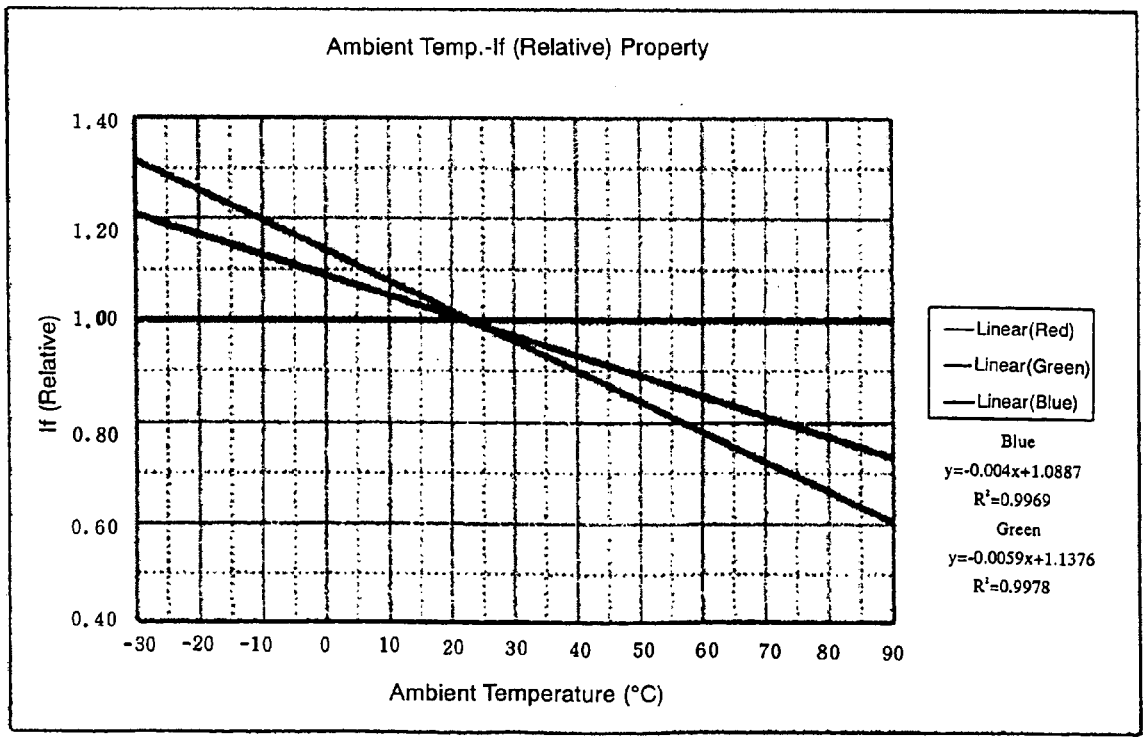

FIG. 14
RGB Backlight Ambient Temp.-If Property
White Balance: x=0. 29、y=0. 29
Red=25mA
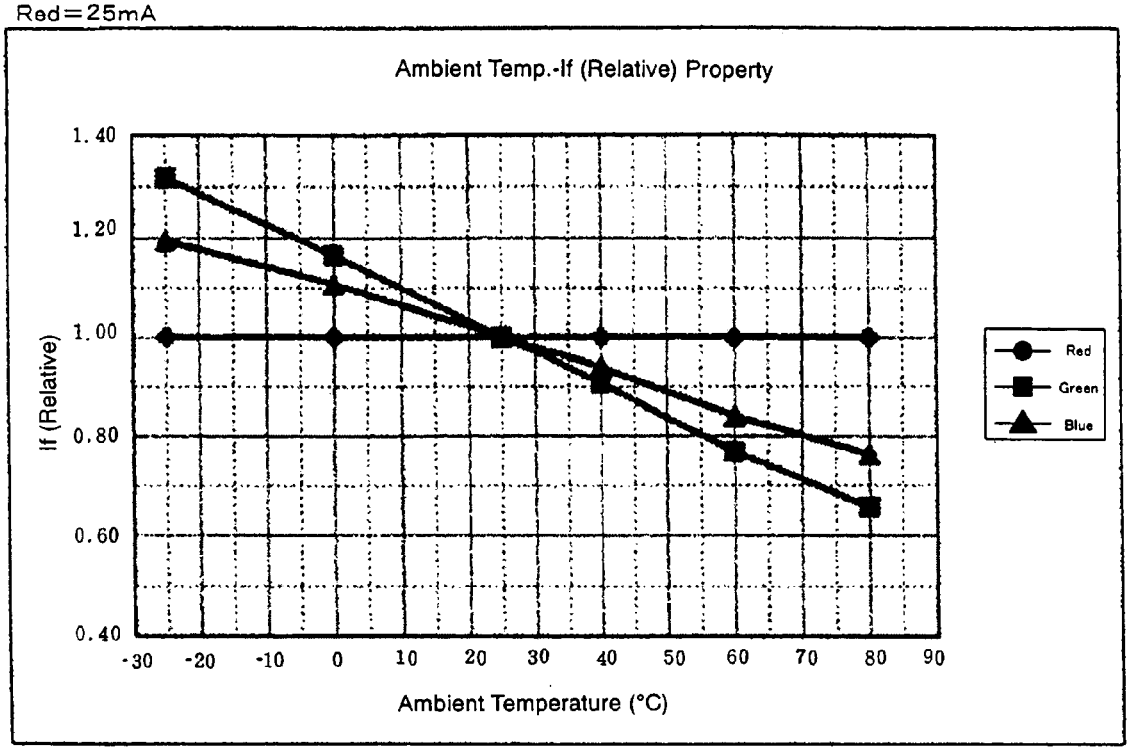
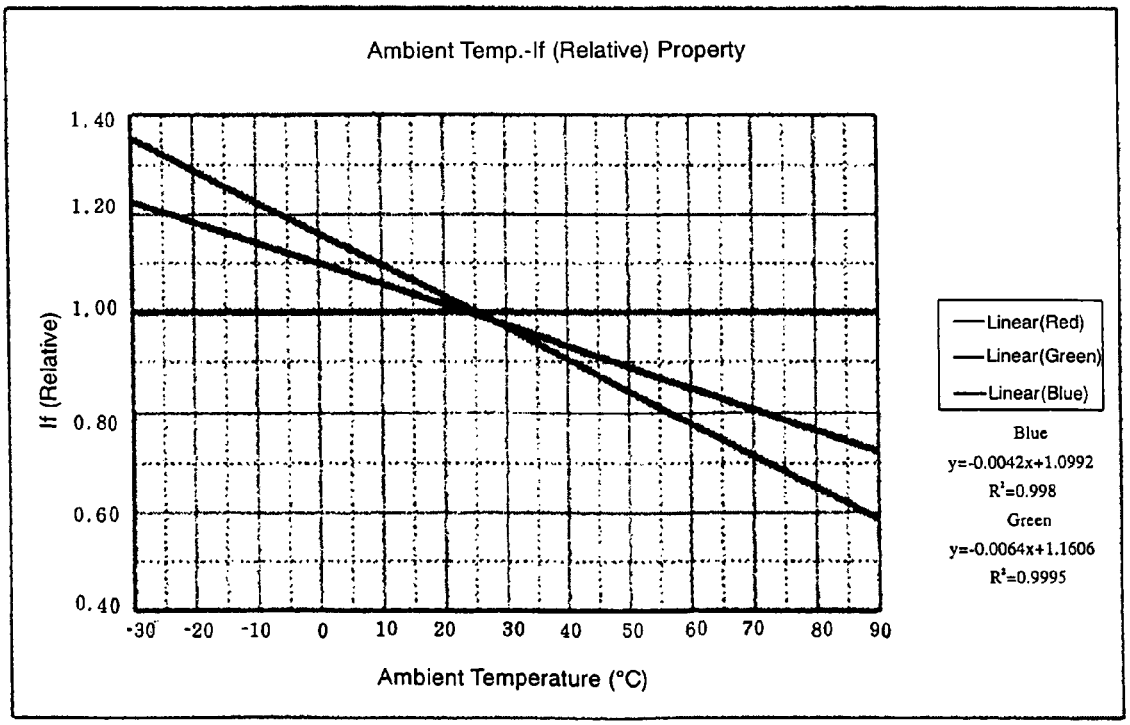

FIG. 15
RGB Backlight Ambient Temp.-If Property
White Balance : x=0. 29、y=0. 29
Red=10mA
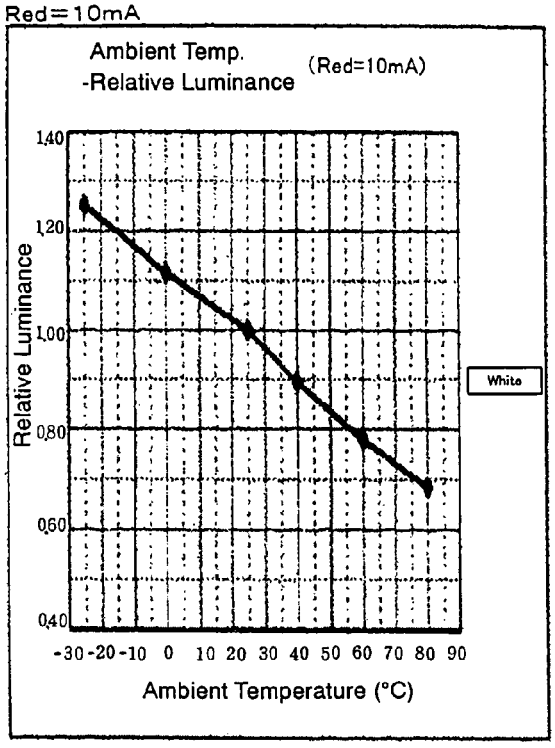
RGB Backlight Ambient Temp.-If Property
White Balance : x=0. 29、y=0. 29
Red=20mA
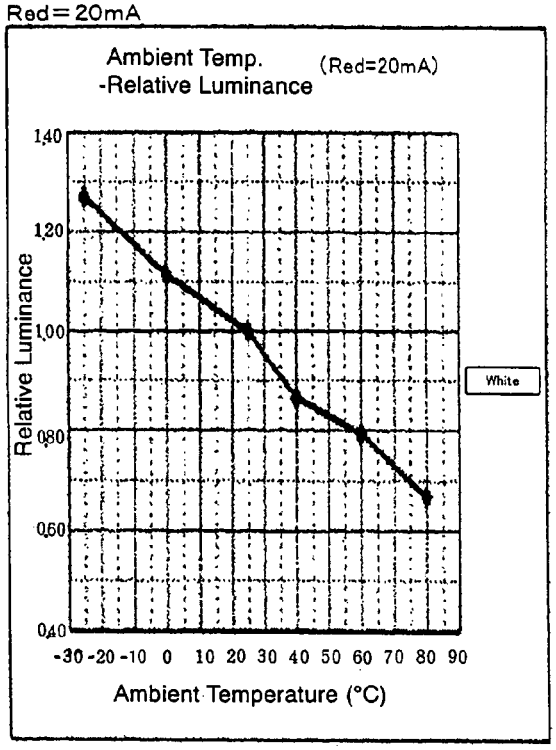
Red=15mA
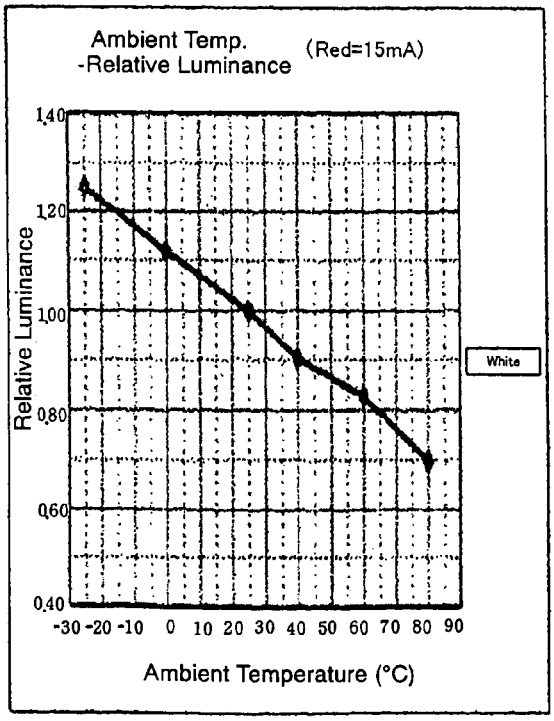
Red=25mA
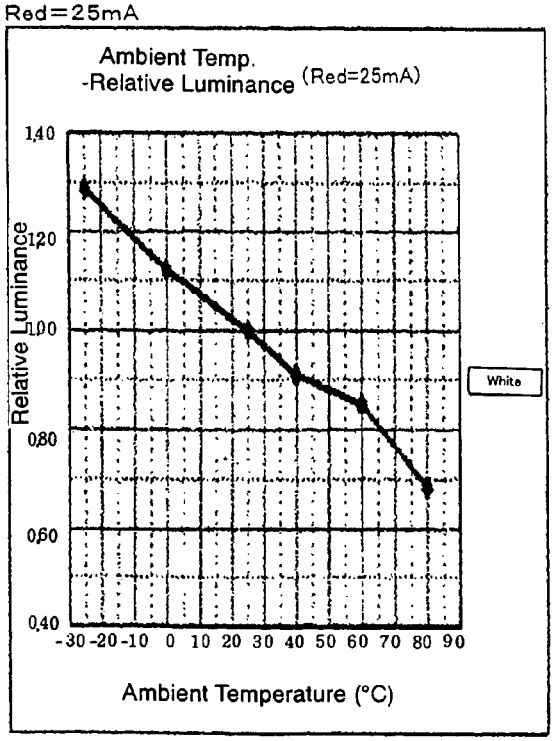

FIG. 16

RGB Backlight Ambient Temp.-White Bal. Property

White Balance: x=0. 29、y=0. 29

Red=10mA

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 1434 | 1.251 | 0.2906 | 0.2901 | 10 | 6.7 | 5.9 | 1.000 | 1.241 | 1.180 |
| 0 | 1280 | 1.117 | 0.2899 | 0.2904 | 10 | 6.1 | 5.5 | 1.000 | 1.130 | 1.100 |
| 25 | 1146 | 1.000 | 0.2896 | 0.2908 | 10 | 5.4 | 5.0 | 1.000 | 1.000 | 1.000 |
| 40 | 1024 | 0.894 | 0.2897 | 0.2896 | 10 | 4.9 | 4.7 | 1.000 | 0.907 | 0.940 |
| 60 | 892.2 | 0.779 | 0.2908 | 0.2896 | 10 | 4.2 | 4.2 | 1.000 | 0.778 | 0.840 |
| 80 | 784 | 0.684 | 0.2899 | 0.2906 | 10 | 3.8 | 3.9 | 1.000 | 0.704 | 0.780 |

Red=15mA

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 1959 | 1.251 | 0.2903 | 0.2896 | 15 | 11.0 | 8.6 | 1.000 | 1.250 | 1.162 |
| 0 | 1750 | 1.117 | 0.2905 | 0.2905 | 15 | 10.0 | 8.0 | 1.000 | 1.136 | 1.081 |
| 25 | 1566 | 1.000 | 0.2892 | 0.2897 | 15 | 8.8 | 7.4 | 1.000 | 1.000 | 1.000 |
| 40 | 1414 | 0.903 | 0.2908 | 0.2906 | 15 | 7.9 | 6.8 | 1.000 | 0.898 | 0.919 |
| 60 | 1297 | 0.828 | 0.2892 | 0.2902 | 15 | 7.0 | 6.3 | 1.000 | 0.795 | 0.851 |
| 80 | 1090 | 0.696 | 0.2899 | 0.2901 | 15 | 8.0 | 5.7 | 1.000 | 0.682 | 0.770 |

Red=20mA

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 2501 | 1.270 | 0.2901 | 0.2898 | 20 | 15.4 | 11.1 | 1.000 | 1.283 | 1.181 |
| 0 | 2194 | 1.114 | 0.2899 | 0.2898 | 20 | 13.7 | 10.3 | 1.000 | 1.142 | 1.096 |
| 25 | 1970 | 1.000 | 0.2894 | 0.2902 | 20 | 12.0 | 9.4 | 1.000 | 1.000 | 1.000 |
| 40 | 1705 | 0.865 | 0.2901 | 0.2900 | 20 | 10.7 | 8.7 | 1.000 | 0.892 | 0.928 |
| 60 | 1564 | 0.794 | 0.2904 | 0.2900 | 20 | 9.2 | 7.9 | 1.000 | 0.767 | 0.840 |
| 80 | 1314 | 0.667 | 0.2900 | 0.2898 | 20 | 8.1 | 7.3 | 1.000 | 0.675 | 0.777 |

Red=25mA

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 2791 | 1.287 | 0.2900 | 0.2900 | 25 | 19.9 | 13.5 | 1.000 | 1.318 | 1.195 |
| 0 | 2430 | 1.121 | 0.2896 | 0.2899 | 25 | 17.6 | 12.5 | 1.000 | 1.166 | 1.105 |
| 25 | 2168 | 1.000 | 0.2899 | 0.2899 | 25 | 15.1 | 11.3 | 1.000 | 1.000 | 1.000 |
| 40 | 1947 | 0.911 | 0.2900 | 0.2900 | 25 | 13.7 | 10.6 | 1.000 | 0.907 | 0.938 |
| 60 | 1844 | 0.851 | 0.2903 | 0.2900 | 25 | 11.6 | 9.5 | 1.000 | 0.768 | 0.841 |
| 80 | 1481 | 0.683 | 0.2904 | 0.2901 | 25 | 9.9 | 8.6 | 1.000 | 0.656 | 0.761 |

FIG. 17
RGB Backlight Ambient Temp.-If Property
White Balance: x=0. 27、y=0. 27
Red=10mA
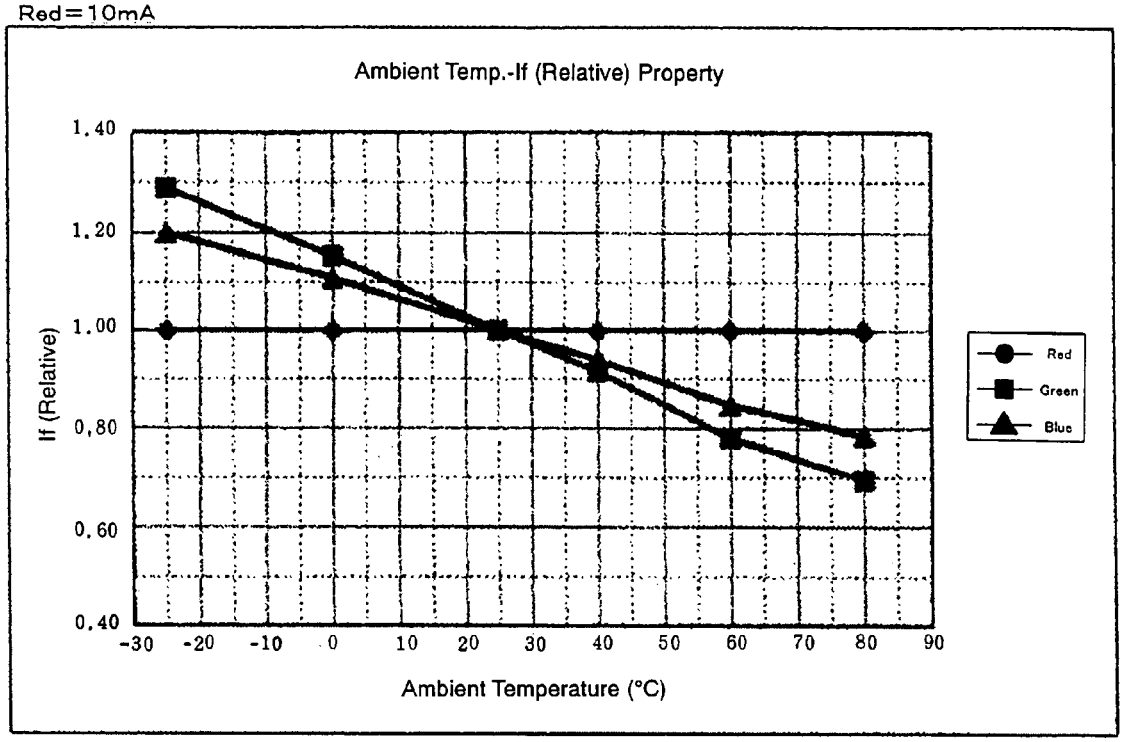
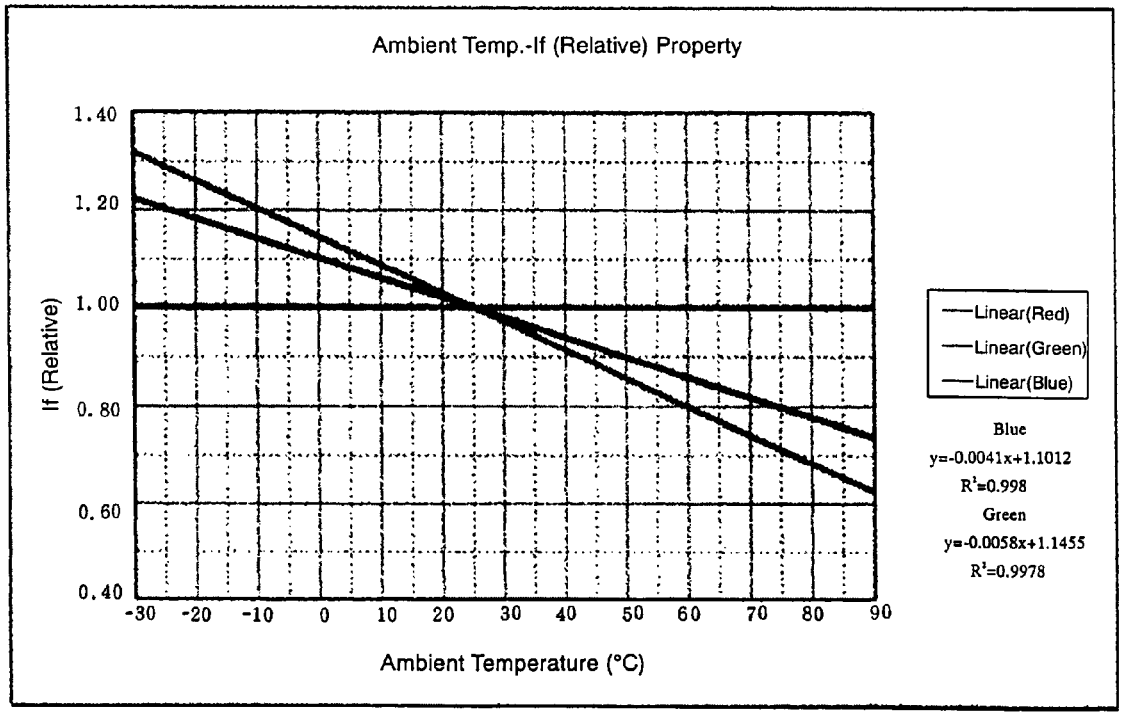

FIG. 18
RGB Backlight Ambient Temp.-If Property
White Balance : x=0. 27、y=0. 27
Red=15mA
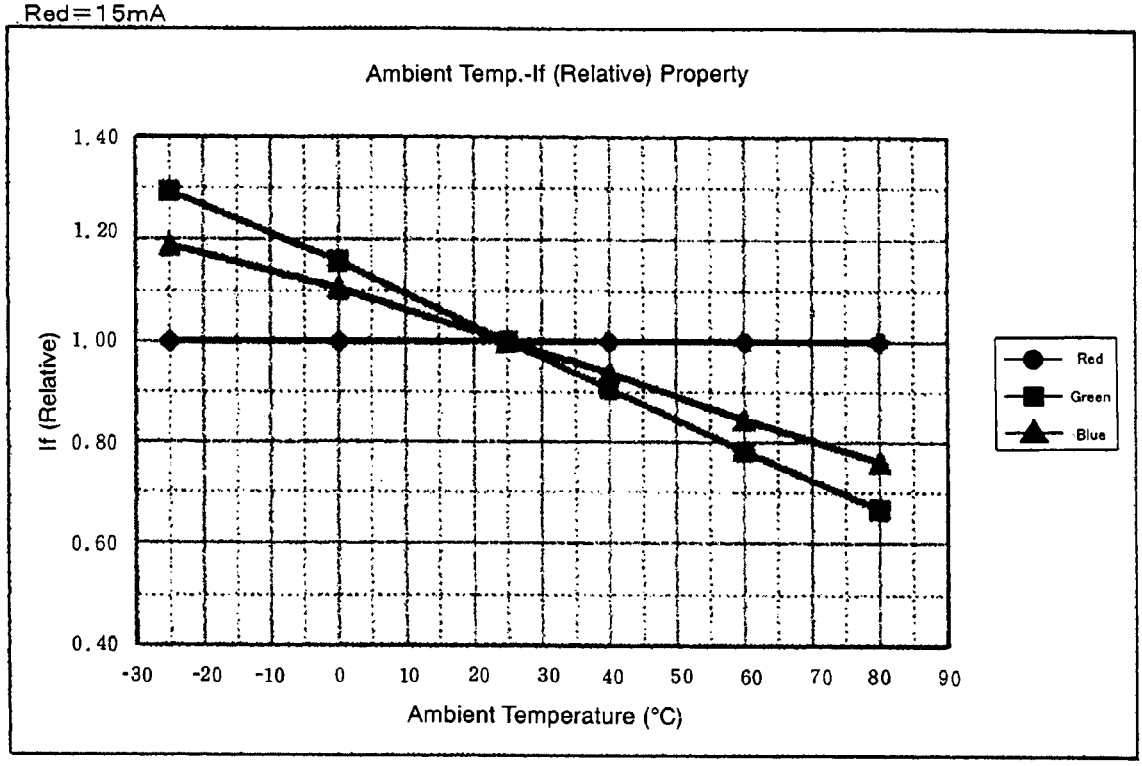
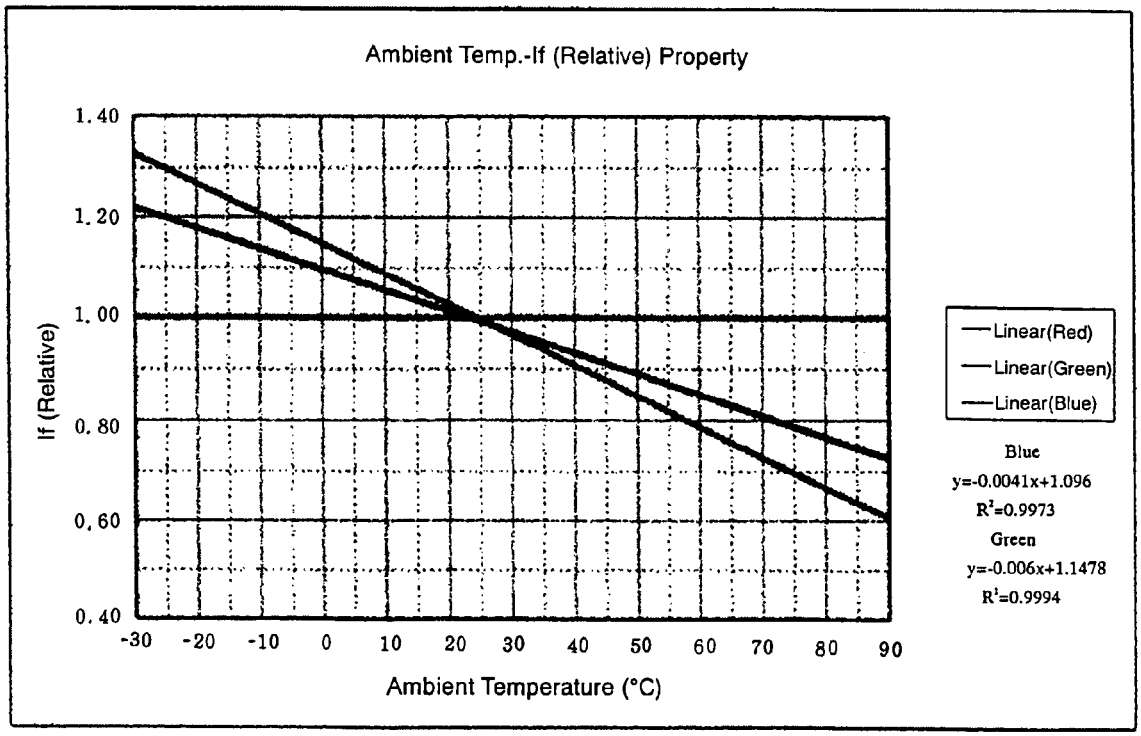

FIG. 19
RGB Backlight Ambient Temp.-If Property
White Balance: x=0. 27、y=0. 27
Red=20mA
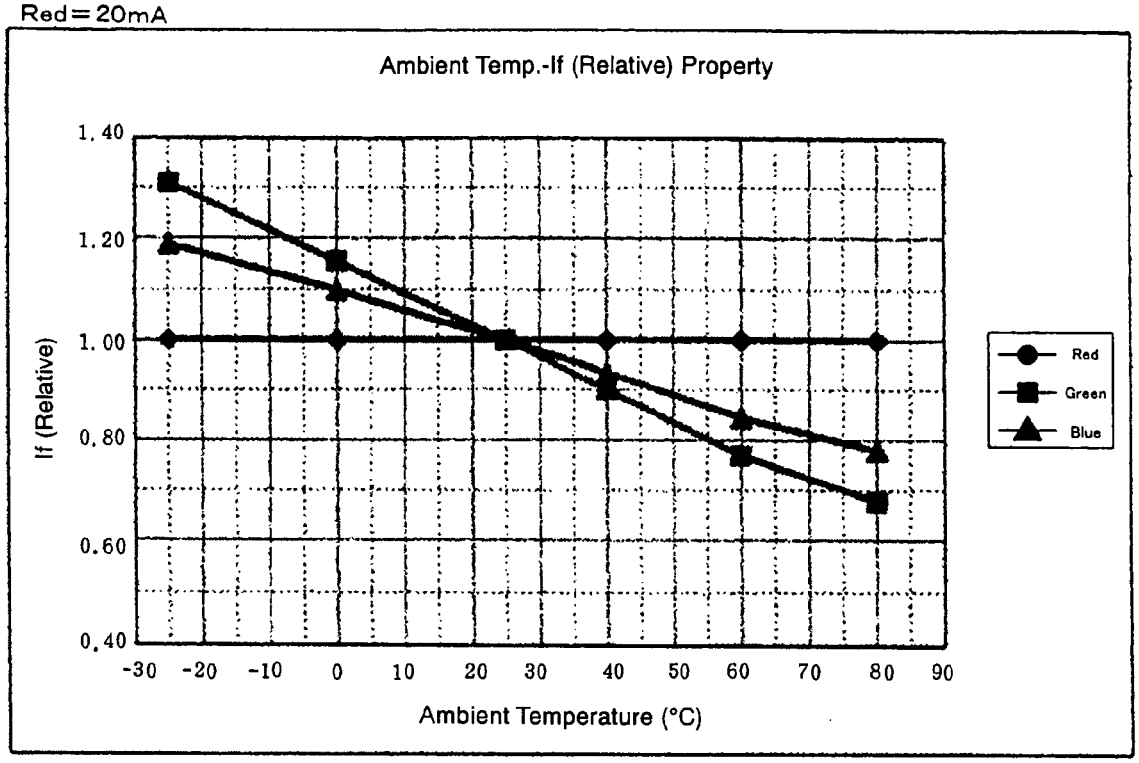
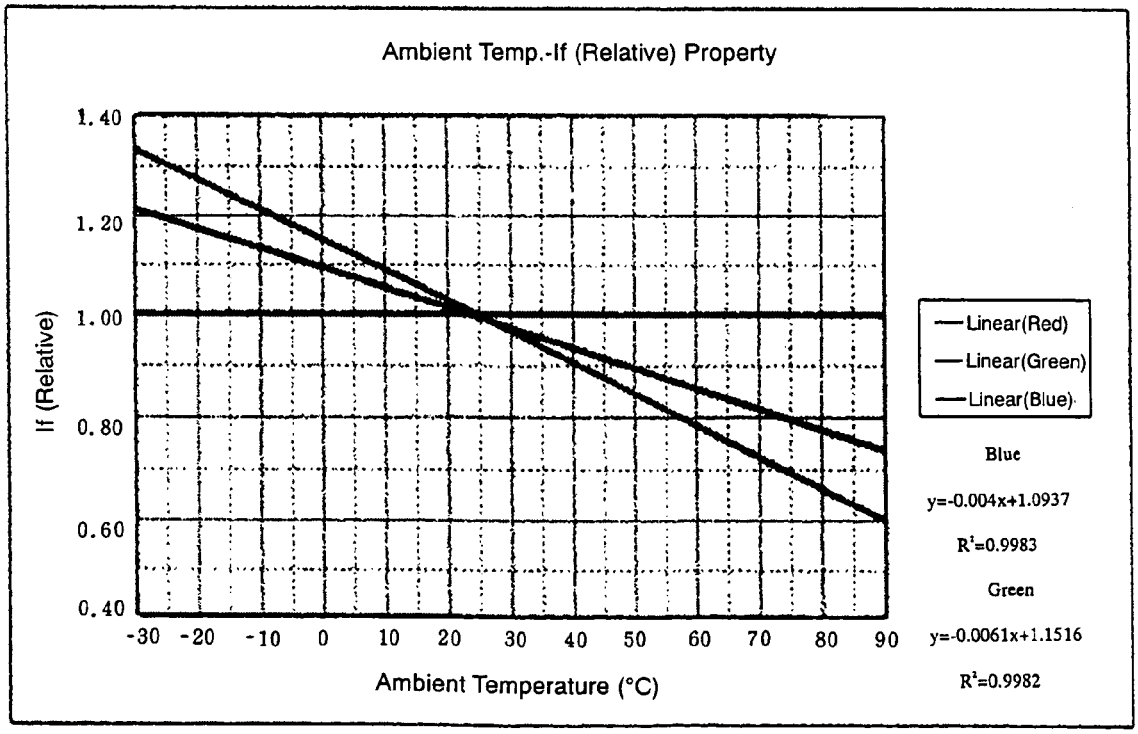

FIG. 20
RGB Backlight Ambient Temp.-If Property
White Balance : x=0. 27、y=0. 27
Red=25mA
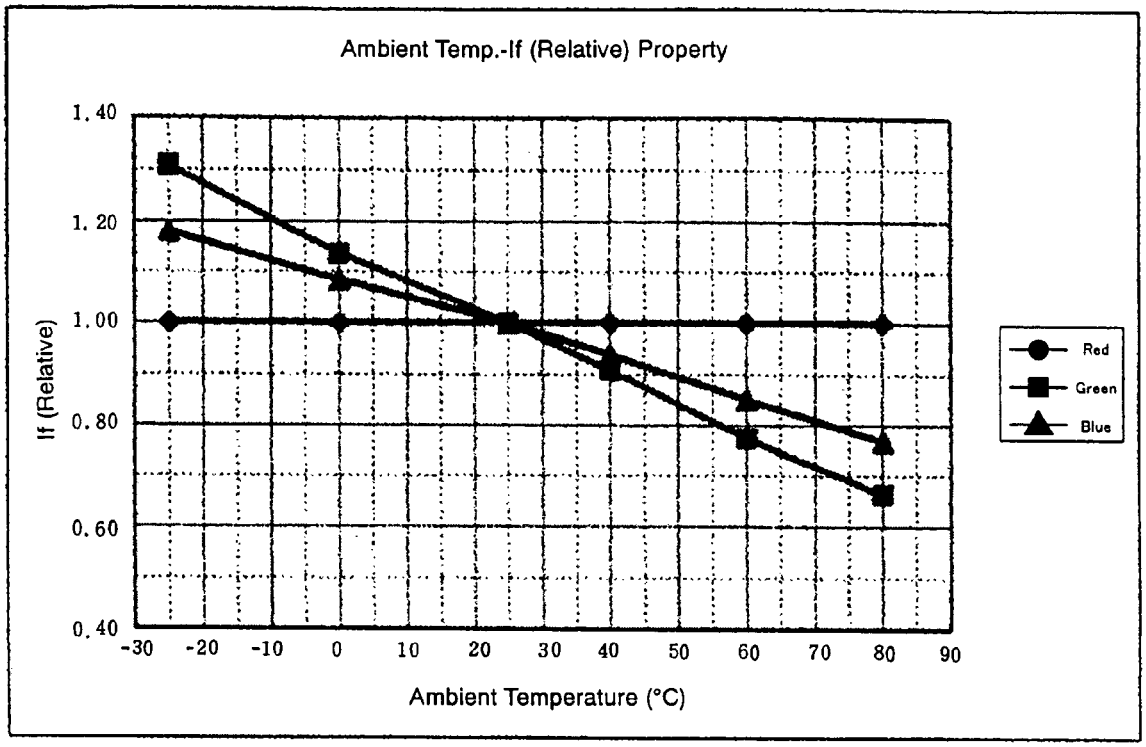
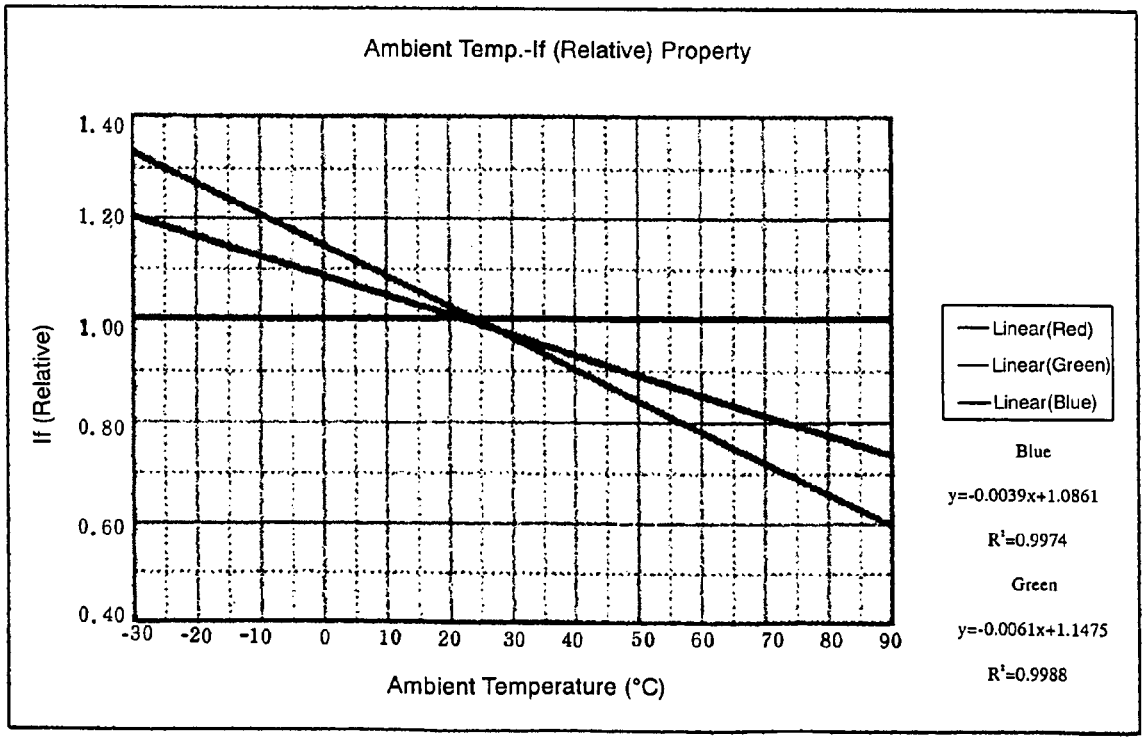

FIG. 22

RGB Backlight Ambient Temp.-White Bal. Property

White Balance: x=0. 27、y=0. 27

Red=10mA

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 1496 | 1.312 | 0.2696 | 0.2702 | 10 | 7.6 | 7.8 | 1.000 | 1.288 | 1.200 |
| 0 | 1299 | 1.139 | 0.2703 | 0.2702 | 10 | 6.8 | 7.2 | 1.000 | 1.153 | 1.108 |
| 25 | 1140 | 1.000 | 0.2703 | 0.2702 | 10 | 5.9 | 6.5 | 1.000 | 1.000 | 1.000 |
| 40 | 1019 | 0.894 | 0.2704 | 0.2701 | 10 | 5.4 | 6.1 | 1.000 | 0.915 | 0.938 |
| 60 | 945.9 | 0.830 | 0.2706 | 0.2693 | 10 | 4.6 | 5.5 | 1.000 | 0.780 | 0.846 |
| 80 | 780.5 | 0.685 | 0.2691 | 0.2693 | 10 | 4.1 | 5.1 | 1.000 | 0.695 | 0.785 |

Red=15mA

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 2099 | 1.288 | 0.2698 | 0.2701 | 15 | 12.4 | 11.4 | 1.000 | 1.292 | 1.188 |
| 0 | 1847 | 1.133 | 0.2699 | 0.2700 | 15 | 11.1 | 10.6 | 1.000 | 1.156 | 1.104 |
| 25 | 1630 | 1.000 | 0.2702 | 0.2700 | 15 | 9.6 | 9.6 | 1.000 | 1.000 | 1.000 |
| 40 | 1488 | 0.913 | 0.2701 | 0.2698 | 15 | 8.7 | 9.0 | 1.000 | 0.906 | 0.938 |
| 60 | 1381 | 0.847 | 0.2697 | 0.2704 | 15 | 7.5 | 8.1 | 1.000 | 0.781 | 0.844 |
| 80 | 1089 | 0.686 | 0.2700 | 0.2701 | 15 | 6.4 | 7.3 | 1.000 | 0.667 | 0.760 |

Red=20mA

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 2596 | 1.305 | 0.2700 | 0.2702 | 20 | 17.0 | 14.5 | 1.000 | 1.308 | 1.189 |
| 0 | 2293 | 1.152 | 0.2702 | 0.2702 | 20 | 15.0 | 13.4 | 1.000 | 1.154 | 1.098 |
| 25 | 1990 | 1.000 | 0.2699 | 0.2701 | 20 | 13.0 | 12.2 | 1.000 | 1.000 | 1.000 |
| 40 | 1808 | 0.909 | 0.2702 | 0.2699 | 20 | 11.7 | 11.4 | 1.000 | 0.900 | 0.934 |
| 60 | 1646 | 0.827 | 0.2704 | 0.2702 | 20 | 10.0 | 10.3 | 1.000 | 0.769 | 0.844 |
| 80 | 1390 | 0.698 | 0.2698 | 0.2697 | 20 | 8.8 | 9.5 | 1.000 | 0.677 | 0.779 |

Red=25mA

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 2791 | 1.277 | 0.2703 | 0.2702 | 25 | 21.3 | 17.2 | 1.000 | 1.307 | 1.178 |
| 0 | 2468 | 1.129 | 0.2703 | 0.2699 | 25 | 18.5 | 15.8 | 1.000 | 1.135 | 1.082 |
| 25 | 2186 | 1.000 | 0.2698 | 0.2698 | 25 | 16.3 | 14.6 | 1.000 | 1.000 | 1.000 |
| 40 | 2016 | 0.922 | 0.2698 | 0.2699 | 25 | 14.8 | 13.7 | 1.000 | 0.908 | 0.938 |
| 60 | 1877 | 0.859 | 0.2698 | 0.2698 | 25 | 12.6 | 12.4 | 1.000 | 0.773 | 0.849 |
| 80 | 1588 | 0.726 | 0.2701 | 0.2703 | 25 | 10.8 | 11.2 | 1.000 | 0.663 | 0.767 |

FIG. 25

RGB Backlight Ambient Temp.-White Bal. Property

White Balance: x=0. 23、y=0. 23

Red=10mA

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 2015.0 | 1.3179 | 0.2300 | 0.2299 | 10.00 | 10.50 | 14.32 | 1.0000 | 1.3191 | 1.2084 |
| 0 | 1789.0 | 1.1700 | 0.2299 | 0.2300 | 10.00 | 9.27 | 13.19 | 1.0000 | 1.1646 | 1.1131 |
| 25 | 1529.0 | 1.0000 | 0.2300 | 0.2300 | 10.00 | 7.96 | 11.85 | 1.0000 | 1.0000 | 1.0000 |
| 40 | 1452.0 | 0.9496 | 0.2299 | 0.2300 | 10.00 | 7.24 | 11.14 | 1.0000 | 0.9095 | 0.9401 |
| 60 | 1296.0 | 0.8476 | 0.2300 | 0.2299 | 10.00 | 6.28 | 10.18 | 1.0000 | 0.7889 | 0.8591 |
| 80 | 1102.0 | 0.7207 | 0.2299 | 0.2299 | 10.00 | 5.37 | 9.24 | 1.0000 | 0.6746 | 0.7797 |

Red=15mA

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 2600 | 1.2316 | 0.2301 | 0.2301 | 15.00 | 16.68 | 20.77 | 1.0000 | 1.3312 | 1.2048 |
| 0 | 2332 | 1.1047 | 0.2299 | 0.2300 | 15.00 | 14.70 | 19.20 | 1.0000 | 1.1732 | 1.1137 |
| 25 | 2111 | 1.0000 | 0.2299 | 0.2301 | 15.00 | 12.53 | 17.24 | 1.0000 | 1.0000 | 1.0000 |
| 40 | 1965 | 0.9308 | 0.2299 | 0.2300 | 15.00 | 11.35 | 16.20 | 1.0000 | 0.9058 | 0.9397 |
| 60 | 1752 | 0.8299 | 0.2299 | 0.2300 | 15.00 | 9.87 | 14.86 | 1.0000 | 0.7877 | 0.8619 |
| 80 | 1502 | 0.7115 | 0.2299 | 0.2299 | 15.00 | 8.30 | 13.40 | 1.0000 | 0.6624 | 0.7773 |

FIG. 26
RGB Backlight Ambient Temp.-If Property
White Balance : x=0. 23、y=0. 23
Red=10mA
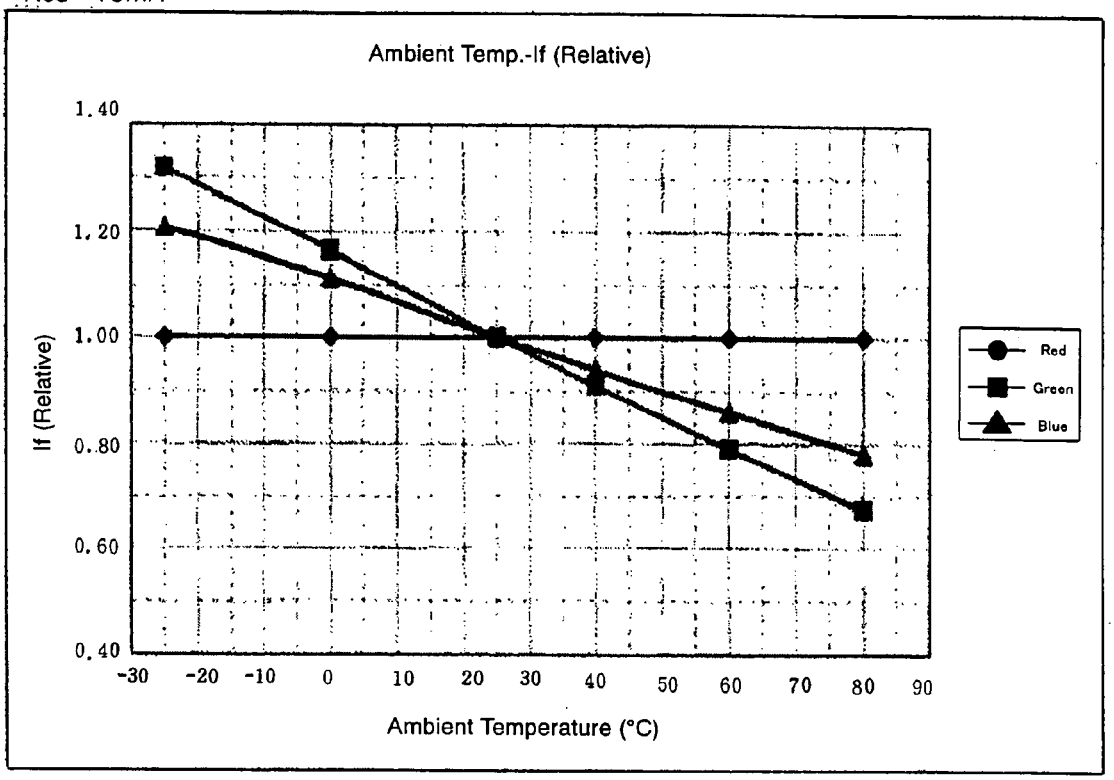
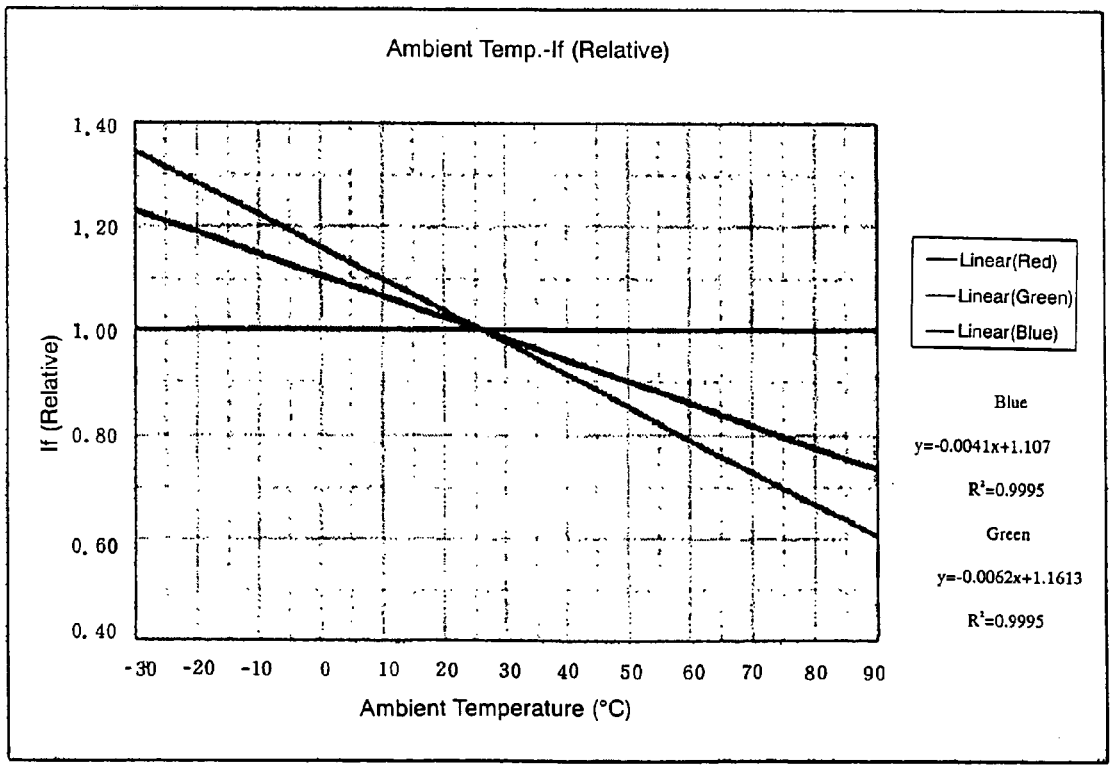

FIG. 27
RGB Backlight Ambient Temp.-If Property
White Balance : x=0. 23, y=0. 23
Red=15mA
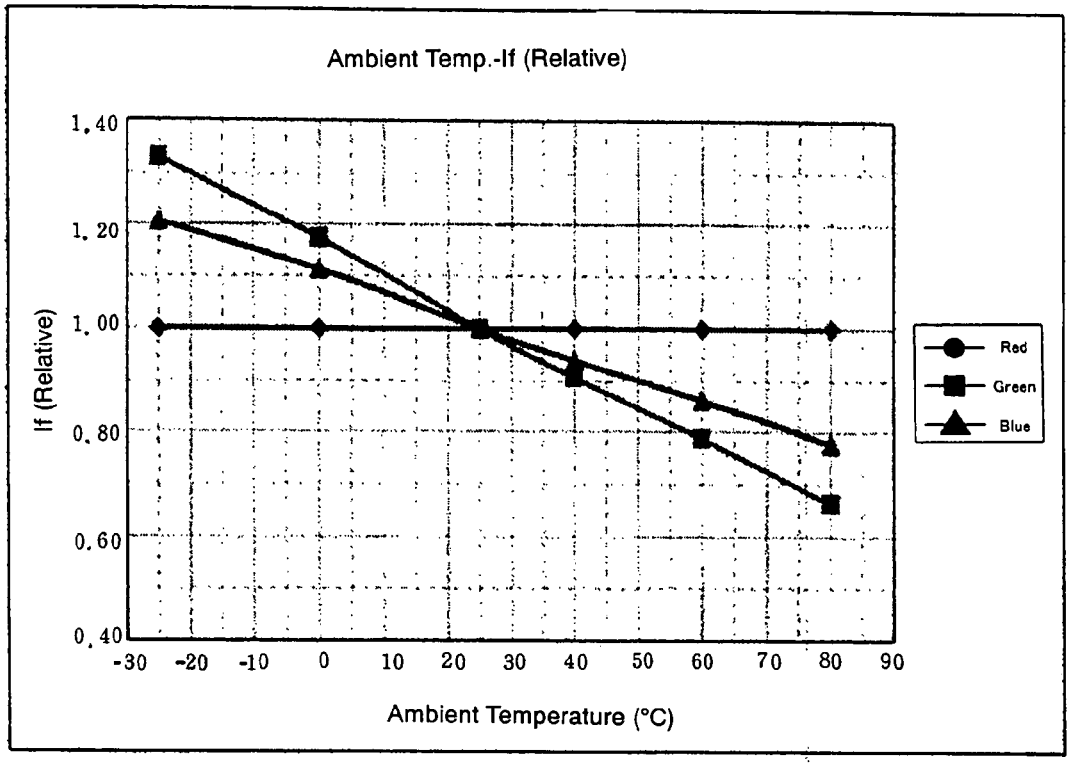
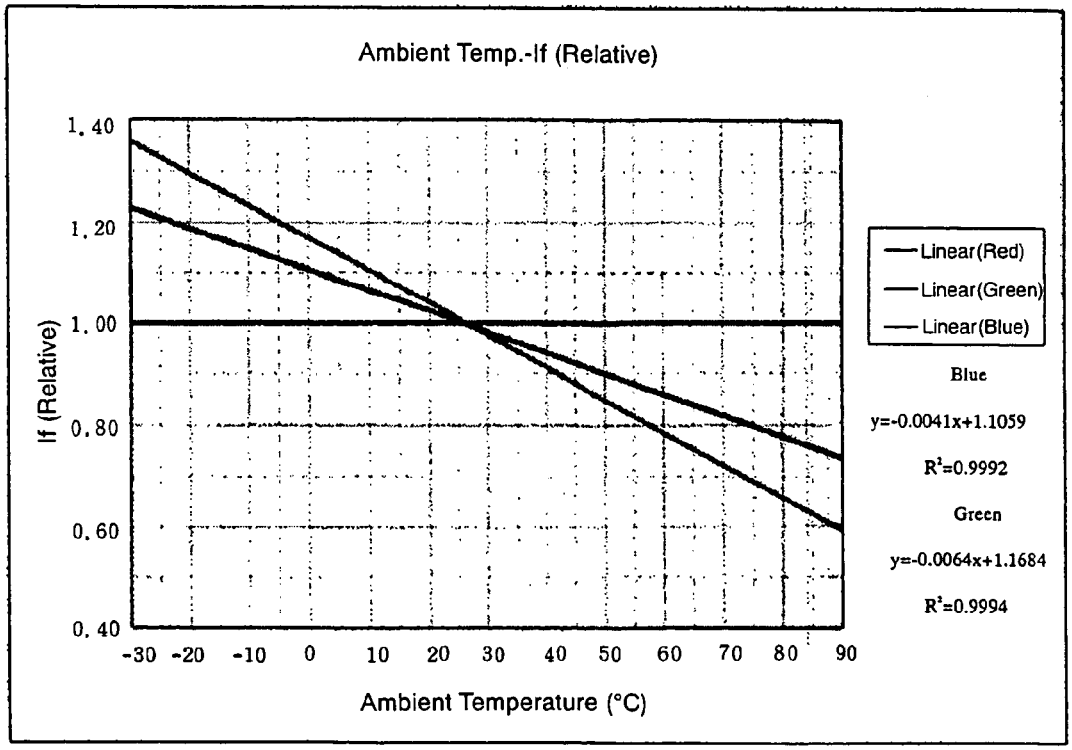

FIG. 28

RGB Backlight Ambient Temp.-White Bal. Property

White Balance: x=0. 41、y=0. 41

Red=10mA

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 1290.0 | 1.2659 | 0.4099 | 0.4099 | 10.00 | 4.97 | 1.21 | 1.0000 | 1.2333 | 1.1415 |
| 0 | 1150.0 | 1.1286 | 0.4102 | 0.4102 | 10.00 | 4.50 | 1.13 | 1.0000 | 1.1166 | 1.0660 |
| 25 | 1019.0 | 1.0000 | 0.4099 | 0.4099 | 10.00 | 4.03 | 1.06 | 1.0000 | 1.0000 | 1.0000 |
| 40 | 931.4 | 0.9140 | 0.4101 | 0.4102 | 10.00 | 3.74 | 1.01 | 1.0000 | 0.9280 | 0.9528 |
| 60 | 806.3 | 0.7913 | 0.4101 | 0.4102 | 10.00 | 3.37 | 0.95 | 1.0000 | 0.8362 | 0.8962 |
| 80 | 665.0 | 0.6526 | 0.4100 | 0.4101 | 10.00 | 2.99 | 0.90 | 1.0000 | 0.7419 | 0.8491 |

Red=20mA

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 2152 | 1.2512 | 0.4100 | 0.4099 | 20.00 | 11.53 | 2.20 | 1.0000 | 1.2726 | 1.1640 |
| 0 | 1918 | 1.1151 | 0.4099 | 0.4100 | 20.00 | 10.30 | 2.05 | 1.0000 | 1.1369 | 1.0847 |
| 25 | 1720 | 1.0000 | 0.4099 | 0.4100 | 20.00 | 9.06 | 1.89 | 1.0000 | 1.0000 | 1.0000 |
| 40 | 1587 | 0.9227 | 0.4098 | 0.4100 | 20.00 | 8.39 | 1.81 | 1.0000 | 0.9260 | 0.9577 |
| 60 | 1393 | 0.8099 | 0.4098 | 0.4099 | 20.00 | 7.40 | 1.69 | 1.0000 | 0.8168 | 0.8942 |
| 80 | 1201 | 0.6983 | 0.4101 | 0.4101 | 20.00 | 6.52 | 1.58 | 1.0000 | 0.7196 | 0.8360 |

FIG. 29
RGB Backlight Ambient Temp.-If Property
White Balance : x=0. 41、y=0. 41
Red=10mA
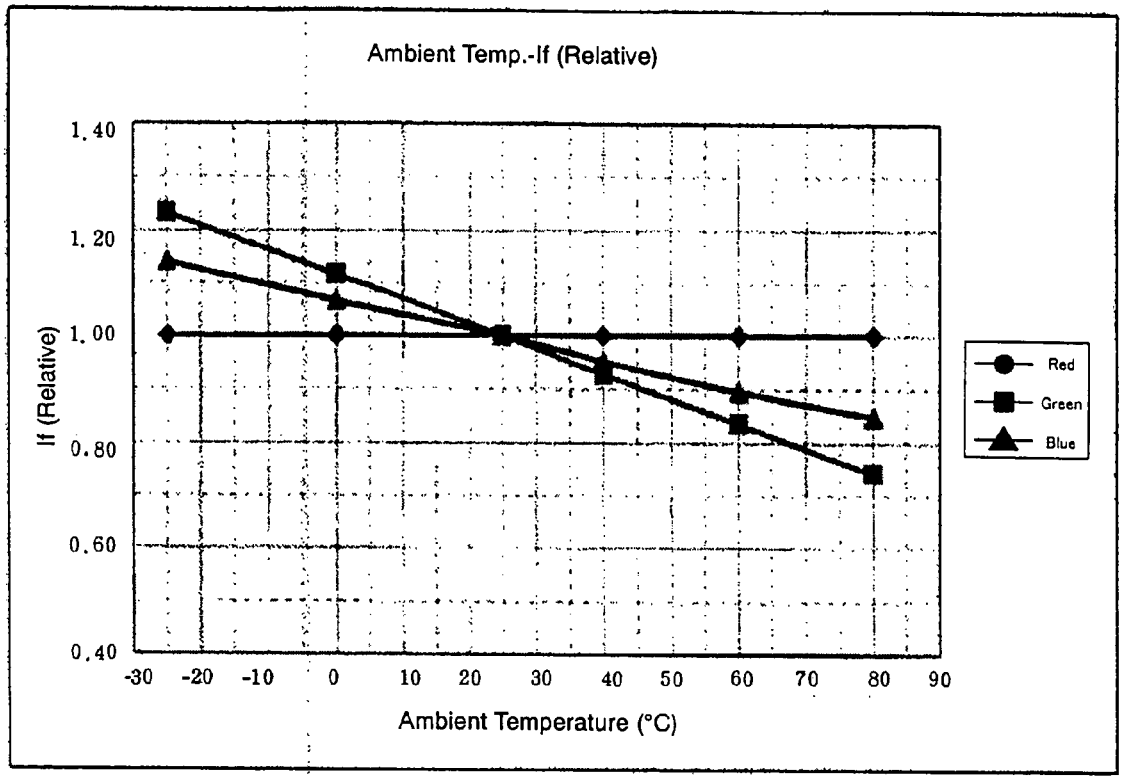
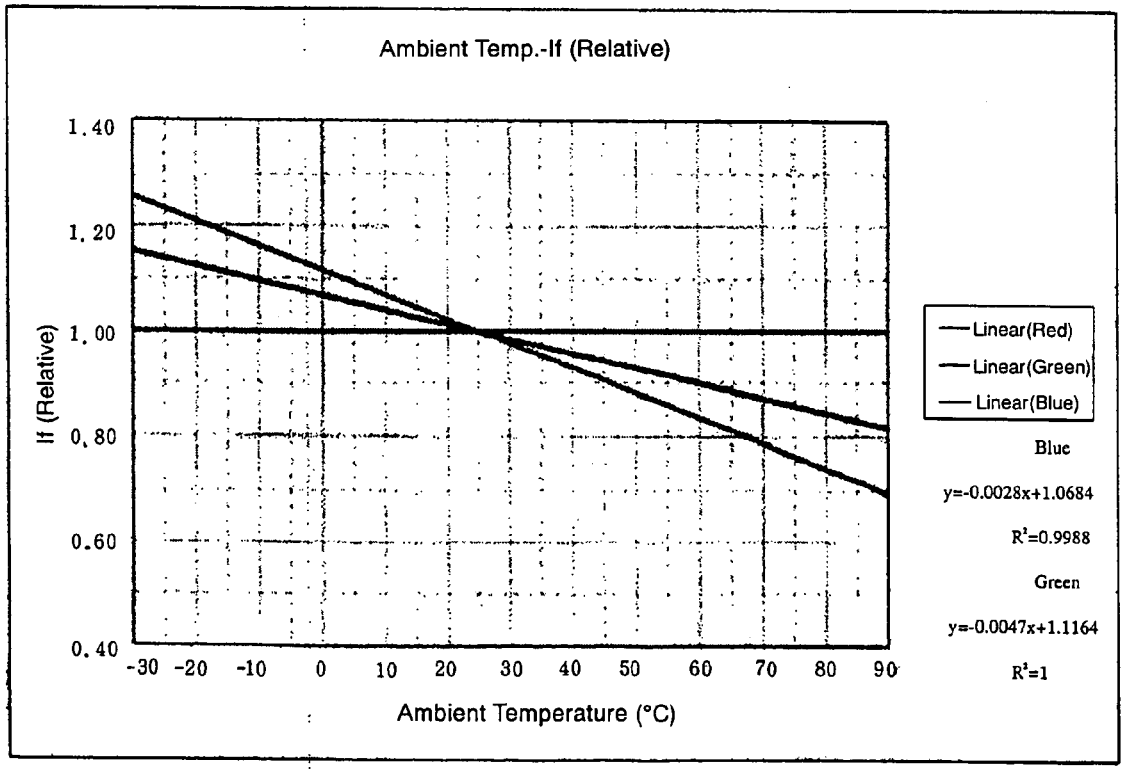

FIG. 30
RGB Backlight Ambient Temp.-If Property
White Balance : x=0. 41, y=0. 41
Red=20mA
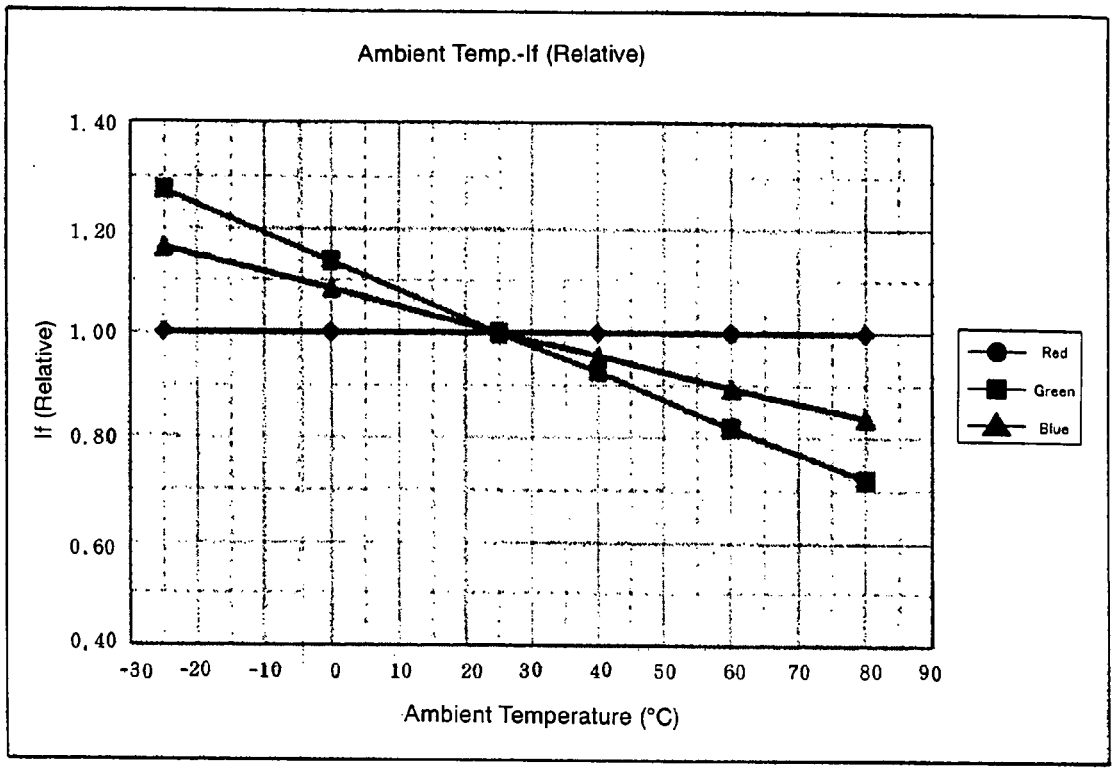
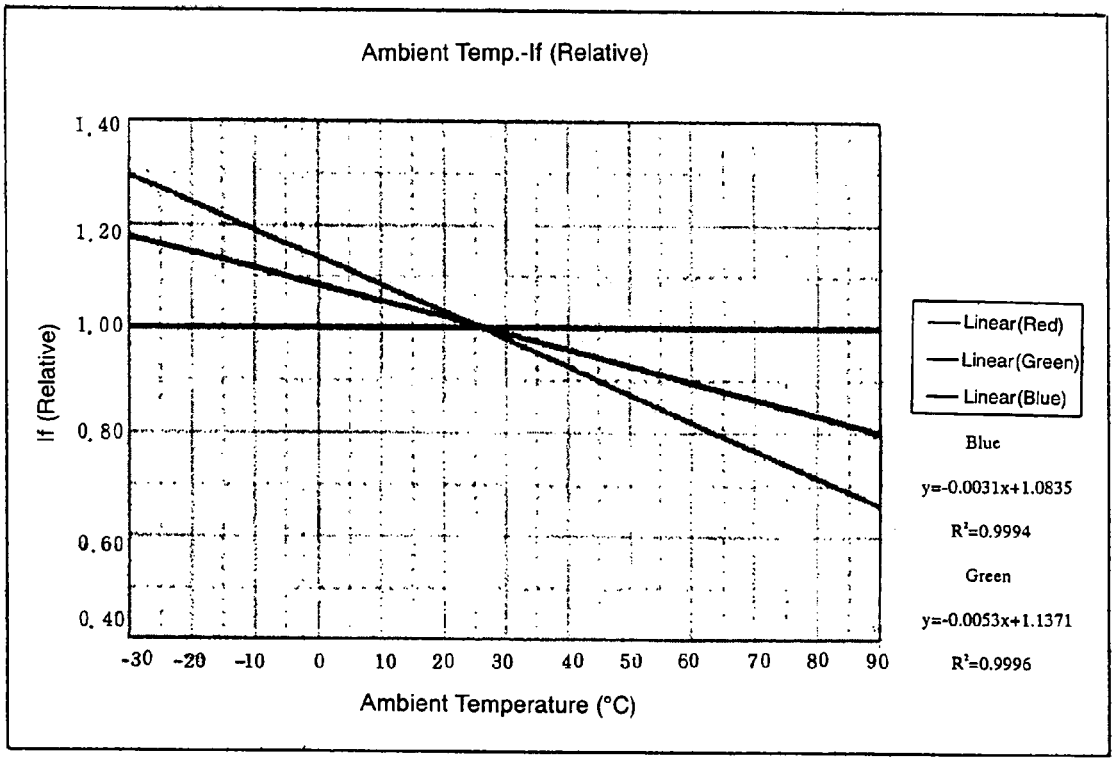

FIG. 31

RGB Backlight Ambient Temp.-White Bal. Property

White Balance: x=0. 3、y=0. 4

Red=10mA

| | | | | | If(mA) | | | If (Relative Value) | | |
|---|---|---|---|---|---|---|---|---|---|---|
| Ta(℃) | Luminance (cd/m²) | Relative Luminance | x | y | Red | Green | Blue | Red | Green | Blue |
| -25 | 2037.0 | 1.2025 | 0.3001 | 0.4001 | 10.00 | 14.19 | 3.88 | 1.0000 | 1.2328 | 1.1345 |
| 0 | 1838.0 | 1.0850 | 0.3000 | 0.4001 | 10.00 | 12.92 | 3.67 | 1.0000 | 1.1225 | 1.0731 |
| 25 | 1694.0 | 1.0000 | 0.2999 | 0.4000 | 10.00 | 11.51 | 3.42 | 1.0000 | 1.0000 | 1.0000 |
| 40 | 1583.0 | 0.9345 | 0.3000 | 0.4001 | 10.00 | 10.66 | 3.26 | 1.0000 | 0.9262 | 0.9532 |
| 60 | 1428.0 | 0.8430 | 0.2999 | 0.4001 | 10.00 | 9.56 | 3.06 | 1.0000 | 0.8306 | 0.8947 |
| 80 | 1243.0 | 0.7338 | 0.2999 | 0.4000 | 10.00 | 8.43 | 2.85 | 1.0000 | 0.7324 | 0.8333 |

Red=15mA

| | | | | | If(mA) | | | If (Relative Value) | | |
|---|---|---|---|---|---|---|---|---|---|---|
| Ta(℃) | Luminance (cd/m²) | Relative Luminance | x | y | Red | Green | Blue | Red | Green | Blue |
| -25 | 2745 | 1.2055 | 0.3000 | 0.3999 | 15.00 | 22.95 | 5.35 | 1.0000 | 1.2534 | 1.1383 |
| 0 | 2465 | 1.0826 | 0.2999 | 0.3999 | 15.00 | 20.63 | 5.04 | 1.0000 | 1.1267 | 1.0723 |
| 25 | 2277 | 1.0000 | 0.2999 | 0.4000 | 15.00 | 18.31 | 4.70 | 1.0000 | 1.0000 | 1.0000 |
| 40 | 2135 | 0.9376 | 0.3000 | 0.4001 | 15.00 | 16.86 | 4.48 | 1.0000 | 0.9208 | 0.9532 |
| 60 | 1942 | 0.8529 | 0.2999 | 0.4001 | 15.00 | 15.14 | 4.22 | 1.0000 | 0.8269 | 0.8979 |
| 80 | 1693 | 0.7435 | 0.2999 | 0.3999 | 15.00 | 13.22 | 3.93 | 1.0000 | 0.7220 | 0.8362 |

FIG. 32
RGB Backlight Ambient Temp.-If Property
White Balance : x=0. 3、y=0. 4
Red=10mA
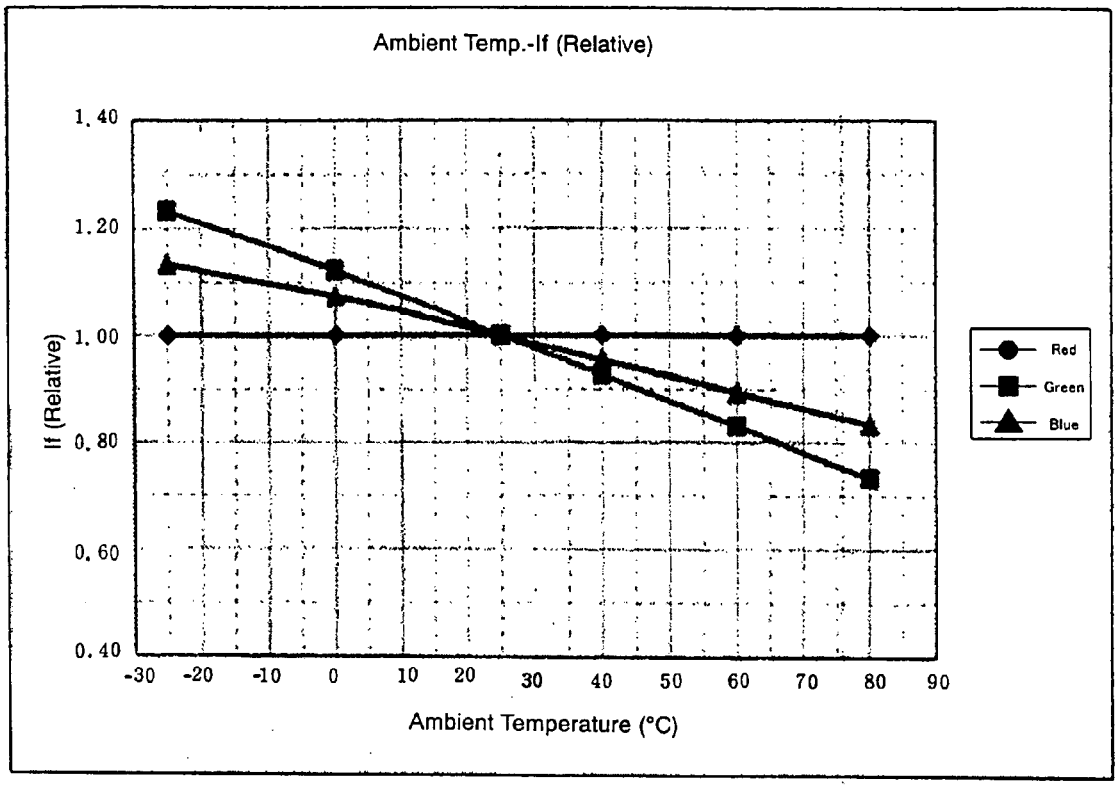
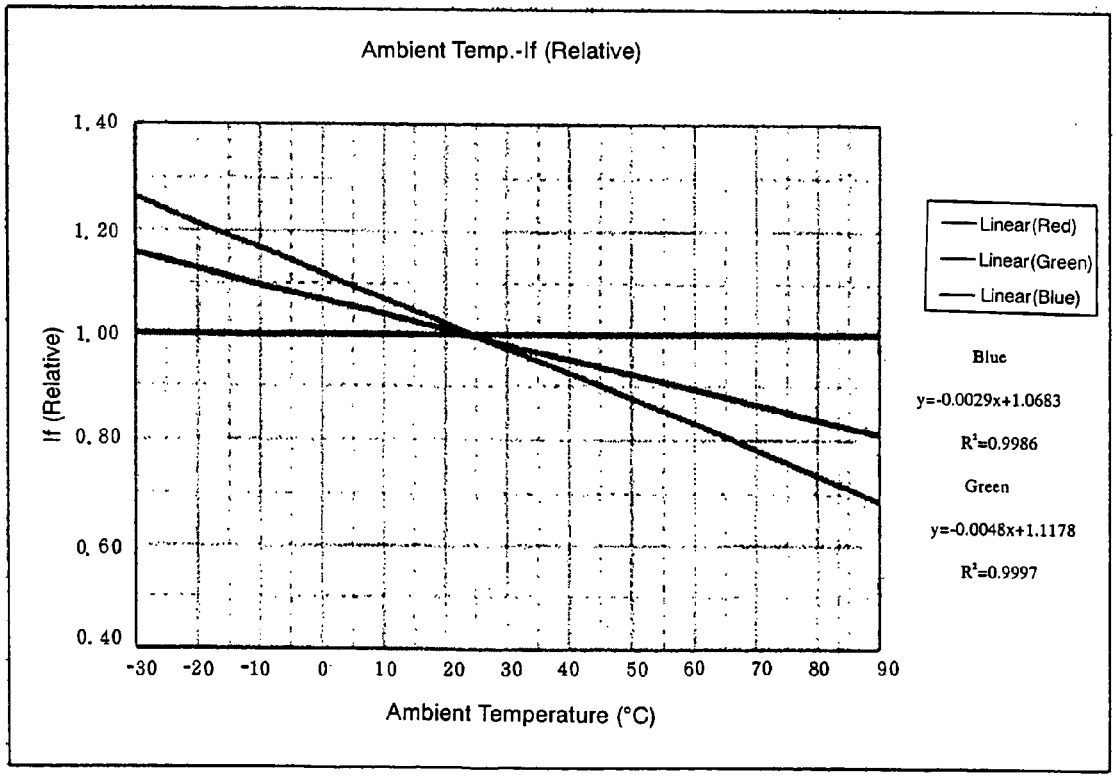

FIG. 33
RGB Backlight Ambient Temp.-If Property
White Balance : x=0. 3、y=0. 4
Red=15mA
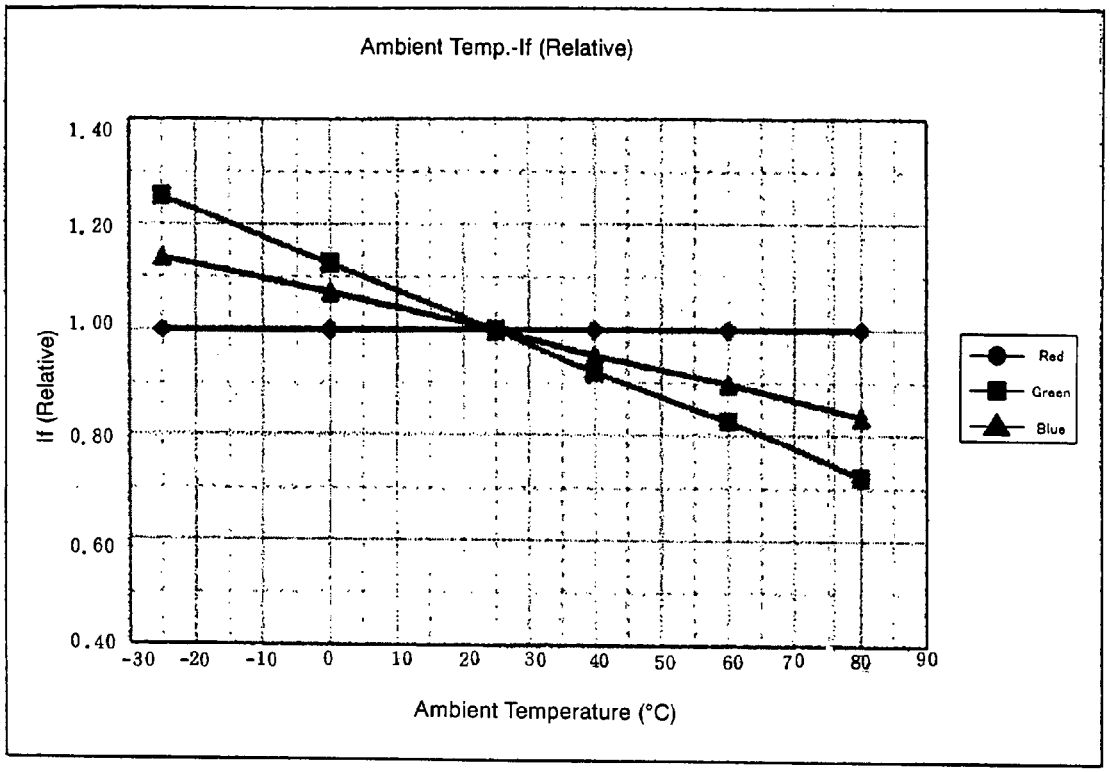
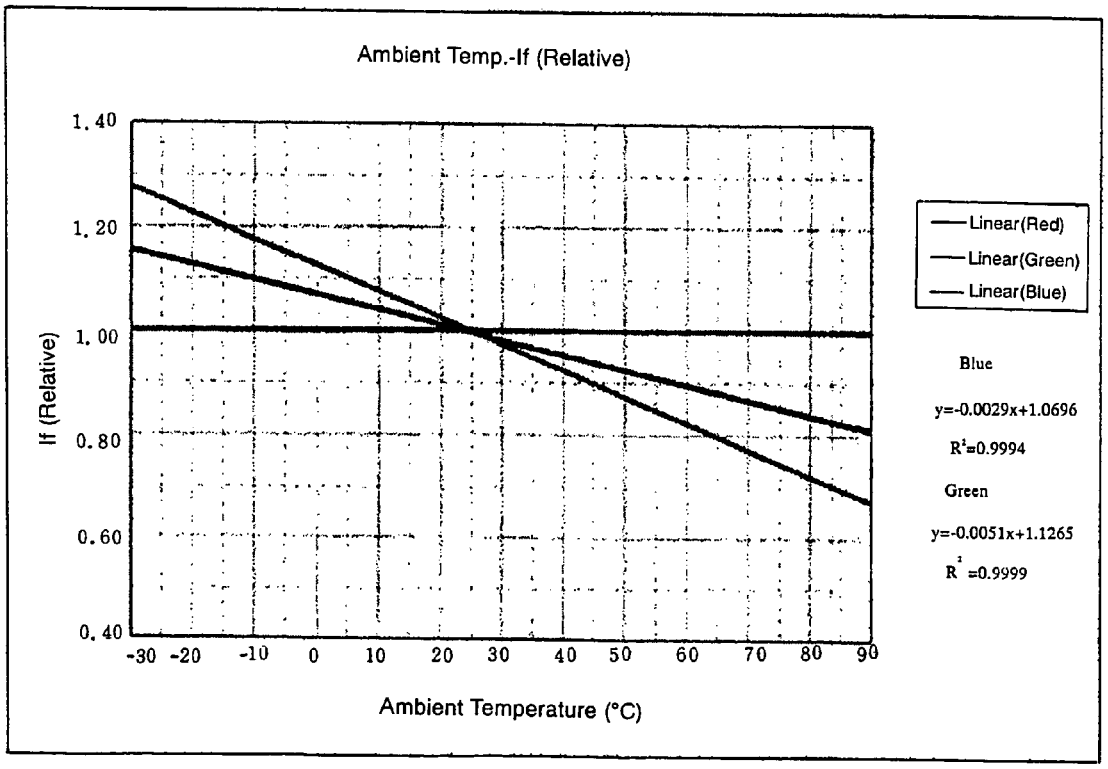

FIG. 35

RGB Backlight Ambient Temp.-White Bal. Property

White Balance: x=0. 31、y=0. 31、Constant Luminance

Red=5mA(at -25° C)~

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 814.9 | 1.00061 | 0.3102 | 0.3101 | 5.00 | 2.83 | 2.44 | 0.7634 | 0.9188 | 0.9173 |
| 0 | 814.8 | 1.00049 | 0.3098 | 0.3101 | 5.75 | 3.00 | 2.58 | 0.8779 | 0.9740 | 0.9699 |
| 25 | 814.4 | 1.00000 | 0.3100 | 0.3102 | 6.55 | 3.08 | 2.66 | 1.0000 | 1.0000 | 1.0000 |
| 40 | 815.3 | 1.00111 | 0.3103 | 0.3101 | 7.48 | 3.31 | 2.83 | 1.1420 | 1.0747 | 1.0639 |
| 60 | 814.7 | 1.00037 | 0.3100 | 0.3101 | 9.05 | 3.68 | 3.12 | 1.3817 | 1.1948 | 1.1729 |
| 80 | 814.5 | 1.00012 | 0.3100 | 0.3100 | 12.07 | 4.46 | 3.71 | 1.8427 | 1.4481 | 1.3947 |

Red=10mA(at -25° C)~

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 1493 | 0.99933 | 0.3100 | 0.3100 | 10.00 | 6.39 | 4.67 | 0.7547 | 0.9116 | 0.9157 |
| 0 | 1493 | 0.99933 | 0.3100 | 0.3100 | 11.72 | 6.91 | 5.00 | 0.8845 | 0.9857 | 0.9804 |
| 25 | 1494 | 1.00000 | 0.3101 | 0.3100 | 13.25 | 7.01 | 5.10 | 1.0000 | 1.0000 | 1.0000 |
| 40 | 1493 | 0.99933 | 0.3100 | 0.3100 | 15.55 | 7.72 | 5.54 | 1.1736 | 1.1013 | 1.0863 |
| 60 | 1492 | 0.99866 | 0.3099 | 0.3100 | 19.13 | 8.47 | 6.06 | 1.4438 | 1.2083 | 1.1882 |
| 80 | 1492 | 0.99866 | 0.3100 | 0.3101 | 25.25 | 9.58 | 6.83 | 1.9057 | 1.3666 | 1.3392 |

Red=15mA(at -25° C)~

| | | | | | If(mA) | | | If (Relative Value) | | |
|---|---|---|---|---|---|---|---|---|---|---|
| Ta(°C) | Luminance (cd/m²) | Relative Luminance | x | y | Red | Green | Blue | Red | Green | Blue |
| -25 | 2078 | 1.00048 | 0.3100 | 0.3099 | 15.00 | 10.43 | 6.76 | 0.7201 | 0.8669 | 0.8966 |
| 0 | 2078 | 1.00048 | 0.3100 | 0.3100 | 17.92 | 11.43 | 7.31 | 0.8603 | 0.9719 | 0.9695 |
| 25 | 2077 | 1.00000 | 0.3100 | 0.3101 | 20.83 | 11.76 | 7.54 | 1.0000 | 1.0000 | 1.0000 |
| 40 | 2077 | 1.00000 | 0.3100 | 0.3101 | 24.19 | 12.39 | 7.95 | 1.1613 | 1.0536 | 1.0544 |
| 60 | 2077 | 1.00000 | 0.3099 | 0.3101 | 31.53 | 13.61 | 8.73 | 1.5137 | 1.1573 | 1.1578 |
| 80 | 2072 | 0.99759 | 0.3100 | 0.3106 | 48.97 | 15.31 | 9.99 | 2.3509 | 1.3019 | 1.3249 |

FIG. 36
RGB Backlight Ambient Temp.-If Property
White Balance : x=0. 31、y=0. 31 Constant Luminance
Red=5mA (at -25°C)~
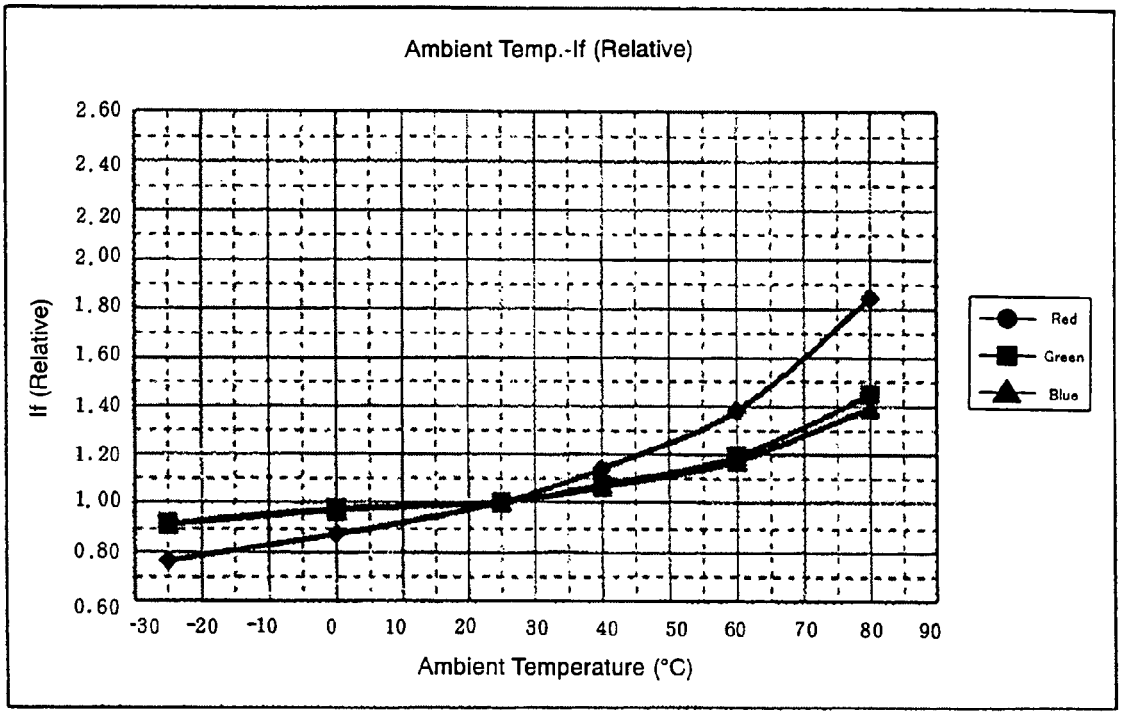
Approximation Curve (Cubic)
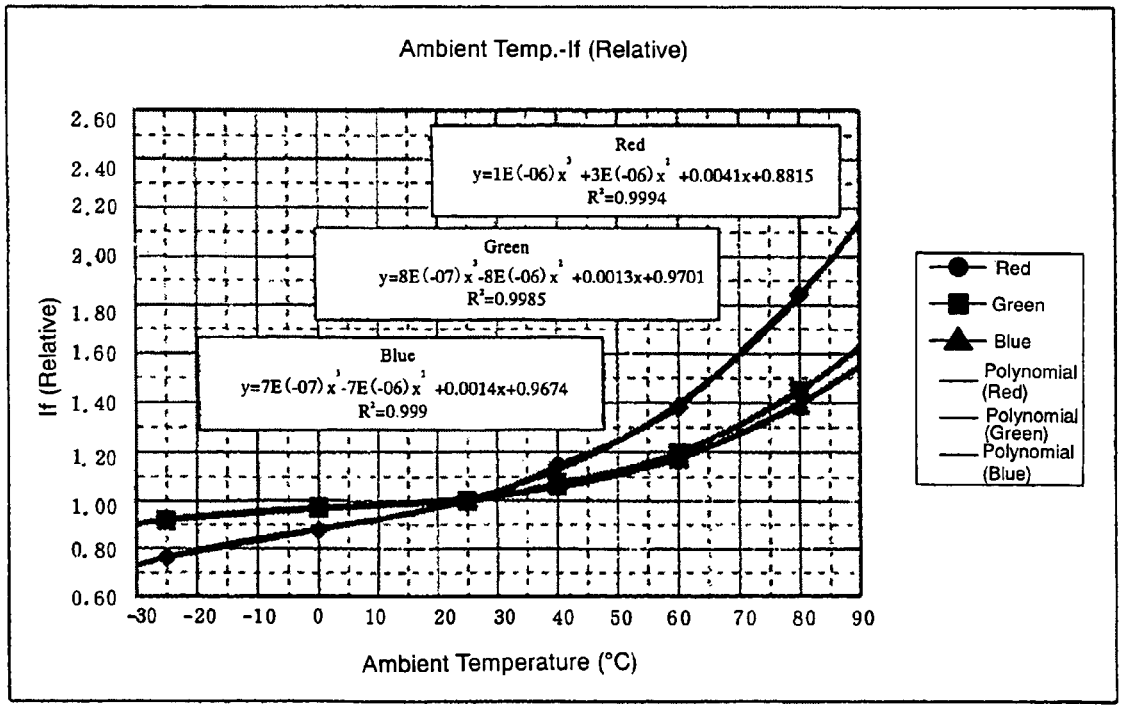

FIG. 37
RGB Backlight Ambient Temp.-If Property
White Balance : x=0. 31、y=0. 31 Constant Luminance
Red=10mA (at -25°C)~
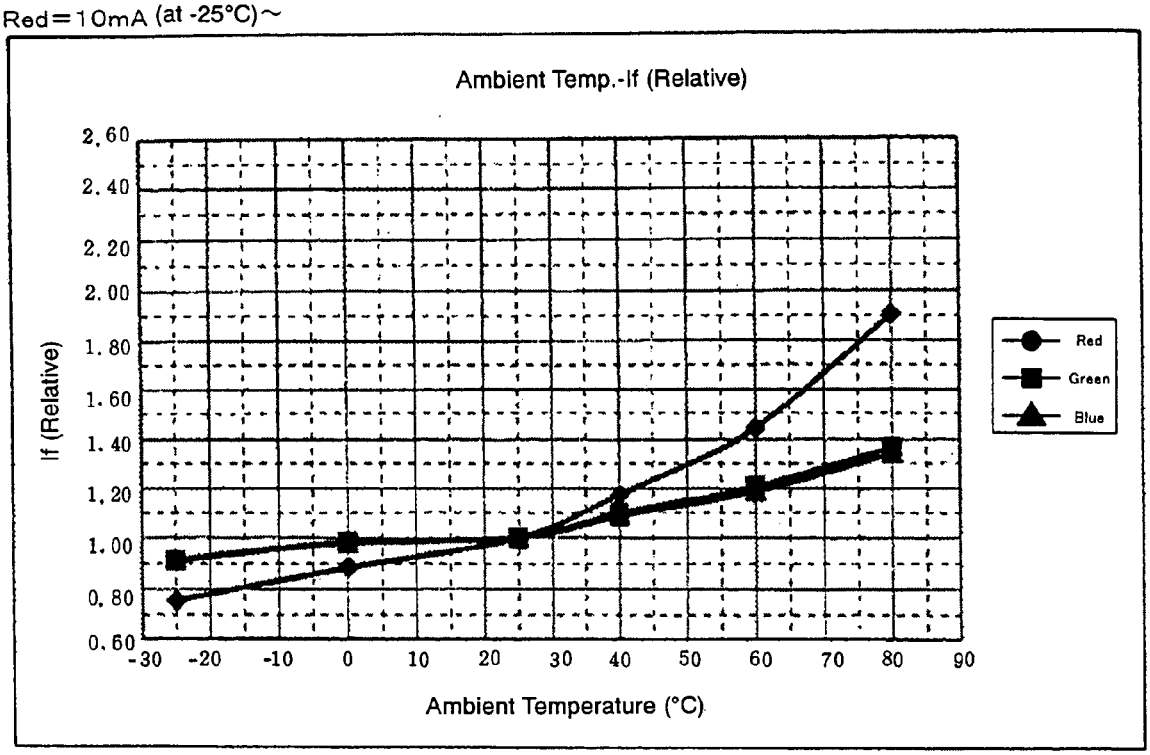
Approximation Curve (Cubic)
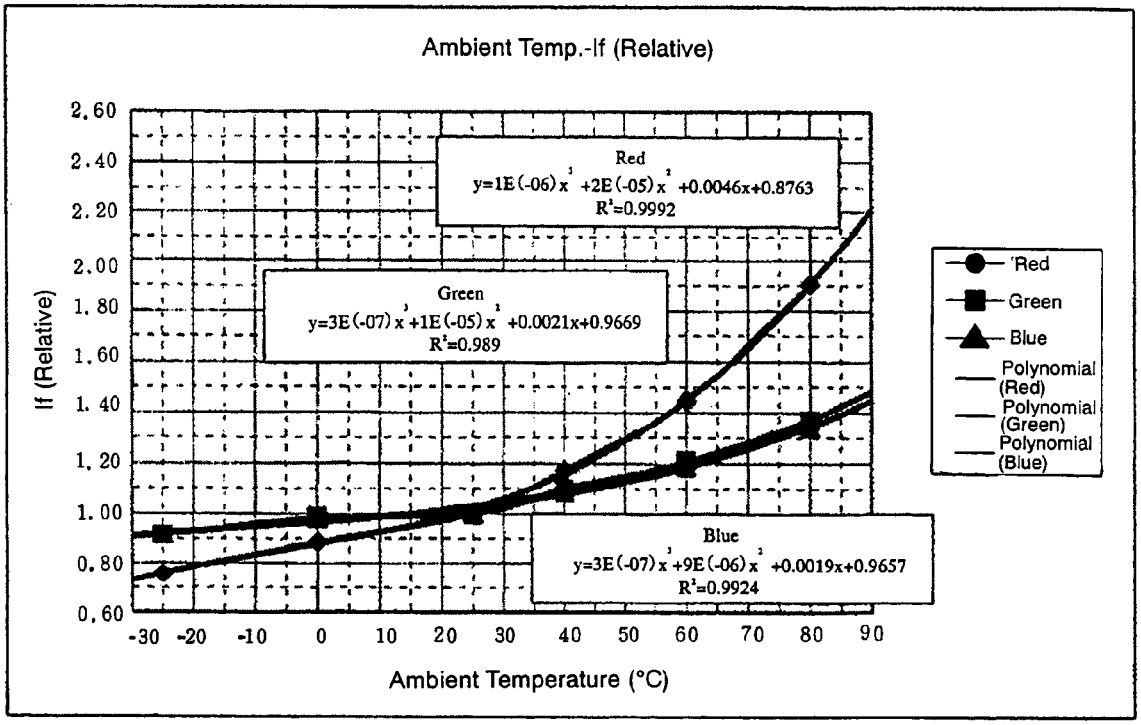

FIG. 38
RGB Backlight Ambient Temp.-If Property
White Balance : x=0. 31、y=0. 31 Constant Luminance
Red=15mA(at -25°C)~
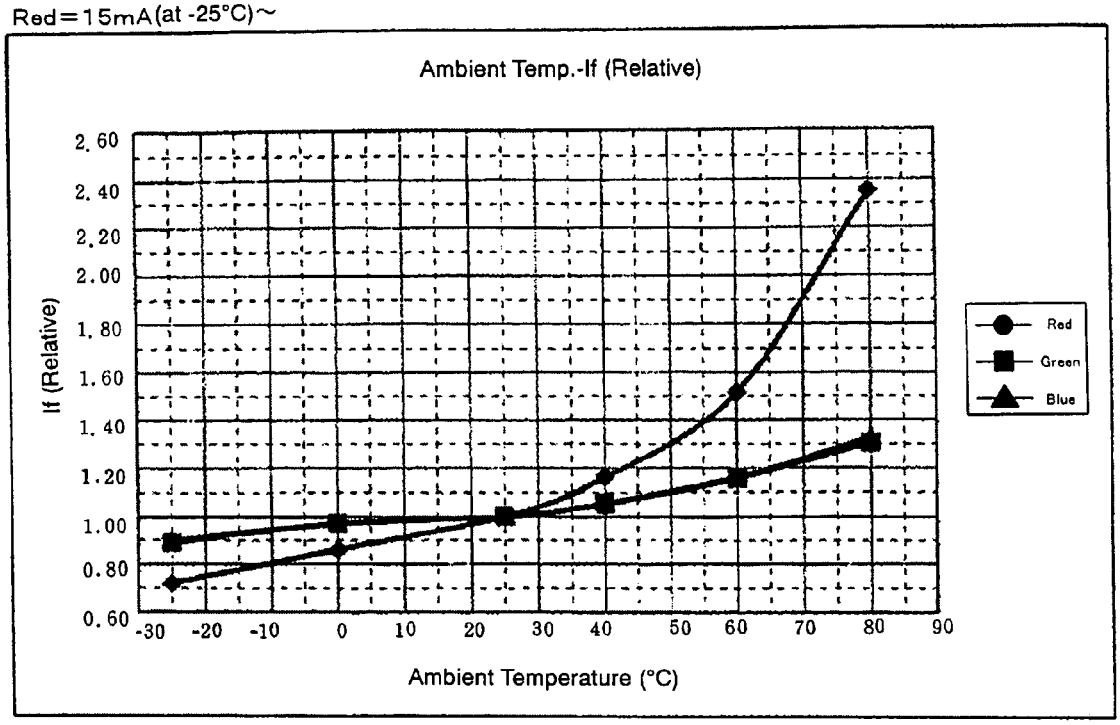
Approximation Curve (Cubic)
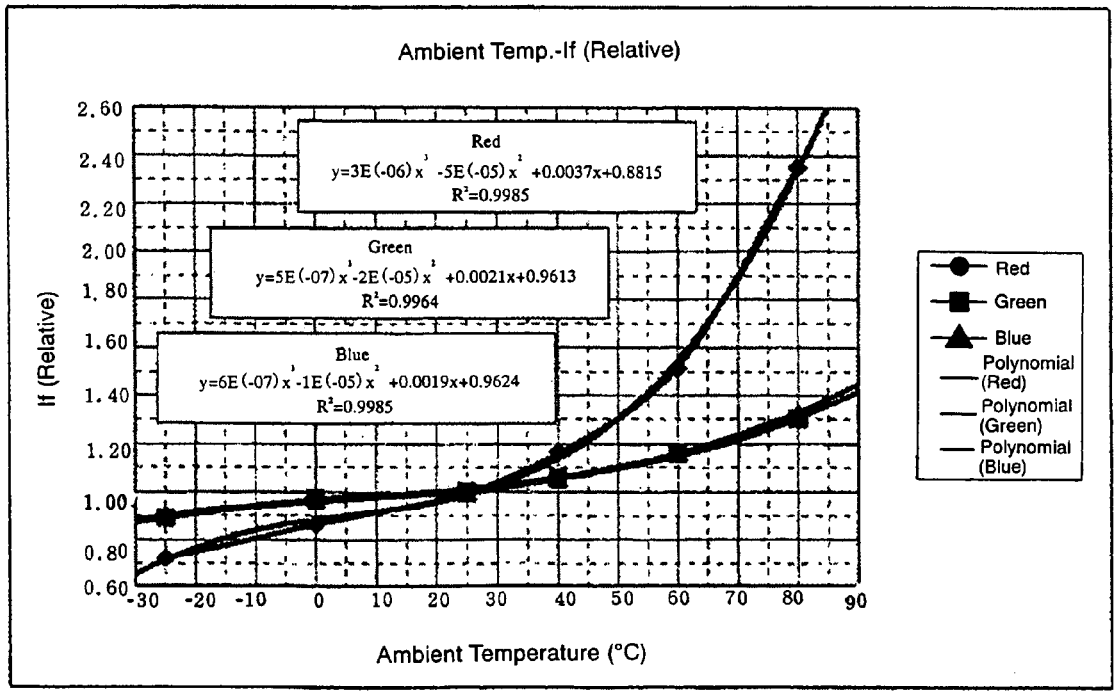

LIGHT EMITTING APPARATUS, LED LIGHTING, LED LIGHT EMITTING APPARATUS, AND CONTROL METHOD OF LIGHT EMITTING APPARATUS

TECHNICAL FIELD

The present invention relates to a light emitting apparatus, LED lighting, an LED light emitting apparatus, and a control method of a light emitting apparatus that, irrespective of temperature vitiation and/or time variation, can stably provide a desired chromaticity and/or color rendering property.

BACKGROUND ART

Generally, it is known that the luminescence intensity of semiconductor light emitting element such as light emitting diode varies according to elapsed time or temperature variation. For example, as for elapsed time, it is known that the luminescence intensity decreases according to deterioration of semiconductor light emitting element. In the case of APC driving or constant light output driving, a drive current or a drive voltage increases according to deterioration of semiconductor light emitting element, as a result, the element eventually cannot emit light, and its life will be over. In addition, in a semiconductor laser diode (LD) or the like, it is known that, when the temperature rises, its threshold current increases and a required drive current or drive voltage increases to provide the same light emission output in some cases. Similarly, in a light emitting diode, it is known that, when the temperature is high, in the case of APC driving i.e., constant light output driving, or the like, its light emission output decreases. On the other hand, when the temperature is low, even in the case of the same current, a larger amount of light emission is obtained.

If fluctuation or variation of light emission output of semiconductor light emitting element according to elapsed time or temperature variation arises, it is difficult to achieve construction of precise measurement system, construction of highly reliable communication equipment, and so on, in optical fiber communication system. In the case of display or lighting composed of light emitting diodes, they may cause unevenness of light intensity or color. For this reason, conventionally, a circuit that is provided with a light output controller 500 to provide temperature compensation for the fluctuation variation of light emission output as shown in FIG. 1 has been devised. In brief description of FIG. 1, the light emission output of a light emitting element 100 varies according to temperature. The light emission output is proportional to a drive current. Accordingly, for example, in the case where the light emission output increases according to temperature variation, the light emission controller 500 serves to reduce a current running through the light emitting element 100. On the other hand, control is performed such that a current running through a field-effect transistor 200 is constant, thus, a bypass current runs through the light emission controller 500. As a result, the light output is constant.

In the other case where the light emission output decreases according to temperature variation, the light emission controller 500 serves to increase a current running through the light emitting element 100 by reducing a bypass current running through the light emission controller 500. As a result, the light output is constant. In the light emission controller 500, a circuit is composed of a FET, a bipolar transistor, etc., and a thermistor. A thermistor is a variable resistor with temperature dependence. Accordingly, a constant-current circuit with temperature dependence is constructed by using a thermistor to provide a stabilized light source with less fluctuation according to elapsed time or temperature variation. In addition, instead of a variable resistor such as thermistor, a voltage generation circuit that has a normal resistor and a silicon diode with a temperature coefficient (e.g., −2 mV/° C. in forward voltage) so as to reduce a bias voltage as temperature rises is constructed to be used in an integrated circuit for a semiconductor light emitting diode or semiconductor laser diode.

Although the case where one semiconductor light emitting element is used alone or a monochromatic semiconductor light emitting element is used is discussed above, the case of a lighting apparatus or display that employs a plurality of combined light emitting elements is similar. That is, for example, in a RGB white LED device composed of red, blue and green LEDs, for fluctuation of light emission output according to elapsed time or temperature variation that affects each LED, a temperature compensation circuit or the like with thermistor, etc., is constructed each, as mentioned above. Alternatively, red, blue and green sensors are provided to constantly measure and monitor respective luminescence intensities of RGB wavelengths, respectively, the luminescence intensities are fed back to respective drive circuits for the RGB LEDs for control so as to bring the respective luminescence intensities of RGB wavelengths desired constant values irrespective of temperature variation, elapsed time, deterioration, and so on. This type of construction is used.

Patent Document 1: Japanese Laid-Open Patent Publication TOKUKAI No. HEI 4-196368

Patent Document 2: Japanese Laid-Open Patent Publication TOKUKAI No. SHO 64-48472

However, conventionally, an object to be controlled by temperature compensation is a luminescent intensity. That is, in lighting, or the like, that is composed of a plurality of semiconductor elements with different wavelength and has a predetermined chromaticity such as white light, in the case where the temperature fluctuates, or the like, conventional temperature compensation for luminescent intensity cannot compensate shift or fluctuation of wavelength of each semiconductor light emitting element such as LED. As a result, there is a problem where the chromaticity of the white lighting, or the like, composed of semiconductors that have shifted (or fluctuated) wavelengths shifts from an initial chromaticity before their wavelengths shift (or fluctuates).

In other words, for example, an LED device composed of RGB three-wavelength light emitting diodes, even in the case where drive control is performed by a feedback circuit with a sensor, or the like, provided therein such that respective light emission intensities of the respective colors of light emitting diodes are kept constant, as shown in FIG. 2, as it is known that the chromaticity (or wavelength property) of light emitting diode fluctuates, even if respective luminescent intensities of the RGB light emitting diodes having wavelength properties or chromaticities that shift from initial drive, as shown in FIG. 3, it is impossible to maintain a predetermined chromaticity in the initial drive are kept constant. Even if the chromaticity is still in white, the obtained white output light has a tint that subtly fluctuates toward reddish side or greenish side. That is, as shown in a schematic x-y chromaticity diagram of FIG. 3, although the color of the RGB LEDs in the initial drive can show the triangle region shown by a solid line in the figure, even if adjustment of the luminescent intensities of RGB light emitting diodes sets the chromaticity at "initial white" shown by a solid circle in the figure, when the temperature fluctuates, chromaticities of RGB also fluctuates to R'G'B' as shown by arrows. In this case, even if the light outputs of the RGB colors of light emitting diodes are kept constant irrespective of temperature fluctuation, subtle fluctuation of wavelength properties, i.e., chromaticities of colors shown in FIG. 2 causes fluctuation from the initial RGB solid-line triangle to a R'G'B' dashed-line triangle. For this reason, maintenance of luminescent intensity to the same luminescent intensity in the initial drive cannot maintain the chromaticity in the initial drive, in this case, "initial white". Similarly, fluctuation occurs according to a drive current value as shown in FIG. 2(*b*). The wavelength property fluctuates according to fluctuation of a drive current value. That is, chromaticity fluctuation phenomenon occurs in the case of light emitting element, and so on. Particularly, as for semiconductor light emitting elements, in some cases of materials or structures, wavelength shift or the like due to deterioration or temperature fluctuates. On the other hand, it is conceivable that light from a light emitting apparatus is directly sensed by a photo sensor, and thus is corrected for color shift, and so on. In order to perform correction with a sensor, for example, it is conceivable that, in consideration of a variation amount of light passing through each filter of RGB as color shift, adjustment to a desired color tone, or the like, is performed by controller that receives feedback of light amount of light emitting element. However, in this case, it is very difficult to provide fine adjustment of the chromaticity depending on the color filter property. If the numbers of filters and sensors are increased, it is possible to provide fine adjustment. But, this causes device complexity and high cost, and thus provides trade-off.

SUMMARY OF THE INVENTION

The present invention is aimed at solving the above problem, and, in a light emitting apparatus employing a semiconductor element, or the like, corrects wavelength variation (shift) due to temperature fluctuation and/or elapsed drive time, that is, chromaticity fluctuation, and additionally, including luminescence correction for providing a desired light emission intensity, provides a light emitting apparatus, LED lighting, and LED light emitting apparatus and a control method of a light emitting apparatus that, irrespective of temperature and/or time, stably provide a desired chromaticity and luminance and/or color rendering level.

To solve the above problem, a light emitting apparatus according to the present invention comprises at least two light emitting elements with different chromaticities, and a light emitting element controller that controls light emitted from the light emitting apparatus so as to be a desired chromaticity. The light emitting element controller controls the light emitting elements based on a predetermined function of light emitting element temperature variation. Accordingly, it is possible to provide a light emitting apparatus that, even if the temperature varies, has a stable desired chromaticity without chromaticity variation. In addition, since control is performed based on a property function of wavelength fluctuation due to light emitting element temperature variation, it is possible to provide more reliable reproduction characteristics, and a desired chromaticity.

According to another aspect of the present invention, the light emitting element controller controls drive currents and/or drive voltages of the light emitting elements based on a predetermined function of light emitting element temperature variation. Accordingly, it is possible to provide a light emitting apparatus that, even if the temperature varies, has a stable desired chromaticity without chromaticity variation. In addition, since the drive currents and/or drive voltages is controlled based on a property function of wavelength fluctuation due to light emitting element temperature variation, it is possible to provide more reliable reproduction characteristics, and a desired chromaticity.

Furthermore, a light emitting apparatus according to another aspect of the present invention comprises at least two light emitting elements with different chromaticities, a light emitting element controller that controls light emitted from the light emitting apparatus so as to be a desired chromaticity, and storage that previously stores drive current values and/or drive voltage values for a plurality of light emitting element temperatures for controlling the light emitted from the light emitting apparatus so as to be the desired chromaticity. The light emitting element controller controls drive currents and/or drive voltages of the light emitting elements based on the drive current values and/or drive voltage values corresponding to a given temperature stored in the storage.

Furthermore, a light emitting apparatus according to another aspect of the present invention comprises at least two light emitting elements with different chromaticities, a light emitting element controller that controls light emitted from the light emitting apparatus so as to be a desired chromaticity, and a temperature detector. The light emitting element controller controls the light emitting elements based on a signal from the temperature detector and a predetermined function of light emitting element temperature variation. Accordingly, even if the temperature constantly varies during operation of the light emitting apparatus, based on related temperature information from the temperature detector, control for temperature variation can be performed so as to provide a desired chromaticity. It is not always necessary to constantly perform the temperature information sampling. For example, the temperature information sampling can be performed at arbitrary timing such as periodic timing a constant period, or environmental variation timing.

Furthermore, a light emitting apparatus according to another aspect of the present invention comprises at least two light emitting elements with different chromaticities, a light emitting element controller that controls light emitted from the light emitting apparatus so as to be a desired chromaticity, a temperature detector, and a drive time detector. The light emitting element controller controls the light emitting elements based on signals from the temperature detector and the drive time detector, and a predetermined function of light emitting element temperature variation and drive time. Accordingly, not only if the temperature varies during operation, but also if time variation such as deterioration of light emission luminance, light emission chromaticity, or the like, of light emitting elements occurs in the case of long drive time, a desired chromaticity of the whole light emitting apparatus can be set and maintained for any of temperature variation and elapsed time.

Furthermore, a light emitting apparatus according to another aspect of the present invention comprises at least two light emitting elements with different chromaticities, a light emitting element controller that controls light emitted from the light emitting apparatus so as to be a desired chromaticity, and a temperature setter. The light emitting element controller controls the light emitting elements based on a value set in the temperature setter and a predetermined function of light emitting element temperature variation. Accordingly, it is possible to provide suitable control drive based on the constantly set temperature. Calculation processing by the predetermined function can provide complex control drive with simple circuitry and a small memory. Thus, it is possible to provide a light emitting apparatus that can be stably controlled so as to emit a desired chromaticity irrespective of the temperature.

Additionally, in a light emitting apparatus according to another aspect of the present invention, the light emitting element controller controls light emitted from the light emitting apparatus so as to be a desired chromaticity that belongs to white light. Accordingly, it is possible to provide a light emitting apparatus that, even if the temperature varies, has a stable desired white color without white chromaticity variation. In addition, since the white chromaticity is controlled based on a property function of wavelength fluctuation due to light emitting element temperature variation, it is possible to provide more reliable reproduction characteristics, and a desired white light.

Additionally, in a light emitting apparatus according to another aspect of the present invention, the light emitting elements are light emitting diodes (LEDs). Accordingly, it is possible to provide an LED light emitting apparatus that, even if the temperature varies, has a stable desired chromaticity without chromaticity variation. In addition, since the desired chromaticity is controlled based on a property function of wavelength fluctuation due to LED light emitting element temperature variation, it is possible to provide more reliable reproduction characteristics, and a desired chromaticity.

Furthermore, LED lighting according to another aspect of the present invention comprises LEDs with three different chromaticities of red, blue and green LEDs. The LED lighting comprises an LED controller that controls light emitted from the LED lighting so as to be a desired chromaticity. The LED controller controls drive currents and/or drive voltages of the LEDs based on a predetermined function of LED temperature variation and thus controls the light emitted from the LED lighting so as to be white light. In addition, the LED controller drives one LED with any one of the chromaticities at a constant current.

Additionally, in LED lighting according to another aspect of the present invention, the red LED is driven at a constant current.

Additionally, in LED lighting according to another aspect of the present invention, the predetermined function of the temperature variation represents that the drive current is a linear function of the temperature.

Additionally, in LED lighting according to another aspect of the present invention, LED lighting comprising: LEDs with three different chromaticities of red, blue and green LEDs, and an LED controller that controls light emitted from the LED lighting so as to be a desired chromaticity and a desired luminance. The LED controller controls pulse drive periods of drive currents and/or drive voltages of the LEDs based on a predetermined function of LED temperature variation and thus controls the light emitted from the LED lighting so as to be white light with the desired luminance.

Furthermore, LED lighting according to another aspect of the present invention comprises LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED lighting so as to be a desired color rendering level, a temperature setter and/or a temperature detector, and a drive time detector. The LED controller controls drive currents and/or drive voltages of the LEDs based on a detected value from the temperature detector, a signal from the drive time detector and a predetermined function of LED temperature variation and drive time and thus controls the light emitted from the LED lighting so as to be the desired color rendering level as white light. In addition, the LED controller drives one LED with any one of the chromaticities at a constant current.

Furthermore, an LED light emitting apparatus according to another aspect of the present invention comprises LEDs of at least red, blue and green colors, and a control portion having a non-volatile memory capable of receiving/providing information for chromaticity maintenance for temperature of the LED light emitting apparatus, a control circuit that can read the information on respective colors and write control information into red, blue and green color setting registers at power startup, a calculation circuit that performs calculation based on signals from the respective color setting registers and a temperature information signal that is received from a temperature measurement element through a temperature information processing portion, digital-analog converters for respective colors that converts output from the calculation circuit, and current sources for respective colors that provide drive currents for the red, blue and green LEDs. The information for chromaticity maintenance for temperature that is received/provided by/from the non-volatile memory contains predetermined functions, a temperature coefficient, and reference chromaticity and luminance data, or drive current values for temperatures.

Additionally, in an LED light emitting apparatus according to another aspect of the present invention, the predetermined function for the red LED represents that a control current value is constant for temperature, and the predetermined functions for green and blue LEDs represent that control current values are linear functions of temperature.

Furthermore, an LED light emitting apparatus according to another aspect of the present invention comprises LEDs of at least red, blue and green colors, and a control portion having a non-volatile memory capable of receiving/providing information for chromaticity and luminance maintenance for temperature of the LED light emitting apparatus, a control circuit that can read the information on respective colors and write control information into red, blue and green color setting registers at power startup, a calculation circuit that performs calculation based on signals from the respective color setting registers and a temperature information signal that is received from a temperature measurement element through a temperature information processing portion, digital-analog converters for respective colors that converts output from the calculation circuit, and current sources for respective colors that provide drive currents for the red, blue and green LEDs. The information for chromaticity and luminance maintenance for temperature that is received/provided by/from the non-volatile memory contains predetermined functions, a temperature coefficient, and reference chromaticity and luminance data, or drive current values for temperatures.

Additionally, in an LED light emitting apparatus according to another aspect of the present invention, the predetermined functions for the red, green and blue LEDs represents that control current values are cubic functions of temperature.

Furthermore, an LED light emitting apparatus according to another aspect of the present invention comprises LEDs of red, blue and green colors, current sources for the LEDs of respective colors that are electrically connected to the LEDs, digital-analog converters for respective colors that are electrically connected to the current sources, setting registers for the LEDs of respective colors that are electrically connected to the digital-analog converters, a control circuit that is electrically connected to the setting registers, and a non-volatile memory that is electrically connected to the control circuit. The control circuit includes electrical input wire connection of temperature information through a temperature information processing portion from a temperature sensing element of the LEDs. The control circuit calculates control current values for LEDs of respective colors based on current setting data for temperature that is stored in the non-volatile memory, or predetermined functions and the temperature information that is provided therein, and thus performs light emission control drive of the LEDs based on the values that are provided into the setting registers.

Additionally, in an LED light emitting apparatus according to another aspect of the present invention, the red LED is composed of a AlInGaP group semiconductor material, and the blue and green LEDs are composed of a nitride group semiconductor material. Accordingly, as for the predetermined function of temperature variation, or the like, for constant chromaticity drive control, linear function approximation or cubic function approximation very suitably fits, thus, a control value for temperature can be easily determined. This provides a merit in consideration of circuitry simplification, reduction of malfunction, saving in calculation processing simplification memory, and so on.

Still furthermore, a control method, according to another aspect of the present invention, of a light emitting apparatus that comprises at least two light emitting elements with different chromaticities, and a light emitting element controller that controls light emitted from the light emitting apparatus so as to be a desired chromaticity. The light emitting element controller controls the light emitting elements based on a predetermined function of light emitting element temperature variation.

According to a light emitting apparatus, LED lighting, an LED light emitting apparatus, and a control method of a light emitting apparatus according the present invention, it is possible to provide a light emitting apparatus that, even if the temperature varies, has a stable desired chromaticity and/or reduce fluctuation of color rendering without chromaticity variation and fluctuation. In addition, since control is performed based on a property function of wavelength property fluctuation, or the like, due to light emitting element temperature variation, it is possible to provide more reliable reproduction characteristics, and a desired chromaticity at low price by small light weight simple circuitry with a small memory capacity.

In addition, even if time elapses, fluctuation/variation of chromaticity and/or color rendering is reduced. Accordingly, it is possible to provide a light emitting apparatus that has a stable desired chromaticity/color rendering. In addition, since control is performed based on a property function of wavelength property fluctuation, or the like, due to elapsed time of light emitting element, it is possible to provide more reliable reproduction characteristics, and a desired chromaticity/color rendering at low price by small light weight simple circuitry with a small memory capacity.

BRIEF DESCRIPTION OF THE DRAWINGS

FIG. 2(*a*) is a graph showing chromaticity fluctuation in the case of temperature fluctuation according to one example of light emission main wavelength of light emitting diode;

FIG. 2(*b*) is a graph showing chromaticity fluctuation in the case of drive current fluctuation according to one example of light emission main wavelength of light emitting diode;

FIG. 3 is a schematic x-y chromaticity diagram showing chromaticity fluctuation of white color consisting of main RGB three wavelengths for temperature;

FIG. 5 shows a graph showing, in white balance of RGB-LED light (x=0.31, y=0.31), variation of each current value for temperature (at a constant red LED current amount of 10 mA);

FIG. 6 shows a graph showing, in white balance of RGB-LED light (x=0.31, y=0.31), variation of each current value for temperature (at a constant red LED current amount of 15 mA);

FIG. 7 shows a graph showing, in white balance of RGB-LED light (x=0.31, y=0.31), variation of each current value for temperature (at a constant red LED current amount of 20 mA);

FIG. 8 shows a graph showing, in white balance of RGB-LED light (x=0.31, y=0.31), variation of each current value for temperature (at a constant red LED current amount of 25 mA);

FIG. 10 shows a table showing, in white balance of RGB-LED light (x=0.31, y=0.31) at each red LED current amount of constant values 10 mA, 15 mA, 20 mA and 25 mA, one example of variation of each parameter for temperature;

FIG. 11 shows a graph showing, in white balance of RGB-LED light (x=0.29, y=0.29), variation of each current value for temperature (at a constant red LED current amount of 10 mA);

FIG. 12 shows a graph showing, in white balance of RGB-LED light (x=0.29, y=0.29), variation of each current value for temperature (at a constant red LED current amount of 15 mA);

FIG. 13 shows a graph showing, in white balance of RGB-LED light (x=0.29, y=0.29), variation of each current value for temperature (at a constant red LED current amount of 20 mA);

FIG. 14 shows a graph showing, in white balance of RGB-LED light (x=0.29, y=0.29), variation of each current value for temperature (at a constant red LED current amount of 25 mA);

FIG. 15 shows a graph showing, in white balance of RGB-LED light (x=0.29, y=0.29) at each red LED current amount of constant values 10 mA, 15 mA, 20 mA and 25 mA, variation of relative luminance relationship for temperature;

FIG. 16 shows a table showing, in white balance of RGB-LED light (x=0.29, y=0.29) at each red LED current amount of constant values 10 mA, 15 mA, 20 mA and 25 mA, one example of variation of each parameter for temperature;

FIG. 17 shows a graph showing, in white balance of RGB-LED light (x=0.27, y=0.27), variation of each current value for temperature (at a constant red LED current amount of 10 mA);

FIG. 18 shows a graph showing, in white balance of RGB-LED light (x=0.27, y=0.27), variation of each current value for temperature (at a constant red LED current amount of 15 mA);

FIG. 19 shows a graph showing, in white balance of RGB-LED light (x=0.27, y=0.27), variation of each current value for temperature (at a constant red LED current amount of 20 mA);

FIG. 20 shows a graph showing, in white balance of RGB-LED light (x=0.27, y=0.27), variation of each current value for temperature (at a constant red LED current amount of 25 mA);

FIG. 22 shows a table showing, in white balance of RGB-LED light (x=0.27, y=0.27) at each red LED current amount of constant values 10 mA, 15 mA, 20 mA and 25 mA, one example of variation of each parameter for temperature;

FIG. 25 shows a table showing, in white balance of RGB-LED light (x=0.23, y=0.23) at each red LED current amount of constant values 10 mA and 15 mA, one example of variation of each parameter for temperature;

FIG. 26 shows a graph showing, in white balance of RGB-LED light (x=0.23, y=0.23), variation of each current value for temperature (at a constant red LED current amount of 10 mA);

FIG. 27 shows a graph showing, in white balance of RGB-LED light (x=0.23, y=0.23), variation of each current value for temperature (at a constant red LED current amount of 15 mA);

FIG. 28 shows a table showing, in white balance of RGB-LED light (x=0.41, y=0.41) at each red LED current amount of constant values 10 mA and 20 mA, one example of variation of each parameter for temperature;

FIG. 29 shows a graph showing, in white balance of RGB-LED light (x=0.41, y=0.41), variation of each current value for temperature (at a constant red LED current amount of 10 mA);

FIG. 30 shows a graph showing, in white balance of RGB-LED light (x=0.41, y=0.41), variation of each current value for temperature (at a constant red LED current amount of 20 mA);

FIG. 31 shows a table showing, in white balance of RGB-LED light (x=0.3, y=0.4) at each red LED current amount of constant values 10 mA and 15 mA, one example of variation of each parameter for temperature;

FIG. 32 shows a graph showing, in white balance of RGB-LED light (x=0.3, y=0.4), variation of each current value for temperature (at a constant red LED current amount of 10 mA);

FIG. 33 shows a graph showing, in white balance of RGB-LED light (x=0.3, y=0.4), variation of each current value for temperature (at a constant red LED current amount of 15 mA);

FIG. 35 shows a table showing, in luminance and chromaticity balance of RGB-LED light (x=0.31, y=0.31) at each red LED current amount of constant values 5 mA, 10 mA and 15 mA, one example of variation of each parameter for temperature;

FIG. 36 shows a graph showing, in constant luminance of 815 cd/m$^2$ and constant chromaticity (x=0.31, y=0.31), variation of each LED control current for temperature;

FIG. 37 shows a graph showing, in constant luminance of 1493 cd/m$^2$ and constant chromaticity (x=0.31, y=0.31), variation of each LED control current for temperature;

FIG. 38 shows a graph showing, in constant luminance of 2077 cd/m$^2$ and constant chromaticity (x=0.31, y=0.31), variation of each LED control current for temperature.

EXPRESSION OF REFERENCE LETTERS

Figure 1:
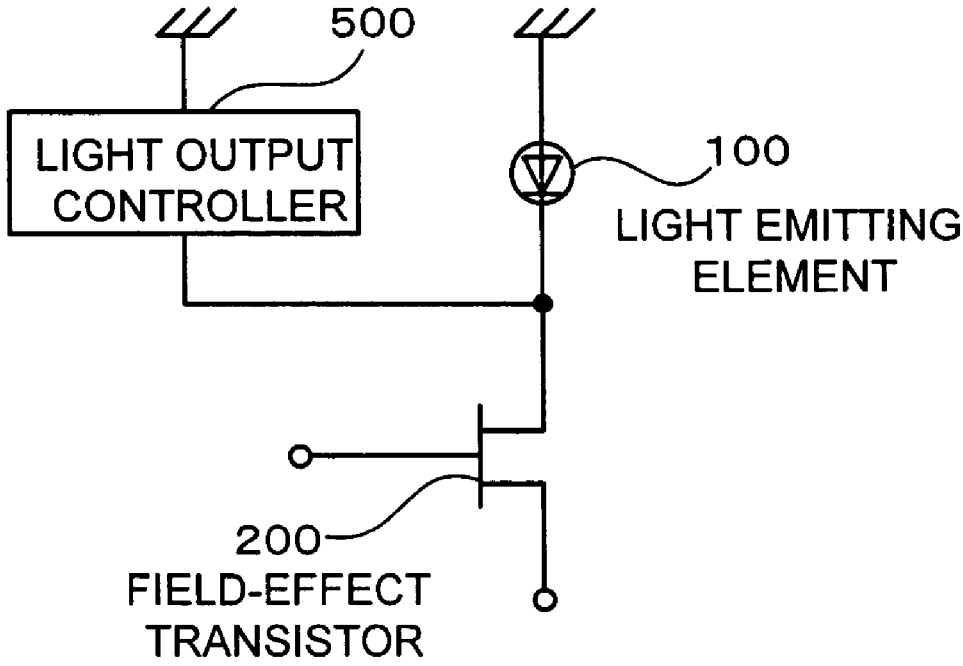
FIG. 1 is a related circuit diagram showing a light emission output temperature compensation circuit.

100: Light Emitting Element; 200: Field-Effect Transistor; 500: Light Output Controller; 231: RED-LED; 232: GREEN-LED; 233: BLUE-LED; 234: Temperature Measurement Element; 235: Control Portion; 236: Frame; 237: Board; 238: Light Guide Plate; 239: Wire; 241: RED-LED; 242: GREEN-LED; 243: BLUE-LED; 244: Temperature Measurement Element; 245: Constant Temperature Box; 246: Frame; 247: Board; 248: Light Guide Plate; 249: Wire; 2410: Variable Constant Current Source; 2411: Measurement Device; 2412: Chromaticity Meter; 2413: Glass Window; 340: Host Computer; 341: Non-Volatile Memory; 342: Control Circuit; 343R, 343 B and 343G: Setting Register; 344R, 344 B and 344G: Calculation Circuit; 345R, 345 B and 345G: Digital Analog Converter (DAC); 346R, 346 B and 346G: Current Sources; 347: Temperature Measurement Element; 348: Temperature Information Processing Portion; 349R: Red LED Group; 349B: Blue LED Group; 349G: Green LED Group; 3410: LED Light Emitting Apparatus

DETAILED DESCRIPTION OF THE PREFERRED EMBODIMENTS

The following description will describe embodiments according to the present invention with reference to the drawings. It should be appreciated, however, that the embodiments described below are illustrations of a light emitting apparatus, LED lighting, an LED light emitting apparatus, and a control method of a light emitting apparatus to give a concrete form to technical ideas of the invention, and a light emitting apparatus, LED lighting, an LED light emitting apparatus, and a control method of a light emitting apparatus of the invention are not specifically limited to description below. Furthermore, it should be appreciated that the members shown in claims attached hereto are not specifically limited to members in the embodiments. Unless otherwise specified, any dimensions, materials, shapes and relative arrangements of the parts described in the embodiments are given as an example and not as a limitation. Additionally, the sizes and the arrangement relationships of the members in each of drawings are occasionally shown larger exaggeratingly for ease of explanation. Members same as or similar to those of this invention are attached with the same designation and the same reference numerals and their description is omitted. In addition, a plurality of structural elements of the present invention may be configured as a single part which serves the purpose of a plurality of elements, on the other hand, a single structural element may be configured as a plurality of parts which serve the purpose of a single element.

A light emitting apparatus according to another aspect of the present invention comprises at least two light emitting elements with different chromaticities, a light emitting element controller that controls light emitted from the light emitting apparatus so as to be a desired chromaticity, a temperature detector, and a drive time detector. The light emitting element controller controls the light emitting elements based on a set value that is set in the temperature setter, a signal from the temperature detector, and a predetermined function of light emitting element temperature variation and drive time. Thus, a control value based the set value and the drive time is calculated by the predetermined function. Therefore, a simple circuitry drive system can stably control light emitted from the light emitting apparatus so as to be a desired chromaticity irrespective of the temperature and drive time. The drive time is preferably total time as overall drive time. In this case, deterioration correction control can be performed in accordance with deterioration of light emitting apparatus. However, in the case where the drive time is light ON time after the light emitting apparatus is turned ON, the control can be achieved. Both types of time can be included.

Additionally, in a light emitting apparatus according to another aspect of the present invention, the light emitting element controller controls the pulse drive periods of drive currents and/or drive voltages of the light emitting elements based on a predetermined function of light emitting element temperature variation.

Furthermore, a light emitting apparatus according to another aspect of the present invention comprises at least two light emitting elements with different chromaticities, a light emitting element controller that controls light emitted from the light emitting apparatus so as to be a desired color rendering level, a temperature detector, and a drive time detector. The light emitting element controller controls the light emitting elements based on signals from the temperature detector and the drive time detector, and a predetermined function of light emitting element temperature variation and drive time.

Furthermore, a light emitting apparatus according to another aspect of the present invention comprises at least two light emitting elements with different chromaticities, a light emitting element controller that controls light emitted from the light emitting apparatus so as to be a desired color rendering level, a temperature setter, and a drive time detector. The light emitting element controller controls the light emitting elements based on a set value that is set in the temperature setter, a signal from the temperature detector, and a predetermined function of light emitting element temperature variation and drive time.

Additionally, in a light emitting apparatus according to another aspect of the present invention, the light emitting element controller controls drive currents and/or drive voltages of the light emitting elements based on a predetermined function of light emitting element temperature variation and drive time.

Furthermore, a light emitting apparatus according to another aspect of the present invention comprises at least two light emitting elements with different chromaticities including a white LED that can emit white light and is composed of a semiconductor light emitting element capable of emitting ultraviolet rays or visible light and a phosphor emitting luminescent radiation caused by excitation of light emitted from the semiconductor light emitting element, a light emitting element controller that controls light emitted from the light emitting apparatus so as to be a desired color rendering level, a temperature setter, and a drive time detector. The light emitting element controller controls the light emitting elements based on a set value that is set in the temperature setter, a signal from the temperature detector, and a predetermined function of light emitting element temperature variation and drive time.

Furthermore, a light emitting apparatus according to another aspect of the present invention comprises at least two light emitting elements with different chromaticities including a white LED that can emit white light and is composed of a semiconductor light emitting element capable of emitting ultraviolet rays or visible light and a phosphor emitting luminescent radiation caused by excitation of light emitted from the semiconductor light emitting element, a light emitting element controller that controls light emitted from the light emitting apparatus so as to be a desired color rendering level, a temperature setter, and a drive time detector The light emitting element controller controls the pulse drive periods of the light emitting elements based on a set value that is set in the temperature setter, a signal from the temperature detector, and a predetermined function of light emitting element temperature variation and drive time.

Additionally, in a light emitting apparatus according to another aspect of the present invention, the light emitting element controller controls the pulse drive periods of drive currents and/or drive voltages of the light emitting elements based on a predetermined function of light emitting element temperature variation and drive time.

Additionally, in a light emitting apparatus according to another aspect of the present invention, the light emitting element controller controls the light emitted from the light emitting apparatus so as to be a desired chromaticity or color rendering level as white light.

Additionally, in a light emitting apparatus according to another aspect of the present invention, the light emitting element is a light emitting diode (LED).

Furthermore, LED lighting according to another aspect of the present invention comprises LEDs with three different chromaticities of red, blue and green LEDs. The LED lighting comprises an LED controller that controls light emitted from the LED lighting so as to be a desired chromaticity. The LED controller performs drive control of the LEDs based on a predetermined function of LED temperature variation. Accordingly, it is possible to provide RGB three-wavelength LED lighting that, even if the temperature varies, has a stable desired chromaticity without chromaticity variation. In addition, since the desired chromaticity is controlled based on a property function of wavelength fluctuation due to temperature variation of each of red, blue and green LEDs, it is possible to provide more reliable reproduction characteristics, and a desired chromaticity.

Additionally, in LED lighting according to another aspect of the present invention, the LED controller controls drive currents and/or drive voltages of the LEDs based on a predetermined function of LED temperature variation. Accordingly, it is possible to provide LED lighting that, even if the temperature varies, has a stable desired chromaticity without chromaticity variation. In addition, since the desired chromaticity is controlled based on a property function of wavelength fluctuation due to LED temperature variation, it is possible to provide more reliable reproduction characteristics, and to maintain a desired chromaticity.

Additionally, in LED lighting according to another aspect of the present invention, the LED controller controls the light emitted from the LED lighting so as to be a desired chromaticity that belongs to white light. Accordingly, it is possible to provide LED lighting that, even if the temperature varies, has a stable desired white chromaticity without white chromaticity variation. In addition, since the desired chromaticity is controlled based on a property function of wavelength fluctuation due to LED temperature variation, it is possible to provide more reliable reproduction characteristics, and to maintain a desired chromaticity.

Furthermore, LED lighting according to another aspect of the present invention is an LED backlight comprising LEDs with three different chromaticities of red, blue and green LEDs, and an LED controller that controls light emitted from the LED backlight so as to be a desired chromaticity that belongs to white light. The LED controller controls drive currents and/or drive voltages of the LEDs based on a predetermined function of LED temperature variation. Accordingly, it is possible to provide an LED backlight that, even if the temperature varies, has a stable desired white chromaticity without white chromaticity variation. In addition, since the white chromaticity is calculated based on a property function of wavelength fluctuation due to LED temperature variation, it is possible to provide more reliable reproduction characteristics, and to maintain a desired white chromaticity.

Furthermore, LED lighting according to another aspect of the present invention is an LED backlight comprising LEDs with three different chromaticities of red, blue and green LEDs, an LED controller that controls light emitted from the LED backlight so as to be a desired chromaticity, and storage that previously stores drive current values and/or drive voltage values for a plurality of LED temperatures for bringing the light emitted from the LED backlighting so as to be the desired chromaticity. The LED controller controls drive currents and/or drive voltages of the LEDs based on the drive current values and/or drive voltage values corresponding to a given temperature stored in the storage. Accordingly, it is possible to provide an LED backlight that, even if the temperature varies, has a stable desired white chromaticity without white chromaticity variation. In addition, since the desired chromaticity is set based on a previously stored property of wavelength fluctuation due to LED temperature variation, it is possible to more quickly provide more reliable reproduction characteristics, and to maintain a desired white chromaticity.

Additionally, in LED lighting according to another aspect of the present invention, the desired chromaticity emitted from the LED backlight is white light.

Furthermore, LED lighting according to another aspect of the present invention is LED lighting comprising LEDs with three different chromaticities of red, blue and green LEDs, an LED controller that controls light emitted from the LED lighting so as to be a desired chromaticity, and a temperature detector. The LED controller performs drive control of the LEDs based on a signal from the temperature detector and a predetermined function of LED temperature variation. Accordingly, even in the case of lighting use such as the case where the temperature constantly varies during operation, an arbitrary desired chromaticity can be held, and can be set and maintained. It is not necessary to constantly detect the temperature. The temperature can be detected at an arbitrary interval, for example. The temperature detection can be adjusted if necessary.

Furthermore, LED lighting according to another aspect of the present invention is LED lighting comprising LEDs with three different chromaticities of red, blue and green LEDs, an LED controller that controls light emitted from the LED lighting so as to be a desired chromaticity, a temperature detector, and a drive time detector. The LED controller performs drive control of the LEDs based on signals from the temperature detector and the drive time detector, and a predetermined function of LED temperature variation and drive time. Accordingly, even in the case RGB-LED temperature variation, LED lighting environmental temperature variation, or light emission state variation caused by deterioration due to LED lighting drive elapsed time, it is possible to provide an RGB-LED lighting that can stably set and maintain a desired chromaticity such as white color, in terms of lighting. Particularly, in the lighting of RGB primary colors, although the chromaticity region that can be represented in color is shown by a triangle, when the chromaticity region of each LED shifts, the chromaticity region that can be represented in color can be controlled according to the variation.

Furthermore, LED lighting according to another aspect of the present invention is LED lighting comprising LEDs with three different chromaticities of red, blue and green LEDs, an LED controller that controls light emitted from the LED lighting so as to be a desired chromaticity, and a temperature setter. The LED controller performs drive control of the LEDs based on a set value that is set in the temperature setter and a predetermined function of LED temperature variation. Accordingly, since a drive control value corresponding to a value that is set and input in a temperature set value can be calculated to perform driving at the drive control value that provides a desired chromaticity irrespective of temperature set value, it is possible to provide LED lighting having a desired chromaticity with simple drive circuitry.

Additionally, in LED lighting according to another aspect of the present invention, the LED controller controls drive currents and/or drive voltages of the LEDs based on a predetermined function of LED temperature variation.

Additionally, in LED lighting according to another aspect of the present invention, the LED controller controls the light emitted from the LED lighting so as to be a desired chromaticity that belongs to white light.

Furthermore, LED lighting according to another aspect of the present invention is LED lighting comprising LEDs with three different chromaticities of red, blue and green LEDs, an LED controller that controls light emitted from the LED lighting so as to be a desired chromaticity, a temperature setter, and a drive time detector. The LED controller performs drive control of the LEDs based on a set value that is set in the temperature setter, a signal from the temperature detector, and a predetermined function of LED temperature variation and drive time. Accordingly, since a LED drive control value corresponding to a temperature that is set in the temperature set value and drive time is calculated to perform control, it is possible to provide LED lighting with a desired chromaticity irrespective of temperature and drive time.

Furthermore, LED lighting according to another aspect of the present invention is LED lighting comprising LEDs with three different chromaticities of red, blue and green LEDs, an LED controller that controls light emitted from the LED lighting so as to be a desired color rendering level, a temperature detector, and a drive time detector. The LED controller performs drive control of the LEDs based on signals from the temperature detector and the drive time detector, and a predetermined function of LED temperature variation and drive time.

Additionally, in LED lighting according to another aspect of the present invention, the LED controller controls drive currents and/or drive voltages of the LEDs based on a predetermined function of LED temperature variation and drive time.

Furthermore, LED lighting according to another aspect of the present invention is LED lighting comprising LEDs with three different chromaticities of red, blue and green LEDs, an LED controller that controls light emitted from the LED lighting so as to a desired color rendering level, a temperature setter, and a drive time detector. The LED controller performs drive control of the LEDs based on a set value that is set in the temperature setter, a signal from the temperature detector, and a predetermined function of LED temperature variation and drive time.

Additionally, in LED lighting according to another aspect of the present invention, the LED controller controls the light emitted from the LED lighting so as to be the desired color rendering level as white light.

Furthermore, LED lighting according to another aspect of the present invention is LED lighting comprising LEDs with three different chromaticities of red, blue and green LEDs, an LED controller that controls light emitted from the LED lighting so as to be a desired chromaticity, and a temperature detector. The LED controller controls drive currents and/or drive voltages of the LEDs based on a signal from the temperature detector and a predetermined function of LED temperature variation. The LED controller controls light emitted from the LED lighting so as to be white light. The LED controller drives one LED with any one of the chromaticities at a constant current.

Furthermore, LED lighting according to another aspect of the present invention is LED lighting comprising LEDs with three different chromaticities of red, blue and green LEDs, and an LED controller that controls light emitted from the LED lighting so as to be a desired chromaticity and a desired luminance. The LED controller controls drive currents and/or drive voltages of the LEDs based on a predetermined function of LED temperature variation and thus controls the light emitted from the LED lighting so as to be white light with the desired luminance.

Furthermore, LED lighting according to another aspect of the present invention is LED lighting comprising LEDs with three different chromaticities of red, blue and green LEDs, an LED controller that controls light emitted from the LED lighting so as to be a desired chromaticity and a desired luminance, and a temperature detector. The LED controller controls drive currents and/or drive voltages of the LEDs based on a signal from the temperature detector and a predetermined function of LED temperature variation. The LED controller controls light emitted from the LED lighting so as to be white light with the desired luminance.

Furthermore, LED lighting according to another aspect of the present invention is LED lighting comprising LEDs with three different chromaticities of red, blue and green LEDs, an LED controller that controls light emitted from the LED lighting so as to be a desired chromaticity, a temperature detector, and a drive time detector. The LED controller controls drive currents and/or drive voltages of the LEDs based on signals from the temperature detector and the drive time detector, and a predetermined function of LED temperature variation and drive time. The LED controller controls light emitted from the LED lighting so as to be white light. The LED controller drives one LED with any one of the chromaticities at a constant current.

Furthermore, LED lighting according to another aspect of the present invention is LED lighting comprising LEDs with three different chromaticities of red, blue and green LEDs, an LED controller that controls light emitted from the LED lighting so as to be a desired chromaticity, and a temperature detector. The LED controller controls drive currents and/or drive voltages of the LEDs based on a set value that is set in the temperature setter and a predetermined function of LED temperature variation. The LED controller controls light emitted from the LED lighting so as to be the desired chromaticity that belongs to white light. The LED controller drives one LED with any one of the chromaticities at a constant current.

Furthermore, LED lighting according to another aspect of the present invention is LED lighting comprising LEDs with three different chromaticities of red, blue and green LEDs, an LED controller that controls light emitted from the LED lighting so as to be a desired chromaticity and a desired luminance, and a temperature setter. The LED controller controls drive currents and/or drive voltages of the LEDs based on a set value that is set in the temperature setter and a predetermined function of LED temperature variation. Thus, the LED controller controls the light emitted from the LED lighting so as to be white light with the desired luminance.

Furthermore, LED lighting according to another aspect of the present invention is LED lighting comprising LEDs with three different chromaticities of red, blue and green LEDs, an LED controller that controls light emitted from the LED lighting so as to be a desired chromaticity, a temperature setter, and a drive time detector. The LED controller control drive currents and/or drive voltages of the LEDs based on a set value that is set in the temperature setter and a signal from the drive time detector, and a predetermined function of LED temperature variation and drive time. The LED controller controls light emitted from the LED lighting so as to be white light. The LED controller drives one LED with any one of the chromaticities at a constant current.

Furthermore, LED lighting according to another aspect of the present invention is LED lighting comprising LEDs with three different chromaticities of red, blue and green LEDs, an LED controller that controls light emitted from the LED lighting so as to a desired color rendering level, a temperature detector, and a drive time detector. The LED controller controls drive currents and/or drive voltages of the LEDs based on signals from the temperature detector and the drive time detector, and a predetermined function of LED temperature variation and drive time. The LED controller controls light emitted from the LED lighting so as to be the desired color rendering level as white light. The LED controller drives one LED with any one of the chromaticities at a constant current.

Furthermore, LED lighting according to another aspect of the present invention is LED lighting comprising LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED lighting so as to be a desired color rendering level, a temperature detector, and a drive time detector. The LED controller performs drive control of the LEDs based on signals from the temperature detector and the drive time detector, and a predetermined function of LED temperature variation and drive time.

Additionally, in LED lighting according to another aspect of the present invention, the LED controller controls drive currents and/or drive voltages of the LEDs based on a predetermined function of LED temperature variation and drive time.

Furthermore, LED lighting according to another aspect of the present invention is LED lighting comprising LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED lighting so as to be a desired color rendering level, a temperature setter, and a drive time detector. The LED controller performs drive control of the LEDs based on a set value that is set in the temperature setter, a signal from the drive time detector, and a predetermined function of LED temperature variation and drive time.

Furthermore, LED lighting according to another aspect of the present invention is LED lighting comprising LEDs with three different chromaticities of red, blue and green LEDs, and an LED controller that controls light emitted from the LED lighting so as to be a desired chromaticity. The LED controller performs the pulse drive periods of drive current control and/or drive voltage control of the LEDs based on a predetermined function of LED temperature variation. The LED controller controls light emitted from the LED lighting so as to be white light. The LED controller drives LED with any one of the chromaticities at a constant current.

Furthermore, LED lighting according to another aspect of the present invention is LED lighting comprising LEDs with three different chromaticities of red, blue and green LEDs, an LED controller that controls light emitted from the LED lighting so as to be a desired chromaticity, and a temperature detector. The LED controller controls the pulse drive periods of drive currents and/or drive voltages of the LEDs based on a signal from the temperature detector and a predetermined function of LED temperature variation. The LED controller controls light emitted from the LED lighting so as to be white light. The LED controller drives one LED with any one of the chromaticities at a constant current.

Additionally, in LED lighting according to another aspect of the present invention, the predetermined function of the temperature variation represents that the drive current is a linear function of the temperature.

Furthermore, LED lighting according to another aspect of the present invention is LED lighting comprising LEDs with three different chromaticities of red, blue and green LEDs, an LED controller that controls light emitted from the LED lighting so as to be a desired chromaticity and a desired luminance, and a temperature detector. The LED controller controls the pulse drive periods of drive currents and/or drive voltages of the LEDs based on a signal from the temperature detector and a predetermined function of LED temperature variation. Thus, the LED controller controls the light emitted from the LED lighting so as to be white light with the desired luminance. The predetermined function of the temperature variation can represent that the drive current is a cubic function of the temperature.

Furthermore, LED lighting according to another aspect of the present invention is LED lighting comprising LEDs with three different chromaticities of red, blue and green LEDs, an LED controller that controls light emitted from the LED lighting so as to be a desired chromaticity, a temperature detector, and a drive time detector. The LED controller controls the pulse drive periods of drive currents and/or drive voltages of the LEDs based on signals from the temperature detector and the drive time detector, and a predetermined function of LED temperature variation and drive time. The LED controller controls light emitted from the LED lighting so as to be white light. The LED controller drives one LED with any one of the chromaticities at a constant current.

Furthermore, LED lighting according to another aspect of the present invention is LED lighting comprising LEDs with three different chromaticities of red, blue and green LEDs, an LED controller that controls light emitted from the LED lighting so as to be a desired chromaticity, and a temperature detector. The LED controller controls the pulse drive periods of drive currents and/or drive voltages of the LEDs based on a set value that is set in the temperature setter and a predetermined function of LED temperature variation. The LED controller controls light emitted from the LED lighting so as to be a desired chromaticity that belongs to white light. The LED controller drives one LED with any one of the chromaticities at a constant current. The LED that is driven at a constant current can be the red LED.

Furthermore, LED lighting according to another aspect of the present invention is LED lighting comprising LEDs with three different chromaticities of red, blue and green LEDs, an LED controller that controls light emitted from the LED lighting so as to be a desired chromaticity and a desired luminance, and a temperature setter. The LED controller controls the pulse drive periods of drive currents and/or drive voltages of the LEDs based on a set value that is set in the temperature setter and a predetermined function of LED temperature variation. Thus, the LED controller controls the light emitted from the LED lighting so as to be white light with the desired luminance. The predetermined function of the temperature variation can represent that the drive current is a cubic function of the temperature.

Furthermore, LED lighting according to another aspect of the present invention is LED lighting comprising LEDs with three different chromaticities of red, blue and green LEDs, an LED controller that controls light emitted from the LED lighting so as to be a desired chromaticity, a temperature setter, and a drive time detector. The LED controller control the pulse drive periods of drive currents and/or drive voltages of the LEDs based on a set value that is set in the temperature setter and a signal from the drive time detector, and a predetermined function of LED temperature variation and drive time. The LED controller controls light emitted from the LED lighting so as to be white light. The LED controller drives one LED with any one of the chromaticities at a constant current.

Furthermore, LED lighting according to another aspect of the present invention is LED lighting comprising LEDs with three different chromaticities of red, blue and green LEDs, an LED controller that controls light emitted from the LED lighting so as to be a desired color rendering level, a temperature detector, and a drive time detector. The LED controller controls the pulse drive periods of drive currents and/or drive voltages of the LEDs based on signals from the temperature detector and the drive time detector, and a predetermined function of LED temperature variation and drive time. The LED controller controls light emitted from the LED lighting so as to be the desired color rendering level as white light. The LED controller drives one LED with any one of the chromaticities at a constant current.

Furthermore, LED lighting according to another aspect of the present invention is LED lighting comprising LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED lighting so as to be a desired color rendering level, a temperature setter, and a drive time detector. The LED controller control the pulse drive periods of drive currents and/or drive voltages of the LEDs based on a set value that is set in the temperature setter and a signal from the drive time detector, and a predetermined function of LED temperature variation and drive time. The LED controller controls light emitted from the LED lighting so as to be the desired color rendering level as white light. The LED controller drives one LED with any one of the chromaticities at a constant current. The LED that is driven at a constant current can be the red LED.

Furthermore, LED lighting according to another aspect of the present invention is LED lighting comprising LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED lighting so as to be a desired color rendering level, a temperature detector, and a drive time detector. The LED controller performs pulse drive period control of the LEDs based on signals from the temperature detector and the drive time detector, and a predetermined function of LED temperature variation and drive time.

Additionally, in LED lighting according to another aspect of the present invention, the LED controller controls drive currents and/or drive voltages of the LEDs based on a predetermined function of LED temperature variation and drive time.

Furthermore, LED lighting according to another aspect of the present invention is LED lighting comprising LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED lighting so as to be a desired color rendering level, a temperature setter, and a drive time detector. The LED controller controls the pulse drive periods of the LEDs based on a set value that is set in the temperature setter, a signal from the drive time detector, and a predetermined function of LED temperature variation and drive time.

Additionally, in LED lighting according to another aspect of the present invention, the LED controller controls drive currents and/or drive voltages of the LEDs based on a predetermined function of LED temperature variation and drive time.

Additionally, in LED lighting according to another aspect of the present invention, the LED controller controls the light emitted from the LED lighting so as to be the desired color rendering level as white light.

Furthermore, an LED backlight according to another aspect of the present invention comprises LEDs with three different chromaticities of red, blue and green LEDs, an LED controller that controls light emitted from the LED backlight so as to be a desired chromaticity that belongs to white light, and a temperature detector. The LED controller controls drive currents and/or drive voltages of the LEDs based on a signal from the temperature detector and a predetermined function of LED temperature variation. Accordingly, even in the case of LED backlight use, such as in the case where use environment in temperature varies, since LED drive control can be performed based on a predetermined function based on the detected temperature even if the temperature varies, it is possible to more quickly maintain and set a desired chromaticity in wider environment in temperature.

Furthermore, an LED backlight according to another aspect of the present invention comprises LEDs with three different chromaticities of red, blue and green LEDs, an LED controller that controls light emitted from the LED backlight so as to be a desired chromaticity, storage that previously stores drive current values and/or drive voltage values for a plurality of LED temperatures for bringing the light emitted from the LED backlighting so as to be the desired chromaticity, and a temperature detector. The LED controller controls drive currents and/or drive voltages of the LEDs based on a signal from the temperature detector and the drive current values and/or drive voltage values corresponding to a given temperature stored in the storage. Accordingly, in temperatures within a wider set range, it is possible to provide an LED backlight that can maintain and set a desired chromaticity.

Furthermore, an LED backlight according to another aspect of the present invention comprises LEDs with three different chromaticities of red, blue and green LEDs, an LED controller that controls light emitted from the LED backlight so as to be a desired chromaticity that belongs to white light, a temperature detector, and a drive time detector. The LED controller controls drive currents and/or drive voltages of the LEDs based on signals from the temperature detector and the drive time detector, and a predetermined function of LED temperature variation and drive time. Accordingly, in an LED white backlight, even if a use environmental temperature or an LED temperature varies, or even in the case of luminance fluctuation and spectrum fluctuation of red, blue and green LEDs depending on drive time, it is possible to stably set and maintain white light in terms of LED backlight.

Furthermore, an LED backlight according to another aspect of the present invention comprises LEDs with three different chromaticities of red, blue and green LEDs, an LED controller that controls light emitted from the LED backlight so as to be a desired chromaticity, storage that previously stores drive current values and/or drive voltage values for a plurality of LED temperatures for bringing the light emitted from the LED backlighting so as to be the desired chromaticity, a temperature detector, and a drive time detector. The LED controller controls drive currents and/or drive voltages of the LEDs based on signals from the temperature detector and the drive time detector, and the drive current values and/or drive voltage values corresponding to a given temperature and a predetermined drive time stored in the storage. Accordingly, it is possible to provide correction drive control for drive temperature, drive elapsed time and LED chromaticity variation or shift with simple circuitry, and thus to provide a stable LED backlight with a desired chromaticity.

Furthermore, an LED backlight according to another aspect of the present invention comprises LEDs with three different chromaticities of red, blue and green LEDs, an LED controller that controls light emitted from the LED backlight so as to be a desired chromaticity that belongs to white light, and a temperature setter. The LED controller controls drive currents and/or drive voltages of the LEDs based on a value that is set in the temperature setter and a predetermined function of LED temperature variation. Accordingly, since drive control of LED backlight is performed based on a control current or a control voltage that is calculated to adjust a desired chromaticity corresponding to a set temperature, irrespective of set temperature, it is possible to provide a stable LED backlight having a desired chromaticity with a simple circuitry.

Furthermore, an LED backlight according to another aspect of the present invention comprises LEDs with three different chromaticities of red, blue and green LEDs, an LED controller that controls light emitted from the LED backlight so as to be a desired chromaticity, storage that previously stores drive current values and/or drive voltage values for a plurality of LED temperatures for bringing the light emitted from the LED backlighting so as to be the desired chromaticity, and a temperature setter. The LED controller controls drive currents and/or drive voltages of the LEDs based on a value that is set in the temperature setter and the drive current values and/or drive voltage values corresponding to a given temperature stored in the storage. Accordingly, a control drive current value or a control drive voltage value corresponding to a set temperature value is read when necessary to perform drive control, thus, it is possible to provide a stable LED backlight with a desired chromaticity irrespective of set temperature.

Furthermore, an LED backlight according to another aspect of the present invention comprises LEDs with three different chromaticities of red, blue and green LEDs, an LED controller that controls light emitted from the LED backlight so as to be a desired chromaticity that belongs to white light, a temperature setter, and a drive time detector. The LED controller controls drive currents and/or drive voltages of the LEDs based on a set value that is set in the temperature setter, a signals from the drive time detector, and a predetermined function of LED temperature variation and drive time.

Furthermore, an LED backlight according to another aspect of the present invention comprises LEDs with three different chromaticities of red, blue and green LEDs, an LED controller that controls light emitted from the LED backlight so as to be a desired chromaticity, storage that previously stores drive current values and/or drive voltage values for a plurality of LED temperatures for bringing the light emitted from the LED backlighting so as to be the desired chromaticity, a temperature setter, and a drive time detector. The LED controller controls drive currents and/or drive voltages of the LEDs based on a set value that is set in the temperature setter, a signals from the drive time detector, and the drive current values and/or drive voltage values corresponding to a given temperature and a predetermined drive time stored in the storage.

Additionally, in an LED backlight according to another aspect of the present invention, the desired chromaticity emitted from the LED backlight is white light.

Furthermore, an LED backlight according to another aspect of the present invention comprises LEDs with three different chromaticities of red, blue and green LEDs, an LED controller that controls light emitted from the LED backlight so as to be a desired color rendering level as white light, a temperature detector, and a drive time detector. The LED controller controls drive currents and/or drive voltages of the LEDs based on signals from the temperature detector and the drive time detector, and a predetermined function of LED temperature variation and drive time.

Furthermore, an LED backlight according to another aspect of the present invention comprises LEDs with three different chromaticities of red, blue and green LEDs, an LED controller that controls light emitted from the LED backlight so as to be a color rendering level, storage that previously stores drive current values and/or drive voltage values for a plurality of LED temperatures and drive time values for bringing the light emitted from the LED backlighting so as to be a desired color rendering level, a temperature detector, and a drive time detector. The LED controller controls drive currents and/or drive voltages of the LEDs based on signals from the temperature detector and the drive time detector, and the drive current values and/or drive voltage values corresponding to a given temperature and a predetermined drive time stored in the storage.

Furthermore, an LED backlight according to another aspect of the present invention comprises LEDs with three different chromaticities of red, blue and green LEDs, an LED controller that controls light emitted from the LED backlight so as to be a desired color rendering level as white light, a temperature setter, and a drive time detector. The LED controller controls drive currents and/or drive voltages of the LEDs based on a set value that is set in the temperature setter, a signals from the drive time detector, and a predetermined function of LED temperature variation and drive time.

Furthermore, an LED backlight according to another aspect of the present invention comprises LEDs with three different chromaticities of red, blue and green LEDs, an LED controller that controls light emitted from the LED backlight so as to be the desired color rendering level, a temperature setter, and a drive time detector. The LED controller controls drive currents and/or drive voltages of the LEDs based on a set value that is set in the temperature setter, a signals from the drive time detector, and the drive current values and/or drive voltage values corresponding to a given temperature and a predetermined drive time stored in the storage.

Furthermore, an LED backlight according to another aspect of the present invention comprises LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED backlight so as to be a desired color rendering level as white light, a temperature setter, and a drive time detector. The LED controller controls drive currents and/or drive voltages of the LEDs based on a set value that is set in the temperature setter, a signal from the drive time detector, and a predetermined function of LED temperature variation and drive time.

Furthermore, an LED backlight according to another aspect of the present invention comprises LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED backlight so as to be a desired color rendering level as white light, a temperature detector, and a drive time detector. The LED controller controls drive currents and/or drive voltages of the LEDs based on signals from the temperature detector and the drive time detector, and a predetermined function of LED temperature variation and drive time.

Furthermore, an LED backlight according to another aspect of the present invention comprises LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED backlight so as to be a color rendering level, storage that previously stores drive current values and/or drive voltage values for a plurality of LED temperatures for bringing the light emitted from the LED backlighting so as to be a desired color rendering level, a temperature detector, and a drive time detector. The LED controller controls drive currents and/or drive voltages of the LEDs based on signals from the temperature detector and the drive time detector, and the drive current values and/or drive voltage values corresponding to a given temperature and a predetermined drive time stored in the storage.

Furthermore, an LED backlight according to another aspect of the present invention comprises LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED backlight so as to be a color rendering level, storage that previously stores drive current values and/or drive voltage values for a plurality of LED temperatures for bringing the light emitted from the LED backlighting so as to be a desired color rendering level, a temperature setter, and a drive time detector. The LED controller controls drive currents and/or drive voltages of the LEDs based on a set value that is set in the temperature setter, a signals from the drive time detector, and the drive current values and/or drive voltage values corresponding to a given temperature and a predetermined drive time stored in the storage.

Furthermore, an LED backlight according to another aspect of the present invention comprises LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED backlight so as to be a desired color rendering level as white light, a temperature detector, and a drive time detector. The LED controller performs drive current control and/or drive voltage pulse drive period control of the LEDs based on signals from the temperature detector and the drive time detector, and a predetermined function of LED temperature variation and drive time.

Furthermore, an LED backlight according to another aspect of the present invention comprises LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED backlight so as to be a color rendering level, storage that previously stores drive current values and/or drive voltage values for a plurality of LED temperatures for bringing the light emitted from the LED backlighting so as to be a desired color rendering level, a temperature detector, and a drive time detector. The LED controller performs drive current control and/or drive voltage pulse drive period control of the LEDs based on signals from the temperature detector and the drive time detector, and the drive current values and/or drive voltage values corresponding to a given temperature and a predetermined drive time stored in the storage.

Furthermore, an LED backlight according to another aspect of the present invention comprises LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED backlight so as to be a desired color rendering level as white light, a temperature setter, and a drive time detector. The LED controller performs drive current control and/or drive voltage pulse drive period control of the LEDs based on a set value that is set in the temperature setter, a signals from the drive time detector, and a predetermined function of LED temperature variation and drive time.

Furthermore, an LED backlight according to another aspect of the present invention comprises LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element, an LED controller that controls light emitted from the LED backlight so as to be a color rendering level, storage that previously stores drive current values and/or drive voltage values for a plurality of LED temperatures for bringing the light emitted from the LED backlighting so as to be a desired color rendering level, a temperature setter, and a drive time detector. The LED controller performs drive current control and/or drive voltage pulse drive period control of the LEDs based on a set value that is set in the temperature setter, a signals from the drive time detector, and the drive current values and/or drive voltage values corresponding to a given temperature and a predetermined drive time stored in the storage.

Additionally, in an LED backlight according to another aspect of the present invention, the chromaticity emitted from the LED backlight is white light.

A control method, according to another aspect of the present invention, of a light emitting apparatus that comprises at least two light emitting elements with different chromaticities, and the light emitting apparatus controls light emitted from the light emitting apparatus so as to be a desired chromaticity and controls the light emitting elements based on a predetermined function of light emitting element temperature variation.

Additionally, in a control method of light emitting apparatus according to another aspect of the present invention, the light emitting element controller controls drive currents and/or drive voltages of the light emitting elements based on a predetermined function of light emitting element temperature variation.

Additionally, in a control method of light emitting apparatus according to another aspect of the present invention, the light emitting element controller controls the light emitted from the light emitting apparatus so as to be a desired chromaticity that belongs to white light.

Additionally, in a control method of a light emitting apparatus according to another aspect of the present invention, the light emitting element is a light emitting diode (LED).

Additionally, in a control method of a light emitting apparatus according to another aspect of the present invention, the light emitting element controller controls the pulse drive periods of drive currents and/or drive voltages of the light emitting elements based on a predetermined function of light emitting element temperature variation.

Furthermore, a control method, according to another aspect of the present invention, of LED lighting comprising LEDs with three different chromaticities of red, blue and green LEDs, and an LED controller that controls light emitted from the LED lighting so as to be a desired chromaticity. The LED controller performs drive control of the LEDs based on a predetermined function of LED temperature variation.

Additionally, in a control method of LED lighting according to another aspect of the present invention, the LED controller controls drive currents and/or drive voltages of the LEDs based on a predetermined function of LED temperature variation.

Additionally, in a control method of LED lighting according to another aspect of the present invention, the LED controller controls the light emitted from the LED lighting so as to be a desired chromaticity that belongs to white light.

Furthermore, a control method of LED lighting according to another aspect of the present invention is a control method of LED lighting comprising LEDs with three different chromaticities of red, blue and green LEDs, and an LED controller that controls light emitted from the LED lighting so as to be a desired chromaticity and a desired luminance. The LED controller controls the pulse drive periods of drive currents and/or drive voltages of the LEDs based on a predetermined function of LED temperature variation. Thus, the LED controller controls the light emitted from the LED lighting so as to be white light with the desired luminance.

Additionally, in a control method of LED lighting according to another aspect of the present invention, the predetermined function of the temperature variation represents that the drive current is a cubic function of the temperature.

Furthermore, a control method of LED lighting according to another aspect of the present invention is a control method of LED lighting comprising LEDs with three different chromaticities of red, blue and green LEDs, and an LED controller that controls light emitted from the LED lighting so as to be a desired chromaticity. The LED controller controls drive currents and/or drive voltages of the LEDs based on a predetermined function of LED temperature variation. The LED controller controls light emitted from the LED lighting so as to be white light. The LED controller drives one LED with any one of the chromaticities at a constant current. The LED that is driven at a constant current can be the red LED.

Furthermore, a drive method of LED lighting according to another aspect of the present invention is a control method of LED lighting comprising LEDs with three different chromaticities of red, blue and green LEDs, and an LED controller that controls light emitted from the LED lighting so as to be a desired chromaticity and a desired luminance. The LED controller controls drive currents and/or drive voltages of the LEDs based on a predetermined function of LED temperature variation. Thus, the LED controller controls the light emitted from the LED lighting so as to be white light with the desired luminance.

Additionally, in a drive method of LED lighting according to another aspect of the present invention, the predetermined function of the temperature variation represents that the drive current is a cubic function of the temperature.

Furthermore, a control method of LED lighting according to another aspect of the present invention is a control method of LED lighting comprising LEDs with three different chromaticities of red, blue and green LEDs, and an LED controller that controls light emitted from the LED lighting so as to be a desired chromaticity. The LED controller performs the pulse drive periods of drive current control and/or drive voltage control of the LEDs based on a predetermined function of LED temperature variation. The LED controller controls light emitted from the LED lighting so as to be white light. The LED controller drives one LED with any one of the chromaticities at a constant current. The LED that is driven at a constant current can be the red LED.

Additionally, in a drive method of LED lighting according to another aspect of the present invention, the predetermined function of the temperature variation represents that the drive current is a linear function of the temperature.

Furthermore, a control method of an LED backlight according to another aspect of the present invention is a control method of an LED backlight comprising LEDs with three different chromaticities of red, blue and green LEDs, and an LED controller that controls light emitted from the LED backlight so as to be a desired chromaticity that belongs to white light. The LED controller controls drive currents and/or drive voltages of the LEDs based on a predetermined function of LED temperature variation.

Furthermore, a control method of an LED backlight according to another aspect of the present invention is a control method of an LED backlight comprising LEDs with three different chromaticities of red, blue and green LEDs, an LED controller that controls light emitted from the LED backlight so as to be a desired chromaticity, and storage that previously stores drive current values and/or drive voltage values for a plurality of LED temperatures for bringing the light emitted from the LED backlighting so as to be the desired chromaticity. The LED controller controls drive currents and/or drive voltages of the LEDs based on the drive current values and/or drive voltage values corresponding to a given temperature stored in the storage.

Additionally, in a control method of an LED backlight according to another aspect of the present invention, the desired chromaticity emitted from the LED backlight is white light.

(Two or More Different Chromaticities)

The following description will describe embodiments according to the present invention with reference to the drawings. As shown in a schematic diagram of FIG. 3, chromaticity is generally represented by chromaticity coordinates. Different coordinate points in the chromaticity coordinates give different chromaticities, although color tone is occasionally used for representation. The schematic diagram of FIG. 3 shows mixture of light consisting of three, RGB chromaticities of red, green and blue colors. However, two, or more than three different chromaticities of light can be mixed. A typical example is RGB white light of red, green and blue colors. LEDs with two different chromaticities of white LED that can emit white light and is composed of a semiconductor light emitting element capable of emitting ultraviolet rays or visible light and a phosphor emitting luminescent radiation caused by excitation of light emitted from the semiconductor light emitting element, and a red LED can be combined. Alternatively, LEDs with four different chromaticities of RGB-LEDs, and a white LED that can emit white light and is composed of a semiconductor light emitting element capable of emitting ultraviolet rays or visible light and a phosphor emitting luminescent radiation caused by excitation of light emitted from the semiconductor light emitting element can be combined. Light emitting elements are not limited to LEDs. That is, even in order to provide white light, it is not necessary to employ three light emitting diodes of red, green and blue LEDs. For example, LEDs that can emit blue green light and red light can be combined. Alternatively, LEDs that can blue light and yellow light can be combined. Complementary color relationship is merely required. The number of them can be increased or reduced if desired. A YAG group white LED or the like can be employed. In the case where a YAG group LED is included, since light contains a yellow component, it is particularly effective for adjustment, and correction and maintenance of color rendering. Therefore, in this case, adjustment region capability is highly improved.

(Light Emitting Apparatus)

The light emitting apparatus is an apparatus that emits and radiates light, and is typically lighting that employs an electricity-to-light conversion device for converting electric energy into light. A backlight for LCD etc., a headlight, a front light, an organic or inorganic electroluminescence, various types of display boards including LED display, a dot matrix unit, a dot line unit, or the like, can be used as the light emitting apparatus except lighting. However, any apparatus that can provide light outwardly of the apparatus can be used as the light emitting apparatus. Additionally, in the case of an LED backlight, as it is understood from various monitors including for mobile phone use, and so on, space-saving, and size and weight reduction are particularly required. For this reason, it is preferably that the present invention is applied to an LED backlight in terms of circuitry and memory saving, space-saving, power-saving, high reliability, and so on.

(Emitted Light)

Light that is outwardly emitted from the light emitting apparatus is referred to as "emitted light". The chromaticity of emitted light in this specification does not always refer to light that is immediately after emitted from the apparatus. For example, in the case where emitted light is white, light that is immediately after emitted from the apparatus can be white. Alternatively, even if light that is immediately after emitted from the apparatus may not be white, e.g., red, blue and green colors, the chromaticity of the emitted light also refers to white as long as the chromaticity of light that is emitted and is viewed in an actual application is white.

(Desired Chromaticity)

The desired chromaticity is typically light with a chromaticity of white. However, the desired chromaticity referred in the present invention may not be white. For example, in the case of a light source of RGB, any chromaticity that is represented in the RGB triangle on the chromaticity coordinates can be represented by adjustment of intensities of RGB light. Accordingly, in any chromaticity of light if initial light emission chromaticities of three, RGB wavelengths of the light source fluctuate, fluctuation of chromaticity of mixed light that is emitted from the apparatus cannot be prevented only by maintenance of constant luminance. In addition, the desired chromaticity is only required at a chromaticity measurement position where light is viewed in an actual application. In other words, it is only required that a chromaticity at a position where the desired chromaticity is required meets a desired value.

(Light Emitting Element Controller)

For example, the light emitting element controller is a controller that performs drive control of light emission of light emitting elements such as control of current or voltage provided to the light emitting elements. Typically, an APC drive device (constant light power drive device), an ACC drive device (constant current drive device), and so on, can be given as examples. However, except them, a current, a voltage, or the like, for various types of correction (typically, luminance correction, chromaticity correction, etc.,) can be superimposed and provided, and the total amount can be controlled. In addition, the light emitting element controller includes a device that controls light emission patterns or a light emission amount such as PWM (Pulse Width Modulation) control for controlling light emission luminance or chromaticity. In the case of pulse drive period control of current including PWM control, in the present invention, particularly, fluctuation of light emission state depending on pulse current amplitude control in drive current control different from fluctuation of light emission state (chromaticity, luminance and color rendering level) depending on temperature or drive period is suppressed. In other words, because of the drive current amount control by pulse width, fluctuation of light emission state due to fluctuation of pulse height is suppressed. For this reason, pulse drive period control of current is preferable.

(Predetermined Function of Temperature Variation)

When the temperature varies, in the case where current control or the like is performed so as to maintain the chromaticity or color tone, a predetermined relationship between current or voltage to be controlled and temperature in the temperature variation. The predetermined relationship is a linear function or quadratic function in some cases, or is a cubic function in other cases. The predetermined relationship may be other relationship function. In addition, as for the relationship, depending on how a reference temperature is set and considered, a relationship function that represents a relative value to be controlled, or the like, may vary. Additionally, since the relationship function shows a similar tendency in the same type of LED, the same function (relationship function) can be applied to the same type of LED. That is, for example, in the case where the above predetermined function is a linear function, even if different lighting apparatuses such as different types of lighting, when the light emitting apparatuses are composed of the same types of LEDs, a similar function can determines their relationship functions. In other words, their relationship functions have the same slope of linear functions of temperature variation. Particularly, in a white light emitting apparatus composed of RGB LEDs as shown in examples, when a drive current value of a red LED is always constant, even in temperature variation, it is found that respective drive current values of blue and green LEDs are closely analogous to a linear function for maintenance of white balance. That is, such a linear function is $y=ax+b$ ($-0.002 \geqq a \geqq 0.008$), where y is a relative value of the drive current, x is a centigrade temperature (ambient temperature in the examples) of degrees centigrade (° C.), and b is about 1.05 to 1.2 in the case where the reference of the relative value of the drive current is normalized at 25° C. as in the examples.

In addition, as for the predetermined function, before the light emitting apparatus such as lighting is actually operated, for example, before shipment of product, and so on, when it is previously measured and calculated once, after that, in actual operation, based on the relationship function, a drive current or the like can be determined for the temperature. Thus, the chromaticity or color tone can be maintained constant very easily. Although the relationship function can be represented as a function in some cases, it is not necessary to represent it as a function. Relationship data between temperature and control current, and so on, can be previously stored and held in a storage device such as memory, thus, control is performed so as to maintain the chromaticity or color tone based on control data that is read for the temperature in actual operation if necessary. In the case of function control, since the capacity of a storage element such as memory can be saved very much and can be small, there is a very advanced merit in terms of lower power consumption, and size and weight reduction, and price reduction of storage element including peripheral circuitry, and so on.

Moreover, a color rendering level (color rendering property) and luminance of light emitting elements fluctuate for temperature in addition to a chromaticity. It is preferable that the predetermined function is a control function of temperature that separately corrects these chromaticity, luminance and color rendering property for temperature or combination of any two of them, or performs total correction including all three of chromaticity, luminance and color rendering property in terms of multi-function performance as light emitting apparatus such as lighting.

(Desired Chromaticity that Belongs to White Light)

Figure 4:
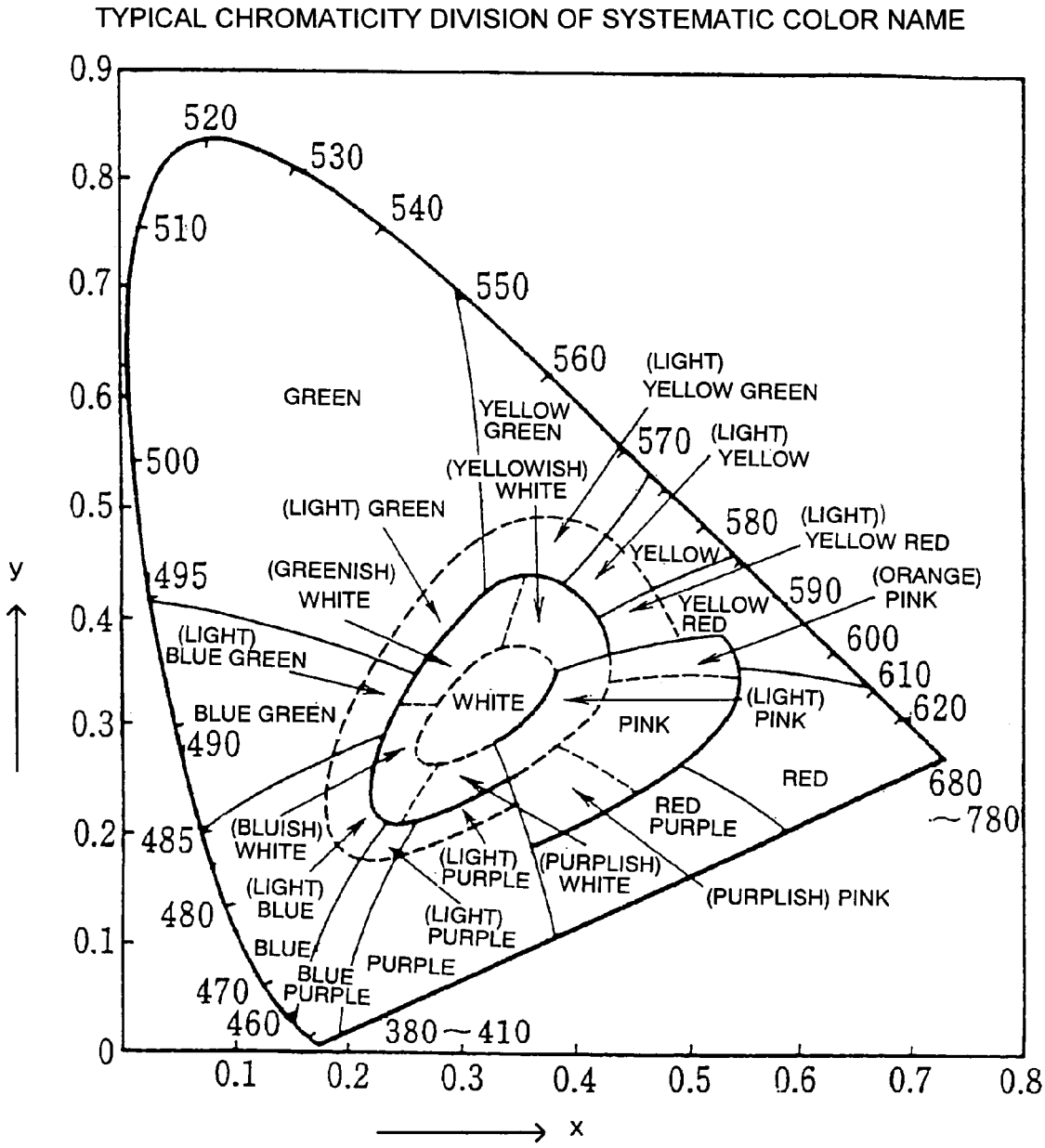
FIG. 4 is a chromaticity diagram with chromaticity regions showing white in the present invention.

White balance refers to adjustment that adjusts light mixture rate such that the color of lighting light source is white. The white as the lighting light source in this case is typically defined by chromaticity coordinates of the JIS Z8701XYZ calorimetric system in the JIS standard as "typical chromaticity division of systematic color name" as shown in FIG. 4. In this specification, typical white refers to colors divided as white, (bluish) white, (purplish) white, (yellowish) white, (greenish) white, and (light) pink (the division shown by a dotted line in FIG. 4). For example, in the case of white composed of three colors, red, green and blue of LEDs, suitable relative adjustment of respective drive currents applied to these three types of LEDs achieves white with different tints. In addition, in the case of white of mixture of (yellow+blue), similarly, suitable relative adjustment of respective drive currents applied to these colors of LEDs, adjustment of phosphor amount or components, and so on, that is, suitable adjustment of emission distribution ratio of the colors of light provides relative intensity variation of color components and thus achieves white, and additionally can suitably provide fine tint adjustment.

On the other hand, white balance is measured by means of a sensor tool. The sensor tool is typically a chromaticity and luminance meter, or a sphere photometer. Light intensities of all wavelengths are measured by means of them, thus evaluation and confirmation can be performed. However, if this sensor tool that measures white balance is configured as a part of lighting apparatus to be always carried or moved, it becomes large and is not convenient for handling. Accordingly, the lighting apparatus can be constructed such that white balance can be adjusted and conformed by means of this sensor tool that is calibrated to be standardized. But even if a sensor tool that can adjust white balance, and can perform evaluation and confirmation is used other than the above construction, there is no problem. In a relationship between color rendering and lamp efficiency or light emission efficiency, when color balance of light for lighting (emitted light) is adjusted on the blackbody radiation line, such as yellow systematic color on the blackbody radiation line, it is possible to provide a more desirable lighting effect. In this embodiment of the present invention, respective drive current values of LEDs are adjusted as initial set values in shipment of lighting apparatus in facilities, and so on, such that a desired white balance is adjusted. The current values of drive currents in the case where the white balance is achieved can be stored as set values of white balance, or a temperature function or time function can be stored. Furthermore, as for brightness in the case where the above white balance is achieved, desired dimming levels such as bright, middle and dark are set. White balance is adjusted in brightness in each dimming level, thus, drive current values at the adjustment can be stored as set values of white balance.

A lighting apparatus that typically emits white light as emitted light of lighting and employs light emitting diodes (LEDs) as electricity-to-light conversion elements is referred to as a white light LED lighting apparatus in this specification. It is not always necessary that respective colors of LEDs are white, however, the white light LED lighting apparatus is an LED lighting apparatus that provides white light at least a point where light as final light for lighting after the light from them is mixed reaches an object to be illuminated. Typically, in a lighting apparatus where it is perceptible or recognizable that white light is emitted at a point where light from the light source of the lighting apparatus or a light emission portion is emitted outwardly from the lighting apparatus when the lighting apparatus is viewed at a suitable distance, in the case where an LED is used as an electricity-to-light conversion elements, the lighting apparatus is referred to as a white LED lighting apparatus. In addition, although typical definition of white is already stated, for example, a tint that is seen as yellowish tint such as sunlight source and incandescent lamp is included in white in this specification in a broad sense. This type of lighting apparatus is included in the white lighting apparatus in the present invention. Particularly, since, in the case of white light that is adjusted on the blackbody radiation line, most people have a feeling of security in visual sense, and are relaxed, additionally, color rendering property is provided and improved. Therefore, this type of white light is preferable.

(Storage)

The storage includes general memories including various types of ROM, RAM and so on such as flash memory, EEPROM, flip-flop, and general storage media such as MO, CD, DVD, and HD. In addition, the storage can be configured such that a storage medium performs storage/maintenance, and constantly performs reading if necessary.

(Given Temperature)

The temperature in the present invention is typically a junction temperature including a light emission portion (or light emission layer) of light emitting element. However, actually, it is difficult to directly and accurately measure the junction temperature of element. The temperature can include not only the junction temperature but also a board temperature that is provided with the element mounted thereon and a stem (mount base) temperature, and additionally a light emitting apparatus temperature and an environmental temperature where the light emitting apparatus is located, as mutatis mutandis application of the junction temperature. The "given" refers to that, in relationship between the above temperature and chromaticity or the like, correlation is previously determined by a function or the like, and is measured, evaluated, grasped and recognized. The correlation is represented and grasped by a function in some cases. Relationship between temperature and chromaticity can be evaluated by data, and the data may be stored in a memory (storage device). Accordingly, if the above temperature according to the light emitting apparatus in operation of light emitting apparatus is found, a wavelength component light emitted from the light emitting apparatus at the temperature, i.e., chromaticity or the like of each light emitting element that composes the light emitting apparatus, is found. Alternatively, it is possible to calculate and derive, in order to maintain or set a chromaticity of the light emitting apparatus at a desired value, how light emission adjustment of each light emitting element should be set, that is, how setting of light emission intensity of each light emitting element that composes the light emitting apparatus, is relatively adjusted and/or absolutely adjusted, based on the memory that stores previously obtained measurement and setting or function. In addition, it is not necessary that the above temperature is an absolute temperature index (typically, absolute temperature (degree Kelvin), or a centigrade temperature (° C.)). As for the temperature detector, the above temperature can be a relative temperature index by a sensor or the like in which a voltage and current is varies for the temperature thermostat, thermistor, FET, bipolar transistor, silicon diode, and so on. There is no problem in the construction of the present invention as long as control by relative temperature can be performed based on the index. In addition, in the case where an environmental temperature where the light emitting apparatus or the light emitting element is driven is measured and evaluated, and is found by a temperature detector such as other temperature measurement device, or in the case where an operation environmental temperature is previously determined and is clear, it is not necessary to provide a temperature detector such as the above temperature detection sensor in the light emitting apparatus. Storage adjustment or calculation processing can be performed as control setting of light emission state corresponding to a set temperature that is set in the temperature setter and is previously found.

According to a method that employs the temperature detector of the present invention such as temperature detection sensor, it is possible to provide precise color shift correction at high level where it is difficult that a method by feedback control with a photo sensor corrects color shift.

(Light Emitting Element)

The light emitting element in the present invention typically refers to an element and typically a semiconductor light emitting element that can convert electric energy into light energy by electricity-to-light conversion. In addition to them, the light emitting element includes all electricity-to-light conversion elements that emits light such as various types of discharge tubes, incandescent lamp, mercury lamp, fluorescent lamp, electroluminescence, backlight for LCD/TFT (e.g., cold-cathode tube, etc.) all. A backlight for LCD/TFT, lighting, and so on, are light sources that are particularly required to provide a stable chromaticity or color tone for temperature variation. For this reason, the present invention is preferably applied to them.

Particularly, the semiconductor light emitting element includes light emitting elements of an LED (light emitting diode) and an LD (laser diode) that are composed of, needless to say, a semiconductor compound of a semiconductor material such as GaAs group, InP group, and GaN group so-called III-V group semiconductor compound, and additionally composed of other semiconductor materials such as Si group, all. A semiconductor light emitting diode is preferable. In addition, in this case, it can contain nitride group semiconductor material of $Al_xIn_yGa_{1-x-y}N$ ($0 \leqq x$, $0 \leqq y$, $x+y \leqq 1$) as a material of the semiconductor light emitting diode. Particularly, in a light emitting apparatus comprising light emitting elements of a red LED composed of AlInGaP group semiconductor material, and blue and green LEDs composed of GaN group semiconductor material, drive currents have linear and cubic functions in the case of constant chromaticity control or constant luminance control. Accordingly, calculation control can be easy, and circuitry can be simple, small and light weight. For this reason, this type of apparatus is preferable.

(Temperatures of Light Emitting Element)

A light emission wavelength property of light emitting element fluctuates depending on the temperature. Accordingly, control currents and so on that provide a desired color balance at a plurality of temperatures of light emitting element in actual use of the light emitting element are previously measured and stored, for example, in actual use, a control current value corresponding to the temperature is read from the storage device, thus, it is possible to perform control that maintains the desired color balance. Of course, it is also possible to perform calculation processing of a function of the temperature without storing them in the storage device. A plurality of temperatures refer to that two or more temperatures are included in the temperatures of the light emitting element in actual use of the light emitting apparatus.

(Red LED)

Typically, as for color of single color radiation, a wavelength of 640 nm to 780 nm refers to red, and an LED that emits light within the range of this color refers to a red LED. In addition, in the case of 578 nm to 640 nm, although it is called as yellowish yellowred, reddish, this range is also included in the red LED in the present invention (in the JIS 8110 standard, green is 495 nm to 548 nm, yellowish green 548 nm to 573 nm, yellow is 573 nm to 584 nm, yellow red 584 nm to 610 nm, and red is 610 nm to 780 nm). In other words, although an LED that emits light with a main light emission wavelength of 640 nm to 780 nm and/or 578 nm to 640 nm refers to a typical red LED, it is not necessary to show red light emission in terms of semiconductor material level. The red LED can be an LED that emits light of the above red light emission in combination with wavelength conversion material. In addition, in consideration of property of LED that is used as an electricity-to-light conversion element, the LED can contain light emission spectrum of other wavelength range. Additionally, an LED that is set to emit red light by combination with light of wavelength other than the above range is also included in the red LED.

The wavelength conversion material that emits red luminescent radiation is a nitride phosphor that is represented by a general formula $L_XM_YN_{((2/3)X+(4/3)Y)}$:R or $L_XM_YO_ZN_{((2/3)X+(4/3)Y-(2/3)Z)}$:R (where L is at least one II group element that is selected from the group consisting of Be, Mg, Ca, Sr, Ba and Zn, and essentially contains Ca or Sr; M is at least one IV group element that is selected from the group consisting of C, Si, Ge, Sn, Ti, Zr and Hf, and essentially contains Si; R is at least one rare earth element that is selected from the group consisting of Y, La, Ce, Pr, Nd, Sm, Eu, Gd, Tb, Dy, Ho, Er and Lu, and essentially contains Eu; $0.5 \leqq x \leqq 3$, $1.5 \leqq y \leqq 8$, $0 \leqq z \leqq 3$). The nitride phosphor preferably contains not less than 1 ppm and not more than 10000 ppm of Mn and or B. The nitride phosphor can be represented by the above general formula. The above general formula preferably contains Mn and/or B. Accordingly, it is possible to improve luminance of light emission and light emission efficiency such as quantum efficiency. Although the reason of this effect is not clear, it is conceivable that preferable addition of manganese and/or boron disperses activator, and thus accelerates particle growth.

In addition, it is conceivable that a manganese or boron element comes into the crystal lattice, and reduce strain of the crystal lattice or relates to a light emission mechanism, and thus improves light emission characteristics such as light emission luminance and quantum efficiency.

Said rare earth element is preferably at least one element that essentially contains Eu. The reason is that, in the case where Eu is employed as an activator, a phosphor that emits luminescent radiation from orange to red can be provided. Partial substitution of other rare earth element for Eu can provide a nitride phosphor that has a different color tone and different persistence characteristics.

The crystal structure of said nitride phosphor is an orthorhombic system or a monoclinic system. Said nitride phosphor has a crystal structure, and the crystal structure is an orthorhombic system or a monoclinic system. In the case of the crystal structure, it is possible to provide a nitride phosphor with an excellent light emission efficiency.

In addition, in description of the present invention, relationship between the color name and the wavelength range is based on the JIS standard (JIS Z8110) unless otherwise noted.

In the above phosphor of red color, it is conceivable that addition of B or Mn provides dispersion of crystal growth, and thus accelerates particle growth. It is not preferable that the concentration of B or Mn is too small or too large. If the concentration of B or Mn is too small, its effect also is small. On the other hand, if too large, concentration quenching occurs. This dispersion makes particles larger than conventional particles, and thus improves light emission luminance at least 10% higher (note that an extent that the particles become larger slightly varies depends on burning conditions, and that all depends on circumstances). However, since B or Mn disperses outwardly of the reaction system by burning, it is very difficult to accurately specify how many ppm is contained in the composition formula after the burning as of now.

The nitride phosphor contains not less than 1 ppm and not more than 10000 ppm of Mn and or B relative to a general formula $L_XM_YN_{((2/3)X+(4/3)Y)}$:R or $L_XM_YO_ZN_{((2/3)X+(4/3)Y-(2/3)Z)}$:R. Boron, boride, boron nitride, borate, and so on, can be employed as boron added to the material.

L is at least one II group element that is selected from the group consisting of Be, Mg, Ca, Sr, Ba and Zn, and essentially contains Ca or Sr. Ca or Sr can be employed alone. Combination such as Ca and Sr, Ca and Mg, Ca and Ba, and Ca, Sr and Ba can be also employed. Any one element of Ca and Sr is contained. Be, Mg, Ba and Zn can be partially substituted for Ca or Sr. In the case where mixture of two or more types of element is employed, the composition ratio can be varied if necessary. The peak wavelength shifts on longer wavelength side in the case where both Ca and Sr are employed as compared with in the case where Ca or Sr is employed alone. The peak wavelength shifts on longer wavelength side in the case where the mol ratio of Sr and Ca is 7:3 or 3:7 as compared with in the case where Ca or Sr is employed alone. In addition, the peak wavelength shifts to the longest wavelength in the case where the mol ratio of Sr and Ca is substantially 5:5.

M is at least one IV group element that is selected from the group consisting of C, Si, Ge, Sn, Ti, Zr and Hf, and essentially contains Si. Si can be employed alone. Combination such as C and Si, Ge and Si, Ti and Si, Zr and Si, and Ge, Ti and Si can be also employed. C, Ge, Sn, Ti, Zr, and Hf can be partially substituted for Si. In the case where mixture essentially containing Si is employed, the composition ratio can be varied if necessary. For example, 95% by weight of Si and 5% by weight of Ge can be employed.

R is at least one rare earth element that is selected from the group consisting of Y, La, Ce, Pr, Nd, Sm, Eu, Gd, Tb, Dy, Ho, Er and Lu, and essentially contains Eu. Eu can be employed alone. Combination such as Ce and Eu, Pr and Eu, and La and EU can be also employed. Particularly, in the case where Eu is employed as an activator, it is possible to provide a nitride phosphor that has the peak wavelength from yellow to red range and excellent light emission characteristics. In the case of partial substitution of other element for Eu, other element provides coactivation. Coactivation can vary the color tone, and thus can adjust light emission characteristics. In the case where mixture essentially containing Eu is employed, the composition ratio can be varied if necessary. In the later-described examples, Eu, which is a rare-earth element, is employed as the center of fluorescence. Europium mainly has a divalent or trivalent energy level. In the phosphor of the description, $Eu^{2+}$ is used as an activation agent for an alkaline-earth-metal group silicon nitride as a base material. $Eu^{2+}$ tends to oxidize and is commercially available as a trivalent composition of $Eu_2O_3$. However, in the commercially available $Eu_2O_3$, O affects the characteristics much. Accordingly, it is difficult to obtain an excellent phosphor. For this reason, it is preferable to use a material in which O is removed from $Eu_2O_3$ outwardly of the system. For example, it is preferable to use europium as a single substance or europium nitride.

As an effect of added boron, it is possible to accelerate diffusion of $Eu^{2+}$, and to improve light emission characteristics such as light emission luminance, energy efficiency and quantum efficiency. In addition, it is possible to increase the particle size, and to improve light emission characteristics. Additionally, an effect of added manganese is similar.

The composition of said nitride phosphor contains oxygen. In the case where a wavelength conversion material of the above materials is employed as the red LED, wavelength spectrum characteristic or a lamp efficiency is further improved. This case is more preferable in terms of color rendering improvement effect of the present invention. In addition, as shown in the examples, the red LED in the present invention is preferably an LED composed of AlInGaN group semiconductor material. It is found that, typically, linear function control can performs chromaticity constant control.

(Green LED)

Typically, as for color of single color radiation, a wavelength of 498 nm to 530 nm refers to green. A wavelength of 493 nm to 498 nm refers to bluish green. A wavelength of 488 nm to 493 nm refers to blue green. A wavelength of 530 nm to 558 nm refers to yellow green. A wavelength of 558 nm to 569 nm refers to yellowgreen. An LED that emits light within these ranges of these colors generically refers to a green LED. In other words, although an LED that emits light with a main light emission wavelength of 488 nm to 569 nm refers to a typical green LED, it is not necessary to show green light emission in terms of semiconductor material level. The green LED can be an LED that emits light of the above green light emission in combination with wavelength conversion material. In addition, in consideration of property of LED that is used as an electricity-to-light conversion element, the LED can contain light emission spectrum of other wavelength range. Additionally, an LED that is set to emit green light by combination with light of wavelength other than the above range is also included in the green LED. As shown in the examples, the green LED in the present invention is preferably an LED composed of a nitride group semiconductor material. It is found that, typically, linear function control can performs chromaticity constant control.

(Blue LED)

Typically, as for color of single color radiation, a wavelength of 467 nm to 483 nm refers to blue. A wavelength of 430 nm to 467 nm refers to purplish blue. A wavelength of 483 nm to 488 nm refers to greenish blue. An LED that emits light within these ranges of these colors generically refers to a blue LED. In other words, although an LED that emits light with a main light emission wavelength of 430 nm to 488 nm refers to a typical blue LED, it is not necessary to show blue light emission in terms of semiconductor material level. The blue LED can be an LED that emits light of the above blue light emission in combination with wavelength conversion material. In addition, in consideration of property of LED that is used as an electricity-to-light conversion element, the LED can contain light emission spectrum of other wavelength range. Additionally, an LED that is set to emit blue light by combination with light of wavelength other than the above range is also included in the blue LED. As shown in the examples, the blue LED in the present invention is preferably an LED composed of a nitride group semiconductor material. It is found that, typically, linear function control can performs chromaticity constant control.

(Drive Time Detector)

In most cases, the controller is provided with clocks or generates clocks. In this case, when a counter circuit that counts the clock signals is provided, it is possible to measure elapsed time. On the other hand, a dedicated clock, timer, or the like, can be provided to detect drive time based on a signal from there. As long as a time measurer or detector that is widely used and known in normal electric and electronic circuitry is used, any time measurer or detector has no problem in terms of the structure of the present invention. In addition, the drive time in the present invention can be light ON time after the light emitting apparatus is turned ON. Additionally, the drive time is preferably total overall drive time after light emitting apparatus operation. In this case, control in accordance with various types of elapsed time variation due to deterioration of light emitting apparatus can be performed. Or, control including deterioration correction can be performed based on calculation of the overall current amount that applied to the light emitting element, that is, the amount that is obtained by the time quadrature of current. Moreover, control including both types of drive time is more preferable.

(Predetermined Function of Drive Time)

Light emitting elements including LED, and light emitting apparatuses generally deteriorate more or less as light emission time elapses, and finally end their lives. With integration of drive time, the chromaticities, color rendering levels and luminances of light emitting elements and light emitting apparatuses vary. In order that the chromaticity, color rendering property and luminance of the light emitting apparatus such as lighting may not vary even when time elapses, a correction drive control condition of drive current, drive voltage, and so on, of each light emitting element that composes the light emitting apparatus can be represented by a function. The function that represents the drive time and drive control condition relationship refers to the predetermined function of drive time. Conversely, after chromaticity fluctuation correction of light emitting element such as LED due to elapsed time previously is measured, drive control that corrects the chromaticity fluctuation is calculated based on a function, and the drive is constantly achieved. As a result, it is possible to stably maintain the chromaticity irrespective of drive time. This is similar to color rendering level and luminance. In addition, in this case, if a drive temperature condition affects chromaticity variation, color rendering property variation and luminance variation together with the elapsed time variation, the function can be a function of both drive temperature and elapsed time. Furthermore, the predetermined function can be a function that corrects any one of, any two of, or all three of chromaticity, color rendering property and luminance, and, additionally, the predetermined function can be a function of any of or both of drive temperature and elapsed time that performs calculation. The latter is more preferable as a light emitting apparatus that achieve multi-function.

(Color Rendering Level)

The color rendering level or color rendering property in the present invention is one of the most important characteristics that specify how the color of an illuminated subject body is perceived as a light source. The method for specifying color rendering property is regulated by JIS Z 8726 that meets a method of International Commission on Illumination (CIE). The color rendering property of light source can be evaluated by one general color rendering index Ra, and can be supplementally evaluated by a dozen or so of special color rendering indices Ri (i=1 to 15) in some cases. The general color rendering index is an average value of the special color rendering indices for eight test colors with a middle extent of lightness and color saturation. It is generally considered as a representative index that mostly represents the color rendering property of a subject color. The special color rendering index refers to a value obtained by subtracting a color difference value between the case where a regulated test color is illuminated by a reference light source, and the case where is illuminated by reference light that is substantially the same correlative color temperature as the light source and is regarded as the reference of color rendering from 100, that is, an index that represents the smallness of color difference amount. Note that, in the present invention, a "color rendering property or color rendering level AB %" refers to a general color rendering index AB.

The color rendering level (the same as color rendering property in the present invention) of light emitting apparatus or light emitting element normally varies together with chromaticity variation, luminance variation, or the like, with elapsed drive time if control is not performed on a drive method. In addition, the variation depends on the temperature in operation. That is, a light emitting apparatus or light emitting element that is operated at a higher temperature for longer time tends to have larger color rendering property variation, chromaticity variation and luminance variation. According to the present invention, a color rendering level variation correction function of elapsed time and/or drive temperature that can maintain a desired value including a color rendering level is previously measured and evaluated, and drive control for time and/or control for drive temperature is performed based on the predetermined function as functional calculation, thus, irrespective of drive time and/or drive temperature, it is possible to provide a light emitting apparatus with a stable color rendering level. Additionally, in the case where the above predetermined function is a linear, quadratic or cubic function, particularly, a merit is expected because of memory saving, and so on. The above predetermined function can be other function. Even in the case of not functional presentation, evaluated correction control data is held as raw data for drive time and/or drive temperature in the storage device to read it, and, with elapsed drive time (and/or drive temperature), a drive control value that meets the elapsed drive time (and/or drive temperature) is suitably read, thus, drive control can be performed based on the drive control value.

In the case where the light emitting apparatus comprises a plurality of light emitting elements, control is suitably performed on each light emitting element, or on each light emitting element group. In this case, it is possible to more easily provide a color rendering property in proximity of a desired color rendering level. Chromaticity level variation due to elapsed time or the like may not be completely corrected by correction control such as control drive current of light emitting element in some cases. However, in the case where more numbers of light emitting element groups are set as subjects to be controlled, it is possible to perform color rendering property control closer the desired color rendering level. In application of the present invention, it is not always necessary to maintain completely the same chromaticity level numerically. Even in this case, it is sufficient to control the desired chromaticity level irrespective of elapsed time or the like to the extent that there is no problem in actual use.

Since the same type of light emitting elements has a high tendency to shows a similar variation rate also in chromaticity variation due to elapsed time, as for the above function or the like that is previously measured, evaluated and calculated, it is not necessary to perform measurement, evaluation and calculation for all light emitting elements in the light emitting apparatus. Evaluation data of an element that is selectively picked up in the same light emitting element group can be applied similarly to the chromaticity elapsed time variation.

In addition, as for drive control that corrects chromaticity or color rendering property variation due to elapsed time and temperature, correction drive can be performed separately from each other. Alternatively, it may be performed in combination of any of them, or correction control including all of them may be performed.

Additionally, in the case where color rendering property adjustment is performed, a light emitting apparatus comprising not only RGB light primary colors of light emitting elements or light sources, but also four light sources or light emitting elements, which additionally include white, of red, blue, green and white is preferable. In this case, since adjustment that maintains and keeps the color rendering property can be performed in a wider region, a region that allows correction extends very much. Particularly, in a white light emitting apparatus comprising red, blue, green and YAG group white LEDs, color rendering correction or adjustment can be achieved in a wide region. Accordingly, there is a tendency to easily perform correction adjustment for elapsed time variation or dride temperature variation.

(Pulse Drive Period of Drive Current and/or Drive Voltage)

In pulse drive of light emitting element, particularly of light emitting diode, it is known that control of pulse width and pulse amplitude of drive current or drive voltage can control magnitude of pulse drive current and pulse drive voltage. However, in control of pulse drive by pulse amplitude, since the absolute amount of a drive current or the like that applied to the light emitting element such as light emitting diode varies, the chromaticity and color rendering property of light emitting element such as light emitting diode fluctuates corresponding to the absolute amount of a drive current or the like. For this reason, in the case where luminance control of light emitting element such as light emitting diode is performed by a pulse drive current or pulse drive voltage, control is preferably performed not by pulse height but by length of pulse width. Especially, in the case where irrespective of light emission state temperature variation of each light emitting element or drive elapsed time variation, chromaticity, luminance or color rendering is stably maintained at a desired value as in the present invention, when control drive is performed for purpose of maintenance and set of any of the items, it is very preferable to reduce light emission state fluctuation due to magnitude control of drive current or the like as a subject to be directly controlled for driving to a minimum.

In this sense, it is preferable that pulse width modulation driving (including PWM) is achieved in pulse driving in terms of the structure of the present invention. In this case, it is possible to reduce fluctuation of chromaticity, color rendering property, and so on, due to drive current absolute value fluctuation. In addition, if a pulse drive period by pulse width control is increased to a maximum, pulse width control cannot increase the luminance any more. In this case, the luminance can be increased by increasing a pulse height. That is, it is preferable that pulse drive period such as pulse width normally controls luminance increase/reduction, and a plurality of steps is set for pulse height. In this case, depending on luminance increase/reduction requirement, setting of pulse height is changed upwardly or downwardly to the next set value, thus, it is possible to reduce light emission property fluctuation due to pulse height fluctuation.

(YAG Group White LED)

The YAG group white LED refers to a light emitting diode (LED) that performs wavelength conversion of electricity-to-light converted direct light from an LED chip by a phosphor containing a material composed of yttrium-aluminum-garnet (so-called YAG) and a compound thereof, i.e., a material group containing yttrium-aluminum-garnet and a compound thereof, and as a result can emit white luminescent radiation. The YAG group white LED typically refers to a blue light emitting chip LED with a resin containing a YAG group phosphor material that molds it. However, The YAG group white LED is not limited to this. For example, an LED that is constructed such that a part of or the whole of light emitted from a blue group LED radiates, passes or is reflected by a film that is formed of a YAG group phosphor material or is provided with a YAG group phosphor material applied thereon, is also included. That is, any light emitting body that contains at least YAG group material (including a compound thereof) as a wavelength conversion and can emit/radiate white light by employing an LED as an electricity-to-light conversion element belongs to this category. In addition, there are some types of phosphor material or compound containing yttrium-aluminum-garnet (YAG) group material and a compound thereof including different mixture ratios. It is known, depending on material composition ratio, mixture amount, and son on, luminescent wavelength spectrum components, peak wavelength, peak wavelength intensity and tint as luminescent characteristics slightly vary. However, in application of the present invention, since they can be arbitrarily selected/adjusted, any types meet and is included in this as long as they relate to a YAG group material and a compound thereof. Additionally, the LED may not be a white LED but can be a yellow group or blue group LED as long as it is used together with a YAG group phophor material as a wavelength conversion material. That is, although the YAG group white LED typically refers to an LED that emits light perceived as white by mixture of blue light emitting LED and yellow fluorescent color, in the case where the mixture balance is adjusted if necessary, it can provide a bluish tint, a yellowish tint, or the like, however, in application of the present invention, it is preferable that a yellowish YAG group white LED is used, i.e., a YAG group white LED with relatively higher intensity of yellow component that is the yellow fluorescent color is used, for example, in terms of improvement of color rendering property. On the other hand, in order to achieve various color temperatures, it is preferable that a light source is constructed by using a bluish YAG group white LED, i.e., a YAG group white LED with high color temperature. Furthermore, it is more preferable that a YAG group white LED employs a short-wavelength blue LED or a purple group LED. Moreover, although a YAG group white LED is shown as one specific example in the present invention, in addition to a YAG group white LED, as a white LED that comprises a semiconductor light emitting element capable of emitting ultraviolet rays or visible light and a phosphor emitting luminescent radiation caused by excitation of light emitted from the semiconductor light emitting element, a nitride semiconductor composed of GaN, InGaN, AlInGaN, or the like, and silicon nitride group phosphor containing Eu, oxynitride group phosphor containing Eu, aluminate phosphor as garnet group phospho containing Ce such as $Lu_3Al_5O_{12}$:Ce and $Tb_3Al_5O_{12}$:Ce, and so on, can be given as representative examples.

EXAMPLES

The following description describes examples of the present invention with reference to the drawings.

Example 1

Figure 24:
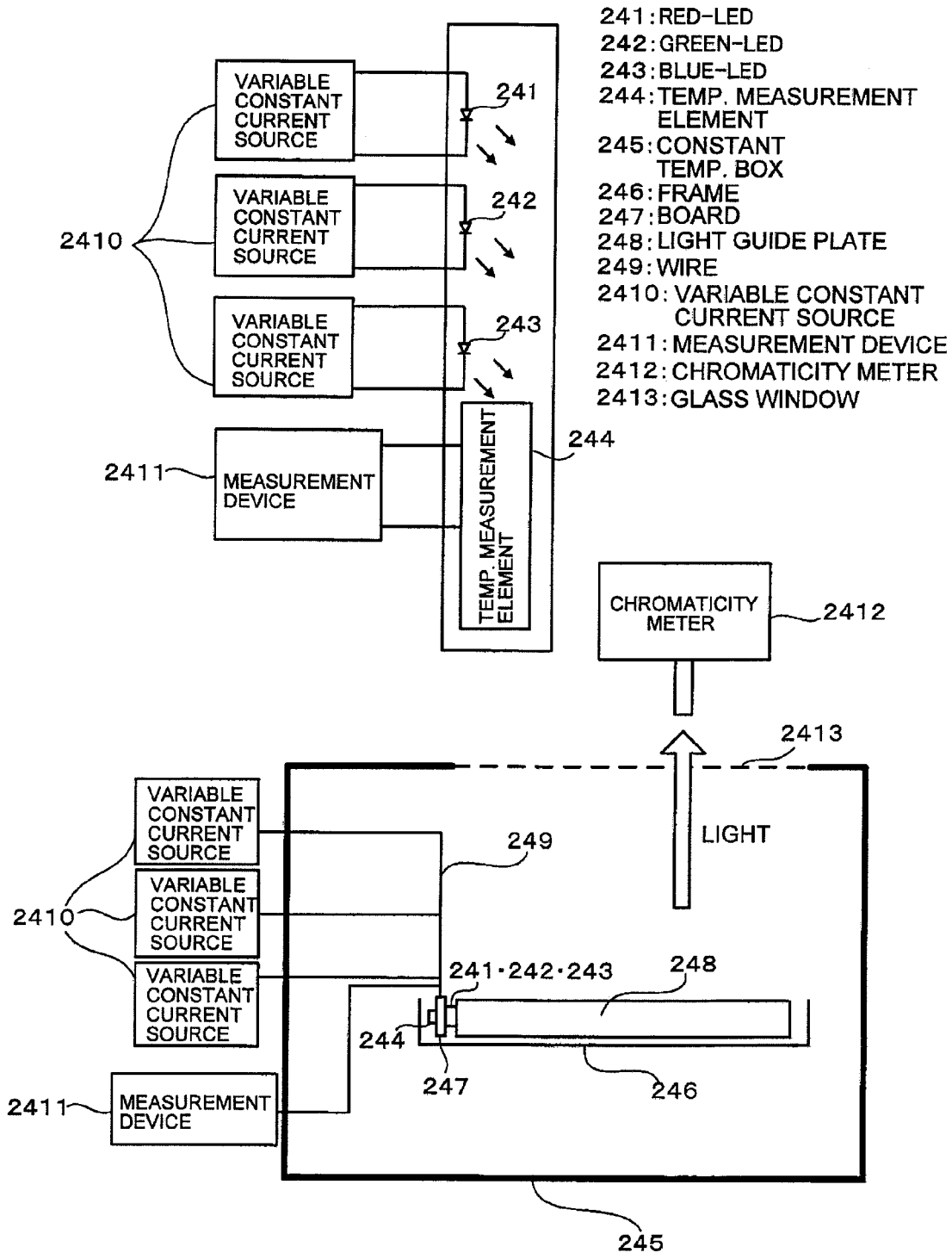
FIG. 24 is a schematic view for explanation of a structure of a backlight according to a second embodiment of the present invention.

As one example of the present invention, a control circuit of a backlight is shown in an upper part of FIG. 24. A side view is shown in a lower part. The construction shown in the lower part shows construction when a state where a chromaticity is set to be constant for ambient temperature variation is confirmed by a chromaticity meter. A light source is composed of three types of an AlInGaP group red LED 241, a nitride group green LED 242 and a nitride group blue LED 243 that are mounted on a board 247. The red, green and blue LEDs 241, 242 and 243 are electrically connected to variable constant current sources 2410 by wire 249, respectively. The red, green and blue LEDs 241, 242 and 243 emit light when electric power is provided from the variable constant current sources 2410. The light is radiated through a guide plate 248 on its one side. The emitted light is measured by a chromaticity meter 2412 through a glass window 2413 of a constant temperature box 245.

In addition, a temperature measurement element 244 is mounted on the back of the board 247. The temperature measurement element 244 transmits an ambient temperature based on its electrical property for temperature to a measuring device 2411 that is electrically connected thereto by the wire 249, thus, measurement is performed. A frame 246 secures and protects the light guide plate 248 and the board 247 that is provided with LEDs mounted thereon.

The temperature in the constant temperature box is set at 25° C. Currents that are applied to the red, green and blue LEDs 241, 242 and 243 are adjusted so as to achieve white chromaticity coordinates (x=0.29, y=0.29). When the temperature in the constant temperature box varies to −25° C., 0° C., 40° C., 60° C. and 80° C., its chromaticity coordinates become different from the initial chromaticity coordinates, or shift. Currents that are applied to the red, green and blue LEDs 241, 242 and 243 are adjusted so as to achieve the same initially set chromaticity coordinates (x=0.29, y=0.29). In this case, while the current that applied to the red LED 241 is held constant, only currents that are applied to green and blue LEDs 242 and 243 are adjusted. The currents that are applied to green and blue LEDs 242 and 243 exhibit values that are analogous to a linear function of the temperatures (see FIGS. 11, 12, 13 and 14). FIG. 11 shows an upper graph showing respective drive currents of red, green and blue LEDs 241, 242 and 243 in the case where the red LED 241 is driven at a constant current of 10 mA and the chromaticity is held constant at the chromaticity coordinates x=0.29 and y=0.29, and a lower graph showing relative values of the drive currents that are normalized by current values at 25° C. The measurement points are −25° C., 0° C., 25° C., 40° C., 60° C. and 80° C. The vertical axis shows the drive current relative value (If) that normalized at 25° C. The horizontal axis shows the ambient temperature of the constant temperature box that is provided with the light emitting apparatus. In this example, it is a temperature index as mutatis mutandis application of the junction temperature. As shown in this figure, it is found that the chromaticity is held constant, in the case where the drive current value of the red LED 241 is constant, the drive current value of the blue LED 243 is controlled based on a linear function of the temperature represented by If=−0.039 T (° C.)+1.0913, and the drive current value of the green LED 242 is controlled based on a linear function of the temperature represented by If=−0.0053 T (° C.)+1.1191

FIG. 12 shows an upper graph showing respective drive currents of red, green and blue LEDs 241, 242 and 243 in the case where the red LED 241 is driven at a constant current of 15 mA and the chromaticity is held constant at the chromaticity coordinates x=0.29 and y=0.29, and a lower graph showing relative values of the drive currents that are normalized by current values at 25° C. The measurement points are −25° C., 0° C., 25° C., 40° C., 60° C. and 80° C. The vertical axis shows the drive current relative value (If) that normalized at 25° C. The horizontal axis shows the ambient temperature of the constant temperature box that is provided with the light emitting apparatus. In this example, it is a temperature index as mutatis mutandis application of the junction temperature. As shown in this figure, it is found that the chromaticity is held constant, in the case where the drive current value of the red LED 241 is constant, the drive current value of the blue LED 243 is controlled based on a linear function of the temperature represented by If=−0.0038 T (° C.)+1.0772, and the drive current value of the green LED 242 is controlled based on a linear function of the temperature represented by If=−0.0055 T (° C.)+1.125

FIG. 13 shows an upper graph showing respective drive currents of red, green and blue LEDs 241, 242 and 243 in the case where the red LED 241 is driven at a constant current of 20 mA and the chromaticity is held constant at the chromaticity coordinates x=0.29 and y=0.29, and a lower graph showing relative values of the drive currents that are normalized by current values at 25° C. The measurement points are −25° C., 0° C., 25° C., 40° C., 60° C. and 80° C. The vertical axis shows the drive current relative value (If) that normalized at 25° C. The horizontal axis shows the ambient temperature of the constant temperature box that is provided with the light emitting apparatus. In this example, it is a temperature index as mutatis mutandis application of the junction temperature. As shown in this figure, it is found that the chromaticity is held constant, in the case where the drive current value of the red LED 241 is constant, the drive current value of the blue LED 243 is controlled based on a linear function of the temperature represented by If=−0.004 T (° C.)+1.0887, and the drive current value of the green LED 242 is controlled based on a linear function of the temperature represented by If=−0.0059 T (° C.)+1.1376

FIG. 14 shows an upper graph showing respective drive currents of red, green and blue LEDs 241, 242 and 243 in the case where the red LED 241 is driven at a constant current of 25 mA and the chromaticity is held constant at the chromaticity coordinates x=0.29 and y=0.29, and a lower graph showing relative values (If) of the drive currents that are normalized by current values at 25° C. The measurement points are −25° C., 0° C., 25° C., 40° C., 60° C. and 80° C. The vertical axis shows the drive current relative value (If) that normalized at 25° C. The horizontal axis shows the ambient temperature of the constant temperature box that is provided with the light emitting apparatus. In this example, it is a temperature index as mutatis mutandis application of the junction temperature. As shown in this figure, it is found that the chromaticity is held constant, in the case where the drive current value of the red LED 241 is constant, the drive current value of the blue LED 243 is controlled based on a linear function of the temperature represented by If=−0.0042 T (° C.)+1.0992, and the drive current value of the green LED 242 is controlled based on a linear function of the temperature represented by If=−0.0064 T (° C.)+1.1606

Furthermore, FIG. 16 shows tables showing respective values, in the case where the drive current values of the red LED 241 are set at 10 mA, 15 mA, 20 mA and 25 mA, in the drive current values of the green and blue LEDs 242 and 243 that can set white balance of chromaticity coordinates x=0.29 and y=0.29, while the chromaticity is maintained and held, in the state where the drive current values of the green and blue LEDs 242 and 243 are adjusted. In each table, it will be understood that values x and y of the chromaticity coordinates are held constant for temperature (Ta (° C.)) variation. The above FIGS. 11 to 15 are graphed based on the current relative values (If) for the temperatures (Ta (° C.)) in this case.

In addition, while the temperature in the constant temperature box varies, respective current of the red, green and blue LEDs 241, 242 and 243 are adjusted so as to hold not only a chromaticity but also a luminance constant. In this case, the respective current of the red, green and blue LEDs 241, 242 and 243 exhibit values that are analogous to a cubic function of the temperatures (see FIGS. 35, 36, 37 and 38). FIG. 35 shows values, at −25° C., in the case where the drive current values of the red LED 241 are set at 5 mA, 10 mA and 15 mA, in the drive current values of the green and blue LEDs 242 and 243 that can set white balance of chromaticity coordinates x=0.31 and y=0.31, while the luminance and the chromaticity are maintained and held, in the state where the drive current values of the red, green and blue LEDs 241, 242 and 243 are adjusted. In each table, it will be understood that luminances, relative luminances, and values x and y of the chromaticity coordinates are held constant for temperature variation. FIGS. 36, 37 and 38 are graphed based on the current relative values for the temperatures in this case.

As shown in a graph in an upper part of FIG. 36, at −25° C., in the case where the drive current amount is 5 mA, and the drive current values of the green and blue LEDs 242 and 243 are adjusted such that the chromaticity is set at chromaticity coordinates x=0.31 and y=0.31, while the luminance and the chromaticity are maintained constant, when the temperature rises from −25° C. to 0° C., 25° C., 40° C., 60° C. and 80° C., the relative values of the drive current values of the red, green and blue LEDs 241, 242 and 243 exhibit cubic functions. In the case where they are normalized based on the current values at 25° C., as shown in a graph in a lower part of FIG. 36, the current value vs. temperature function of the red LED 241 is a cubic function of T (° C.) that is represented by $If=1E(-6)T^3+3E(-6)T^2+0.0041\ T+0.8815$ The current value vs. temperature function of the green LED 242 is a cubic function of T (° C.) that is represented by $If=8E(-7)T^3+8E(-6)T^2+0.0013\ T+0.9701$ The current value vs. temperature function of the blue LED 243 is a cubic function of T (° C.) that is represented by $If=7E(-7)T^3-7E(-6)T^2+0.0014\ T+0.9674$ That is, the drive current of LED of each color controlled based on the above function of temperature so as to vary for the temperature, thus, the chromaticity and luminance are maintained constant.

As shown in a graph in an upper part of FIG. 37, at −25° C., in the case where the drive current amount is 10 mA, and the drive current values of the green and blue LEDs 242 and 243 are adjusted such that the chromaticity is set at chromaticity coordinates x=0.31 and y=0.31, while the luminance and the chromaticity are maintained constant, when the temperature rises from −25° C. to 0° C., 25° C., 40° C., 60° C. and 80° C., the relative values of the drive current values of the red, green and blue LEDs 241, 242 and 243 exhibit cubic functions. In the case where they are normalized (If) based on the current values at 25° C., as shown in a graph in a lower part of FIG. 37, the current value vs. temperature function of the red LED 241 is a cubic function of T (° C.) that is represented by $If=1E(-6)T^3+2E(-6)T^2+0.0046\ T+0.8763$ The current value vs. temperature function of the green LED 242 is a cubic function of T (° C.) that is represented by $If=3E(-7)T^3+1\ E(-5)T^2+0.0021\ T+0.9669$ The current value vs. temperature function of the blue LED 243 is a cubic function of T (° C.) that is represented by $If=3E(-7)T^3+9E(-6)T^2+0.0019\ T+0.9657$ That is, the drive current of LED of each color controlled based on the above function of temperature so as to vary for the temperature, thus, the chromaticity and luminance are maintained constant.

As shown in a graph in an upper part of FIG. 38, at −25° C., in the case where the drive current amount is 15 mA, and the drive current values of the green and blue LEDs 242 and 243 are adjusted such that the chromaticity is set at chromaticity coordinates x=0.31 and y=0.31, while the luminance and the chromaticity in this case are maintained constant, when the temperature rises from −25° C. to 0° C., 25° C., 40° C., 60° C. and 80° C., the relative values of the drive current values of the red, green and blue LEDs 241, 242 and 243 exhibit cubic functions. In the case where they are normalized based on the current values at 25° C., as shown in a graph in a lower part of FIG. 38, the current value vs. temperature function of the red LED 241 is a cubic function of T (° C.) that is represented by $If=3E(-6)T^3-5E(-5)T^2+0.0037\ T+0.8815$ The current value vs. temperature function of the green LED 242 is a cubic function of T (° C.) that is represented by $If=5E(-7)T^3-2E(-5)T^2+0.0021\ T+0.9613$ The current value vs. temperature function of the blue LED 243 is a cubic function of T (° C.) that is represented by $If=6E(-7)T^3-1E(-5)T^2+0.0019\ T+0.9624$ That is, the drive current of LED of each color controlled based on the above function of temperature so as to vary for the temperature, thus, the chromaticity and luminance are maintained constant.

In FIGS. 36 to 38, the vertical axis shows the drive current relative value (If) that normalized at 25° C. The horizontal axis shows the ambient temperature where the LED lighting is provided, and a temperature index as mutatis mutandis application of LED junction temperature, stem temperature, or the like. Accordingly, also in this case, since the value of control current that holds the luminance and chromaticity constant for temperature can be obtained by calculation processing based on the cubic function, it is not necessary to store 2268 bits of set values of current values for temperatures, but it is possible to perform constant luminance and chromaticity current control with a 48-bit storage element by calculation processing based on storage of a functional calculation formula even in temperature variation. In drive current control based on these types of functions, it is confirmed to provide high repeatable chromaticity maintenance.

Figure 23:
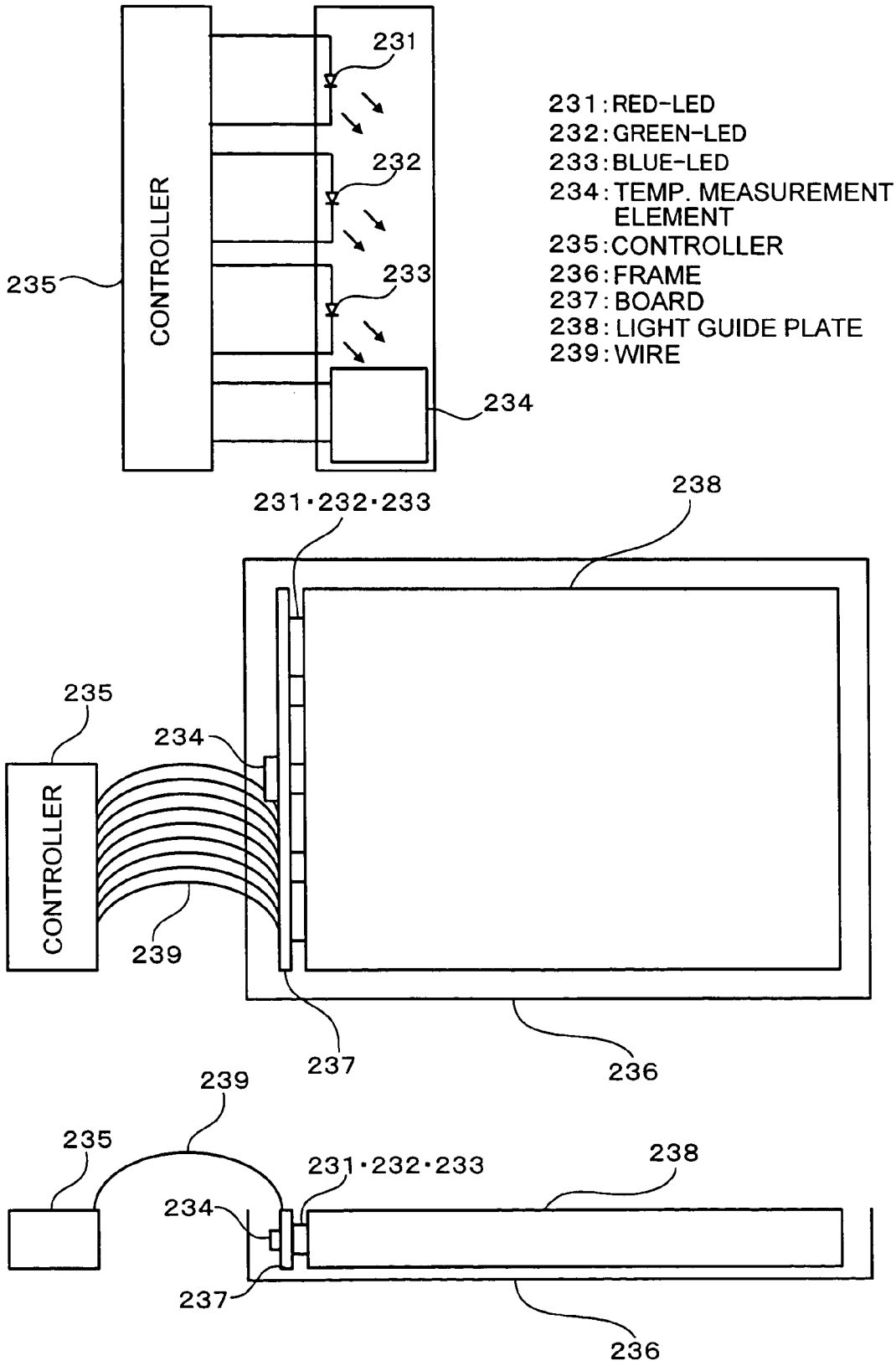
FIG. 23 is a schematic view for explanation of a structure of a backlight according to one embodiment of the present invention.

FIG. 23 shows another example of the present invention. The example shown in FIG. 23 corresponds to a schematic diagram of lighting that is controlled by a function that is previously obtained by measurement in the construction shown in the example of FIG. 24 and is applied to backlight lighting. An upper part is a block diagram of control circuit. A middle part is a plan view of the backlight lighting. A lower part is a side view thereof.

A light source is composed of three types of an AlInGaP group red LED 231, a nitride group green LED 232 and a nitride group blue LED 233 that are mounted on a board 237. The red, green and blue LEDs 231, 232 and 233 are electrically connected to a control portion 235 by wire 239, respectively. In addition, a temperature measurement element 234 is mounted on the board 237. The temperature measurement element transmits an ambient temperature based on its electrical property for temperature to the control portion 235 that is electrically connected thereto by the wire 239. The red, green and blue LEDs 231, 232 and 233 emit light when electric power is provided from the control portion. The light is radiated through a light guide plate 238 on its one side. A frame 236 secures and protects the light guide plate 238 and the board 237 that is provided with LEDs mounted thereon.

Once setting the chromaticity (x=0.31, y=0.31) at one temperature, the control portion 235 senses board temperature variation due to ambient temperature variation with the temperature measurement element 234, and thus controls values of currents that are applied to the red, green and blue LEDs 231, 232 and 233 based on the predetermined functions (see FIGS. 5, 6, 7 and 8). Embodiment conditions of FIGS. 5 to 8 are similar to the aforementioned description in the case of FIGS. 11 to 14 except that the set chromaticity is different. As a result, an upper graph in FIG. 5 shows respective drive currents of red, green and blue LEDs 241, 242 and 243 in the case where the red LED 241 is driven at a constant current of 10 mA and the chromaticity is held constant at the chromaticity coordinates x=0.31 and y=0.31, and a lower graph shows relative values of the drive currents that are normalized by current values at 25° C. The measurement points are −25° C., 0° C., 25° C., 40° C., 60° C. and 80° C. The vertical axis shows the drive current relative value (If) that normalized at 25° C. The horizontal axis shows the ambient temperature of the constant temperature box that is provided with the light emitting apparatus. In this example, it is a temperature index as mutatis mutandis application of the junction temperature. As shown in this figure, it is found that the chromaticity is held constant, in the case where the drive current value of the red LED 241 is constant, the drive current value of the blue LED 243 is controlled based on a linear function of the temperature represented by If=−0.004 T (° C.)+1.0868, and the drive current value of the green LED 242 is controlled based on a linear function of the temperature represented by If=−0.0053 T (° C.)+1.1279

Similarly, an upper graph in FIG. 6 shows respective drive currents of red, green and blue LEDs 241, 242 and 243 in the case where the red LED 241 is driven at a constant current of 15 mA and the chromaticity is held constant at the chromaticity coordinates x=0.31 and y=0.31, and a lower graph in FIG. 6 shows relative values of the drive currents that are normalized by current values at 25° C. The measurement points are −25° C., 0° C., 25° C., 40° C., 60° C. and 80° C. The vertical axis shows the drive current relative value (If) that normalized at 25° C. The horizontal axis shows the ambient temperature of the constant temperature box that is provided with the light emitting apparatus. In this example, it is a temperature index as mutatis mutandis application of the junction temperature. As shown in this figure, it is found that the chromaticity is held constant, in the case where the drive current value of the red LED 241 is constant, the drive current value of the blue LED 243 is controlled based on a linear function of the temperature represented by If=−0.041 T (° C.)+1.1028, and the drive current value of the green LED 242 is controlled based on a linear function of the temperature represented by If=−0.0056 (° C.) T+1.1349

Similarly, an upper graph in FIG. 7 shows respective drive currents of red, green and blue LEDs 241, 242 and 243 in the case where the red LED 241 is driven at a constant current of 20 mA and the chromaticity is held constant at the chromaticity coordinates x=0.31 and y=0.31, and a lower graph in FIG. 7 shows relative values of the drive currents that are normalized by current values at 25° C. The measurement points are −25° C., 0° C., 25° C., 40° C., 60° C. and 80° C. The vertical axis shows the drive current relative value (If) that normalized at 25° C. The horizontal axis shows the ambient temperature of the constant temperature box that is provided with the light emitting apparatus. In this example, it is a temperature index as mutatis mutandis application of the junction temperature. As shown in this figure, it is found that the chromaticity is held constant, in the case where the drive current value of the red LED 241 is constant, the drive current value of the blue LED 243 is controlled based on a linear function of the temperature represented by If=−0.004 T (° C.)+1.0914, and the drive current value of the green LED 242 is controlled based on a linear function of the temperature represented by If=−0.0057 T (° C.)+1.1444

Similarly, an upper graph in FIG. 8 shows respective drive currents of red, green and blue LEDs 241, 242 and 243 in the case where the red LED 241 is driven at a constant current of 25 mA and the chromaticity is held constant at the chromaticity coordinates x=0.31 and y=0.31, and a lower graph in FIG. 8 shows relative values (If) of the drive currents that are normalized by current values at 25° C. The measurement points are −25° C., 0° C., 25° C., 40° C., 60° C. and 80° C. The vertical axis shows the drive current relative value (If) that normalized at 25° C. The horizontal axis shows the ambient temperature of the constant temperature box that is provided with the light emitting apparatus. In this example, it is a temperature index as mutatis mutandis application of the junction temperature. As shown in this figure, it is found that the chromaticity is held constant, in the case where the drive current value of the red LED 241 is constant, the drive current value of the blue LED 243 is controlled based on a linear function of the temperature represented by If=−0.0042 T (° C.)+1.106, and the drive current value of the green LED 242 is controlled based on a linear function of the temperature represented by If=−0.0061 T (° C.)+1.157

Figure 9:
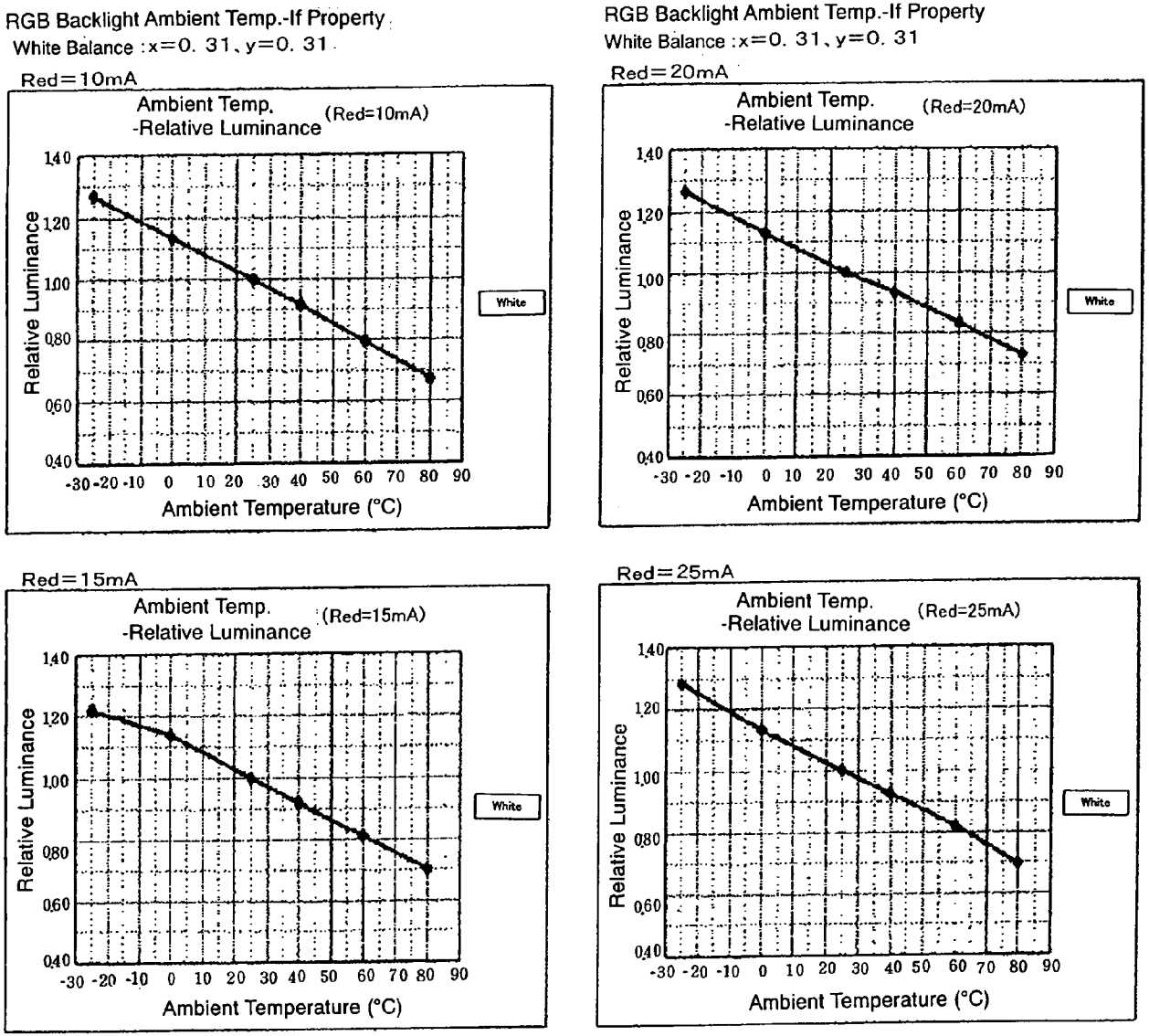
FIG. 9 shows graphs showing, in white balance of RGB-LED light (x=0.31, y=0.31) at each red LED current amount of constant values 10 mA, 15 mA, 20 mA and 25 mA, variation of relative luminance relationship for temperature.

Thus, the chromaticity of light emitted from a light emission surface of the light guide plate 238 is held constant irrespective of ambient temperature variation. In this example, since the current value of the red LED is constant, and the currents of the green and blue LEDs are controlled based on the linear functions, as shown in FIG. 9, white luminance decreases as the temperature rises. FIG. 9 shows a graph showing relationship between temperature and relative luminance in each of cases where the current amount of the LED 241 is set constant at 10 mA, 15, mA, 20 mA and 25 mA, in the case where the light emission luminance of the LED light emitting apparatus according to this example for the ambient temperature is normalized as light emission luminance value at 25° C. In this case, the white balance is held at x=0.31 and y=0.31 on the chromaticity coordinates in the whole temperature range, needless to say, the above chromaticity in white is maintained. Furthermore, FIG. 10 shows tables showing respective values, in the case where the drive current values of the red LED 241 are set at 10 mA, 15 mA, 20 mA and 25 mA, in the drive current values of the green and blue LEDs 242 and 243 that can set white balance of chromaticity coordinates x=0.31 and y=0.31, while the chromaticity is maintained and held, in the state where the drive current values of the green and blue LEDs 242 and 243 are adjusted. In each table, it will be understood that values x and y of the chromaticity coordinates are held constant for temperature (Ta (° C.)) variation. The above FIGS. 5 to 9 are graphed based on the current relative values (If) for the temperatures (Ta (° C.)) in this case. In this example, although only one LED is shown for each color as a representative form, lighting composed of a plurality of LEDs for each color can be treated similarly.

In addition, current control is performed not only based on a function, but also based on RGB-LED current set values that are previously stored for each temperature to hold the white balance constant. In this construction, current control can be performed by reading stored set values corresponding to the temperature in lighting operation.

Additionally, as for detection of LED ambient temperature variation, a temperature measurement element (such as temperature detector) can be used similarly to this example, or control may be performed based on an input value. The input value can be input based on an index value that indicates or suggests any LED operation environmental temperature index such as set temperature value of air conditioner or constant temperature box and is input, for example. Alternatively, in the case where the environmental temperature varies periodically as time elapses, or the like, the controlled current set value can be changed in accordance with the elapsed time as time elapses.

Example 2

Figure 34:
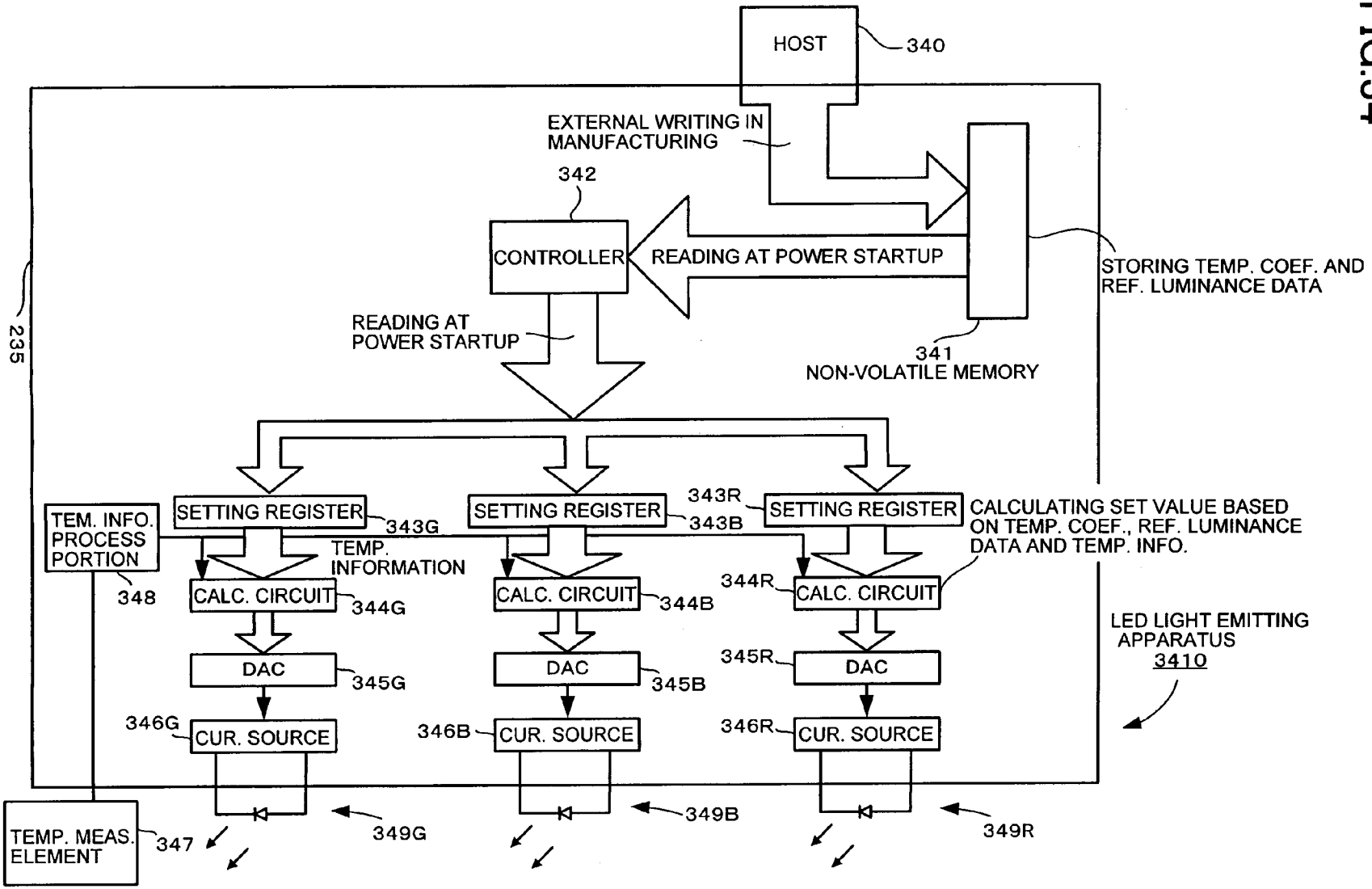
FIG. 34 is a schematic block structure diagram of a constant chromaticity lighting form.

FIG. 34 is a schematic diagram of an example 2. In FIG. 34, AlInGaP group LED 349R, nitride group blue and green LEDs 349B and 349G that compose an LED light emitting apparatus 3410 as a lighting apparatus are provided with setting registers 343, calculation circuits 344, DACs (digital-analog converters) 345 and current sources 346, and are connected thereto as shown in FIG. 34. As for this lighting, in manufacturing, current data such as a previously-measured chromaticity constant current control function depending on the temperature and its coefficients, a reference luminance is written into a non-volatile memory 341 inside a control portion 235 from a host computer 340. At power startup in lighting, the data is written in the setting register 343 for each color through the control circuit 342. A temperature measurement element that is located in proximity to each LED measures an environmental temperature of each LED that composes the lighting, and provides temperature information to a calculation circuit 344 through a temperature information processing portion 348. The calculation circuit 344 calculates a current set value for constant chromaticity based on the temperature information, the function, the temperature coefficients, the reference luminance and so on, and provides an instruction of a given current set value to the current source 346 through the converter 345. As a result, light emission control is suitably performed on the LEDs 349R, 349G and 349B, thus, even in temperature variable conditions, the white balance as constant white level is maintained.

The control portion 235 operates as follows. The reference luminance data, and a luminance data variation rate for temperature variation from the external host 340 such as personal computer are written into the non-volatile memory 341 for each of RGB colors in manufacturing and/or adjustment (maintenance). In actual operation, i.e., in actual use of the lighting, at startup of the control portion 235, the data on the non-volatile memory 341 is read by the control portion 342, and written into the register 343 that can easily and directly use the data in calculation. The calculator circuit 344 calculates a luminance data set value based on the set data written in the register 343, and the temperature data that is generated by the temperature information processing portion 348 based on the signal provided from the temperature measurement element 347. The calculated set value is converted into a signal that can directly control the current source 346 by the DA converter 345.

The picking up of the temperature information from the temperature sensor, and luminance control based on temperature information are periodically performed at a constant period that is determined by a calculation algorithm based on the function of the calculation circuit 344. FIGS. 17 to 22 shows the example where the chromaticity is adjusted at (x=0.27, y=0.27) by this lighting circuit. Embodiment conditions of FIGS. 17 to 20 are similar to the aforementioned description in the case of FIGS. 11 to 14 except that the set chromaticity is different. Accordingly, an upper graph in FIG. 17 shows respective drive currents of red, green and blue LEDs 241, 242 and 243 in the case where the red LED 241 is driven at a constant current of 10 mA and the chromaticity is held constant at the chromaticity coordinates x=0.27 and y=0.27, and a lower graph in FIG. 17 shows relative values of the drive currents that are normalized by current values at 25° C. The measurement points are −25° C., 0° C., 25° C., 40° C., 60° C. and 80° C. The vertical axis shows the drive current relative value (If) that normalized at 25° C. The horizontal axis shows the ambient temperature of the constant temperature box that is provided with the light emitting apparatus. In this example, it is a temperature index as mutatis mutandis application of the junction temperature. As shown in this figure, it is found that the chromaticity is held constant, in the case where the drive current value of the red LED 241 is constant, the drive current value of the blue LED 243 is controlled based on a linear function of the temperature represented by If=−0.041 T (° C.)+1.1012, and the drive current value of the green LED 242 is controlled based on a linear function of the temperature represented by If=−0.0058 T (° C.)+1.1455

Similarly, an upper graph in FIG. 18 shows respective drive currents of red, green and blue LEDs 241, 242 and 243 in the case where the red LED 241 is driven at a constant current of 15 mA and the chromaticity is held constant at the chromaticity coordinates x=0.27 and y=0.27, and a lower graph in FIG. 18 shows relative values of the drive currents that are normalized by current values at 25° C. The measurement points are −25° C., 0° C., 25° C., 40° C., 60° C. and 80° C. The vertical axis shows the drive current relative value (If) that normalized at 25° C. The horizontal axis shows the ambient temperature of the constant temperature box that is provided with the light emitting apparatus. In this example, it is a temperature index as mutatis mutandis application of the junction temperature. As shown in this figure, it is found that the chromaticity is held constant, in the case where the drive current value of the red LED 241 is constant, the drive current value of the blue LED 243 is controlled based on a linear function of the temperature represented by If=−0.041 T (° C.)+1.096, and the drive current value of the green LED 242 is controlled based on a linear function of the temperature represented by If=−0.006 (° C.) T+1.1478

Similarly, an upper graph in FIG. 19 shows respective drive currents of red, green and blue LEDs 241, 242 and 243 in the case where the red LED 241 is driven at a constant current of 20 mA and the chromaticity is held constant at the chromaticity coordinates x=0.27 and y=0.27, and a lower graph in FIG. 19 shows relative values of the drive currents that are normalized by current values at 25° C. The measurement points are −25° C., 0° C., 25° C., 40° C., 60° C. and 80° C. The vertical axis shows the drive current relative value (If) that normalized at 25° C. The horizontal axis shows the ambient temperature of the constant temperature box that is provided with the light emitting apparatus. In this example, it is a temperature index as mutatis mutandis application of the junction temperature. As shown in this figure, it is found that the chromaticity is held constant, in the case where the drive current value of the red LED 241 is constant, the drive current value of the blue LED 243 is controlled based on a linear function of the temperature represented by If=−0.004 T (° C.)+1.0937, and the drive current value of the green LED 242 is controlled based on a linear function of the temperature represented by If=−0.0061 T (° C.)+1.1516

Figure 21:
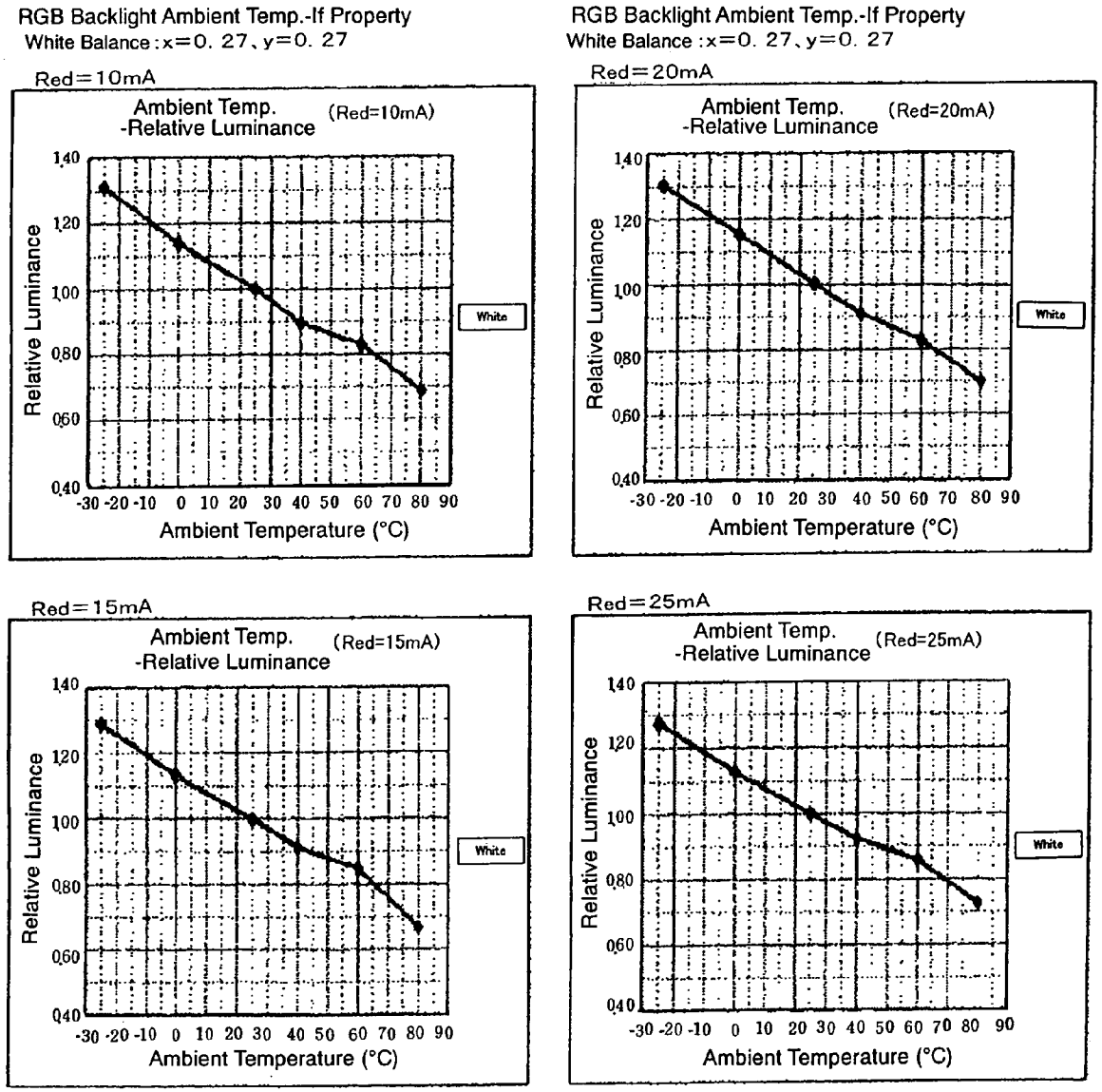
FIG. 21 shows a graph showing, in white balance of RGB-LED light (x=0.27, y=0.27) at each red LED current amount of constant values 10 mA, 15 mA, 20 mA and 25 mA, variation of relative luminance relationship for temperature.

Similarly, an upper graph in FIG. 20 shows respective drive currents of red, green and blue LEDs 241, 242 and 243 in the case where the red LED 241 is driven at a constant current of 25 mA and the chromaticity is held constant at the chromaticity coordinates x=0.27 and y=0.27, and a lower graph in FIG. 20 shows relative values (If) of the drive currents that are normalized by current values at 25° C. The measurement points are −25° C., 0° C., 25° C., 40° C., 60° C. and 80° C. The vertical axis shows the drive current relative value (If) that normalized at 25° C. The horizontal axis shows the ambient temperature of the constant temperature box that is provided with the light emitting apparatus. In this example, it is a temperature index as mutatis mutandis application of the junction temperature. As shown in this figure, it is found that the chromaticity is held constant, in the case where the drive current value of the red LED 241 is constant, the drive current value of the blue LED 243 is controlled based on a linear function of the temperature represented by If=−0.0039 T (° C.)+1.0861, and the drive current value of the green LED 242 is controlled based on a linear function of the temperature represented by If=−0.0061 (° C.) T+1.1475 In addition, FIG. 21 shows a graph showing relationship between temperature and relative luminance in each of cases where the current amount of the LED 241 is set constant at 10 mA, 15, mA, 20 mA and 25 mA, in the case where the light emission luminance of the LED light emitting apparatus according to this example for the ambient temperature is normalized as light emission luminance value at 25° C. In this case, the white balance is held at x=0.27 and y=0.27 on the chromaticity coordinates in the whole temperature range, needless to say, the above chromaticity in white is maintained.

FIG. 22 shows tables showing respective values, in the case where the drive current values of the red LED 241 are set at 10 mA, 15 mA, 20 mA and 25 mA, in the drive current values of the green and blue LEDs 242 and 243 that can set white balance of chromaticity coordinates x=0.27 and y=0.27, while the chromaticity is maintained and held, in the state where the drive current values of the green and blue LEDs 242 and 243 are adjusted. In each table, it will be understood that values x and y of the chromaticity coordinates are held constant for temperature (Ta (° C.)) variation. The above FIGS. 17 to 20 are graphed based on the current relative values (If) for the temperatures (Ta (° C.)) in this case.

As seen these figures, in any cases of them, when control currents of green and blue LEDs at constant red LED current value are analogous to a linear function, this control holds the white balance. Similarly, in the cases of white balance setting at white chromaticity level (x=0.23, y=0.23), white chromaticity level (x=0.41, y=0.41) and white chromaticity level (x=0.3, y=0.4), control currents can be controlled based on linear function approximation as shown in FIGS. 26 to 27, 29 to 30, and 32 to 33. In FIG. 26, in the case of white balance setting at chromaticity x=0.23 and y=0.23, at constant drive current value the red LED 241 of 10 mA, drive control based on functions of temperature T (° C.) of If=−0.0041 T+1.107 as for a drive current relative value (If) of the blue LED 243, and If=−0.0062 T+1.1613 as for a drive current relative value (If) of the green LED 242 can hold the chromaticity constant. Additionally, in FIG. 27, in the case of white balance setting at chromaticity x=0.23 and y=0.23, at constant drive current value the red LED 241 of 15 mA, drive control based on functions of temperature (° C.) of If=−0.0041 T+1.1059 as for a drive current relative value (If) of the blue LED 243, and If=−0.0064 T+1.1684 as for a drive current relative value (If) of the green LED 242 can hold the chromaticity constant. In FIG. 29, in the case of white balance setting at chromaticity x=0.41 and y=0.41, at constant drive current value the red LED 241 of 10 mA, drive control based on functions of temperature T (° C.) of If=−0.0028 T+1.0684 as for a drive current relative value (If) of the blue LED 243, and If=−0.0047 T+1.1164 as for a drive current relative value (If) of the green LED 242 can hold the chromaticity constant. Additionally, in FIG. 30, in the case of white balance setting at chromaticity x=0.41 and y=0.41, at constant drive current value the red LED 241 of 20 mA, drive control based on functions of temperature T (° C.) of If=−0.0031 T+1.0835 as for a drive current relative value (If) of the blue LED 243, and If=−0.0053 T+1.1371 as for a drive current relative value (If) of the green LED 242 can hold the chromaticity constant. In FIG. 32, in the case of white balance setting at chromaticity x=0.3 and y=0.4, at constant drive current value the red LED 241 of 10 mA, drive control based on functions of temperature T (° C.) of If=−0.0029 T+1.0683 as for a drive current relative value (If) of the blue LED 243, and If=−0.0048 T+1.1178 as for a drive current relative value (If) of the green LED 242 can hold the chromaticity constant. Moreover, in FIG. 33, in the case of white balance setting at chromaticity x=0.3 and y=0.4, at constant drive current value the red LED 241 of 15 mA, drive control based on functions of temperature T (° C.) of If=−0.0029 T+1.0696 as for a drive current relative value (If) of the blue LED 243, and If=−0.0051 T+1.1265 as for a drive current relative value (If) of the green LED 242 can hold the chromaticity constant. In these cases, chromaticity maintenance is confirmed.

Furthermore, FIG. 25 shows tables showing respective values, in the case where the drive current values of the red LED 241 are set at 10 mA, and 15 mA, in the drive current values of the green and blue LEDs 242 and 243 that can set white balance of chromaticity coordinates x=0.23 and y=0.23, while the chromaticity is maintained and held, in the state where the drive current values of the green and blue LEDs 242 and 243 are adjusted. FIGS. 26 to 27 are graphed based on the current relative values (If) for the temperatures (Ta (° C.)) in this case. In addition, FIG. 28 shows tables showing respective values, in the case where the drive current values of the red LED 241 are set at 10 mA, and 20 mA, in the drive current values of the green and blue LEDs 242 and 243 that can set white balance of chromaticity coordinates x=0.41 and y=0.41, while the chromaticity is maintained and held, in the state where the drive current values of the green and blue LEDs 242 and 243 are adjusted. FIGS. 29 to 30 are graphed based on the current relative values (If) for the temperatures (Ta (° C.)) in this case. Additionally, FIG. 31 shows tables showing respective values, in the case where the drive current values of the red LED 241 are set at 10 mA, and 15 mA, in the drive current values of the green and blue LEDs 242 and 243 that can set white balance of chromaticity coordinates x=0.3 and y=0.4, while the chromaticity is maintained and held, in the state where the drive current values of the green and blue LEDs 242 and 243 are adjusted. FIGS. 32 to 33 are graphed based on the current relative values (If) for the temperatures (Ta (° C.)) in this case. In each table, it will be understood that values x and y of the chromaticity coordinates are held constant for temperature (Ta (° C.)) variation.

In this example, the whole temperature range, in the case where the current of red LED is held constant, as the temperature rises, the luminance of red LED reduces as a linear function (see FIGS. 9, 15 and 21). Thus, it is found that linear-functional luminance reduction of green and blue LEDs for the above luminance reduction of red LED can easily provide white balance by simple circuit construction, and small space and memory capacity. More accurately, even when the currents are constant, the green and blue LEDs should be treated by a quadratic function. However, since their temperature dependency coefficients are considerably small as compared with the red LED, that is, the temperature dependency of the green and blue LEDs is ignorable as compared with the red LED in terms of visual sense, a linear-functional current control can hold the white balance within the white chromaticity region that can be substantially considered as the same as it in terms of visual sense.

In the case where a current value can be controlled based on a predetermined function, the storage element capacity can be reduced. Accordingly, there is a merit that achieves small light weight, and simple peripheral circuitry. For example, that is, in the case where storage of current set values for LED of each color is required to maintain the white balance for every one degree step in the range of −40 to 85° C., if one set value requires 6 bits, the necessary capacity for the storage element is $$126 \text{ points} \times 6 \text{ bits} \times 3\ (R,\ G, \text{ and } B) = 2268 \text{ bits}$$

On the other hand, in the case where linear functional control controls the green and blue LEDs for the temperature, although bits for the slopes and intercepts are required, the required bits are $$(6 \text{ bits} + 6 \text{ bits}) \times 2\ (G, \text{ and } B) = 24 \text{ bits}$$

Thus, the necessary capacity is about 1/100 the above case. In addition, even in the case where control is performed based on a quadratic or cubic function, 36 bits or 48 bits of storage can substantially store the control current values that provide constant chromaticity and luminance. Thus, the storage capacity is reduced by two orders of magnitude.

Accordingly, it is possible to provide small size, low cost, and light weight of an address decode circuit in access to memory data, and so on. In addition, it is possible to provide constant chromaticity control by small circuitry including a peripheral circuit. For this reason, this example is very preferable with many things considered. The smallness of circuit size reduces an area of IC chip (approximately proportional to the number of bits), and thus highly contributes reduction of unit price and occupied area in printed board. In addition to a cost aspect, it is considered that simplification of address signal and so on reduces address recognition error, and reduces error misoperation or malfunction, and thus achieves an effect that improves reliability.

Particularly, in the case where the blue and green LEDs are composed of a nitride group semiconductor material, and the red LED is composed of an aluminum indium gallium phosphide (AlInGaP), when a white light source comprises RGB-LEDs, it is found that there is a tendency where constant white current control for temperature variation can be suitably represented by linear functional approximation in the case the red LED current value is constant, and by a cubic functional approximate relation formula in the case where both chromaticity and luminance are constant for temperature variation. Since control based on these functions can be easily achieved by simple circuit construction that provides low cost and small size, this example is preferable.

Example 3

Figure 39:
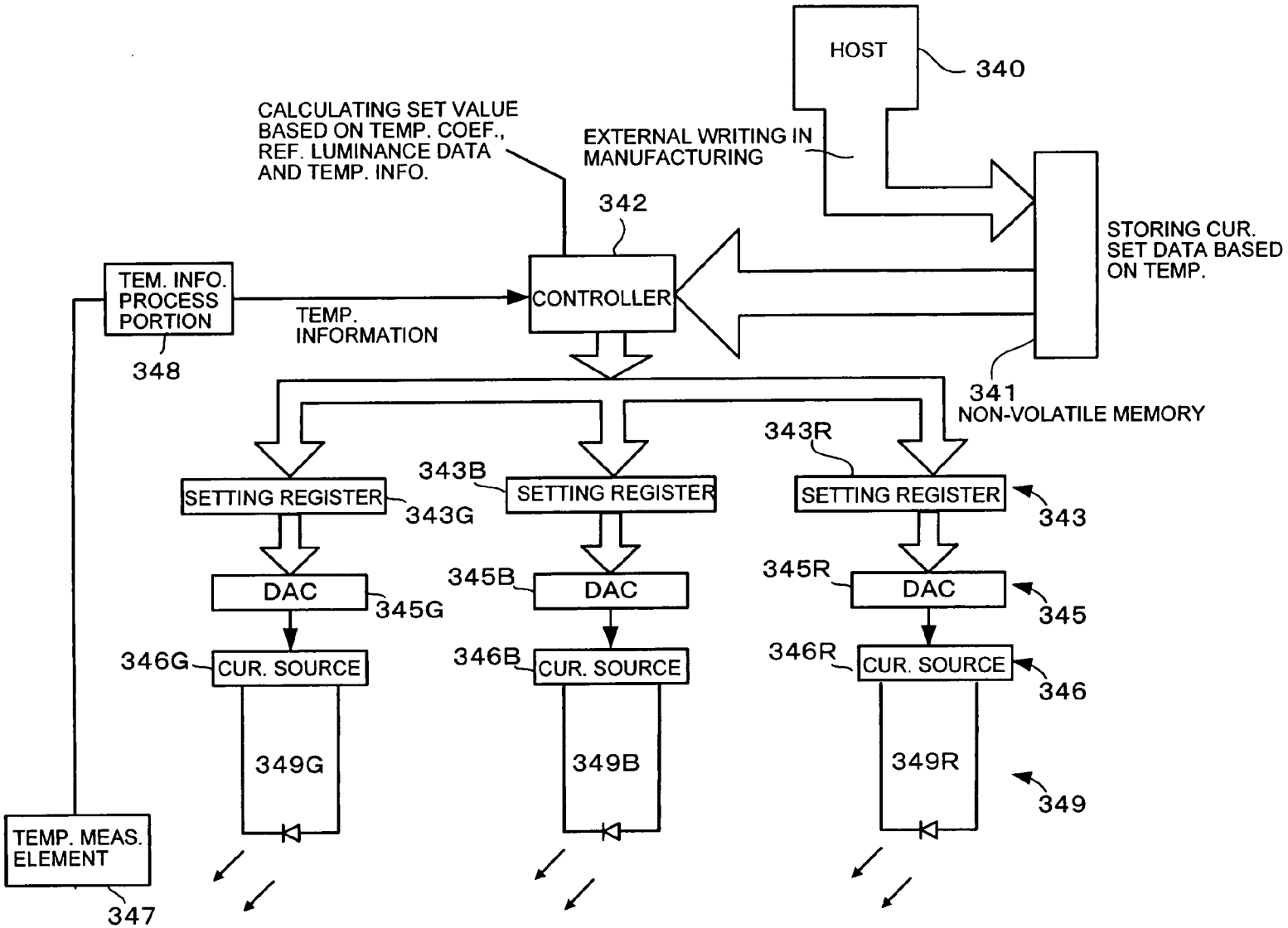
FIG. 39 is a circuit diagram of an LED light emitting apparatus according to an example 3.

The control portion 235 may operate as follows. As shown in FIG. 39, the temperature information from the temperature information processing portion 348 is directly provided to a control circuit 342 dissimilarly from the example 2. Accordingly, the control circuit 342 can calculate control set values corresponding to the provided temperature information in a collective manner. In addition, a calculation circuit for each of RGB is not required, thus, it is possible to directly provide the calculated values as direct signals from the setting register 343 to the DAC (digital-analog converter) 345. Current set value in accordance with the temperature is previously measured and evaluated in manufacturing or adjustment and written into the non-volatile memory 341 from the external host 340, such as PC. In actual operation, the control circuit 342 calculates set values of luminance data, chromaticity data and so on based on the temperature information that is generated by the temperature information processing portion 348 based on a signal obtained from the temperature measurement element 347.

The control circuit 342 writes the set values calculated for the measured temperature into a register that can easily converts data to use it. The DA-converter 345 controls the current source 346 based on the written data. The picking up of the temperature information from the temperature sensor, and luminance control based on temperature information are periodically performed at a constant period that is determined by a calculation algorithm based on the control circuit 342. In this example, a calculation circuit for each of RGB is not required, in addition, it is not necessary to write the whole data for various temperatures in the setting register. Additionally, only the control information corresponding to the measured temperature is required to be written in the setting register. Accordingly, a portion downstream of the control circuit in control information flow can be easily constructed, and can be simplified and quickly operate. Since a calculation circuit for each of RGB is not provided, thus, it is possible to achieve small size, light weight, slimness at low cost. Configuration of a predetermined function for control is similar to the foregoing examples. Constant chromaticity control based on the predetermined function can be provided by a very small memory.

A light emitting apparatus, LED lighting, an LED light emitting apparatus, and a control method of a light emitting apparatus can provide a desired chromaticity and so on irrespective of variation of temperature and so on, and can be suitably applied to a backlight for LCD, a headlight, a front light, an organic or inorganic electroluminescence, various types of display boards including LED display, a dot matrix display, a dot line unit and so on.

What is claimed is:

1. A light emitting apparatus comprising:

at least two light emitting elements with different chromaticities; and a light emitting element controller that controls light emitted from the light emitting apparatus so as to be a desired chromaticity of the emitted light which is mixed by at least two lights with different chromaticities, wherein the light emitting element controller controls drive currents of the light emitting elements based on a predetermined function of light emitting element temperature variation and drive current, the predetermined function represents the drive current as a substantially linear function of the temperature, the predetermined function is set based on an actual measurement of the chromaticity of mixed light in order to adjust the chromaticity of mixed light to be a predetermined constant value, and the light emitting element controller sets one drive current value of one light emitting element with one chromaticity as constant, and controls another drive current value of another light emitting element with another chromaticity adjustably based on the linear function of temperature variation.

2. A light emitting apparatus comprising:

at least two light emitting elements with different chromaticities;

a light emitting element controller that controls light emitted from the light emitting apparatus so as to be a desired chromaticity of the emitted light which is mixed by at least two lights with different chromaticities; and storage that previously stores drive current values for a plurality of light emitting element temperatures for controlling the light emitted from the light emitting apparatus so as to be the desired chromaticity, wherein the light emitting element controller controls drive currents of the light emitting elements based on the drive current values corresponding to a given temperature stored in the storage on condition that a chromaticity of mixed light emitted from the light emitting apparatus is kept constant for temperature variation, and the light emitting element controller sets one drive current value of one light emitting element with one chromaticity as constant, and controls another drive current value of another light emitting element with another chromaticity adjustably based on the drive current values stored in the storage.

3. A light emitting apparatus comprising:

at least two light emitting elements with different chromaticities;

a light emitting element controller that controls light emitted from the light emitting apparatus so as to be a desired chromaticity of the emitted light which is mixed by at least two lights with different chromaticities; and a temperature detector, wherein the light emitting element controller controls drive currents of the light emitting elements based on a signal from the temperature detector and a predetermined function of light emitting element temperature variation and drive current, the predetermined function represents the drive current as substantially linear function of the temperature, the predetermined function is set based on an actual measurement of the chromaticity of mixed light in order to adjust the chromaticity of mixed light to be a predetermined constant value, and the light emitting element controller sets one drive current value of one light emitting element with one chromaticity as constant, and controls another drive current value of another light emitting element with another chromaticity adjustably based on the linear function of temperature variation.

4. A light emitting apparatus comprising:

at least two light emitting elements with different chromaticities;

a light emitting element controller that controls light emitted from the light emitting apparatus so as to be a desired chromaticity of the emitted light which is mixed by at least two lights with different chromaticities;

a temperature detector; and a drive time detector, wherein the light emitting element controller controls drive currents of the light emitting elements based on signals from the temperature detector and the drive time detector, and a predetermined function of light emitting element temperature variation, drive time and drive current, the predetermined function represents the drive current as substantially linear function of the temperature, the predetermined function is set based on an actual measurement of the chromaticity of mixed light in order to adjust the chromaticity of mixed light to be a predetermined constant value, and the light emitting element controller sets one drive current value of one light emitting element with one chromaticity as constant, and controls another drive current value of another light emitting element with another chromaticity adjustably based on the linear function of temperature variation.

5. A light emitting apparatus comprising:

at least two light emitting elements with different chromaticities;

a light emitting element controller that controls light emitted from the light emitting apparatus so as to be a desired chromaticity of the emitted light which is mixed by at least two lights with different chromaticities; and a temperature setter, wherein the light emitting element controller controls drive currents of the light emitting elements based on a value set in the temperature setter and a predetermined function of light emitting element temperature variation and drive current, the predetermined function represents the drive current as substantially linear function of the temperature, the predetermined function is set based on an actual measurement of the chromaticity of mixed light in order to adjust the chromaticity of mixed light to be a predetermined constant value, and the light emitting element controller sets one drive current value of one light emitting element with one chromaticity as constant, and controls another drive current value of another light emitting element with another chromaticity adjustably based on the linear function of temperature variation.

6. The light emitting apparatus according to claim 1, wherein the light emitting element controller controls light emitted from the light emitting apparatus, the light mixed by at least two light with different chromaticities, so as to be a desired chromaticity that belongs to white light.

7. The light emitting apparatus according to claim 1, wherein the light emitting elements are light emitting diodes (LEDs).

8. An LED lighting comprising:

LEDs with three different chromaticities of red, blue and green LEDs;

an LED controller that controls light emitted from the LED lighting so as to be a desired chromaticity of the emitted light which is mixed by at least two lights with different chromaticities;

the LED controller controls drive currents of the LEDs based on a predetermined function of LED temperature variation and drive current, the predetermined function representing the drive current as a substantially linear function of the temperature, and thus controls the light emitted from the LED lighting so as to be white light, wherein the predetermined function is set based on an actual measurement of the chromaticity of mixed light in order to adjust the chromaticity of mixed light to be a predetermined constant value, and the LED controller drives one LED with any one of the chromaticities at a constant current and another LED with another chromaticity adjustably based on the linear function of temperature variation.

9. The LED lighting according to claim 8, wherein the red LED is driven at a constant current.

10. An LED lighting comprising:

LEDs with three different chromaticities of red, blue and green LEDs; and an LED controller that controls light emitted from the LED lighting so as to be a desired chromaticity and a desired luminance of the emitted light which is mixed by at least two lights with different chromaticities, wherein the LED controller controls pulse drive periods of drive currents of the LEDs based on a predetermined function of LED temperature variation and drive current, the predetermined function representing the drive current as a substantially linear function of the temperature, and thus controls the light emitted from the LED lighting so as to be white light with the desired luminance, the predetermined function is set based on an actual measurement of the chromaticity of mixed light in order to adjust the chromaticity of mixed light to be a predetermined constant value, and the LED controller sets one drive current value of one LED with one chromaticity as constant, and controls another drive current value of another LED with another chromaticity adjustably based on the linear function of temperature variation.

11. An LED lighting comprising:

LEDs with four different chromaticities of red, blue and green LEDs, and a white LED that can emit white light and is composed of a semiconductor light emitting element capable of emitting ultraviolet rays or visible light and a phosphor emitting luminescent radiation caused by excitation of light emitted from the semiconductor light emitting element;

an LED controller that controls light emitted from the LED lighting so as to be a desired color rendering level of the emitted light which is mixed by at least two lights with different chromaticities;

a temperature setter or a temperature detector; and a drive time detector, wherein the LED controller controls drive currents of the LEDs based on a detected value from the temperature detector, a signal from the drive time detector and a predetermined function of LED temperature variation, drive current and drive time and thus controls the light emitted from the LED lighting so as to be the desired color rendering level as white light, the predetermined function representing the drive current as a substantially linear function of the temperature, wherein the predetermined function is set based on an actual measurement of the chromaticity of mixed light in order to adjust the chromaticity of mixed light to be a predetermined constant value, and the LED controller drives one LED with any one of the chromaticities at a constant current and another LED with another chromaticity adjustably based on the linear function of temperature variation.

12. An LED light emitting apparatus comprising:

LEDs of at least red, blue and green colors; and a control portion having a non-volatile memory capable of receiving or providing information for chromaticity maintenance for temperature of the LED light emitting apparatus;

a control circuit that can read the information on respective colors and write control information into red, blue and green color setting registers at power startup, a calculation circuit that performs calculation based on signals from the respective color setting registers and a temperature information signal that is received from a temperature measurement element through a temperature information processing portion, digital-analog converters for respective colors that converts output from the calculation circuit, and current sources for respective colors that provide drive currents for the red, blue and green LEDs, wherein the information for chromaticity maintenance for temperature that is received, provided by and from the non-volatile memory contains predetermined functions of drive current; a temperature coefficient, and reference chromaticity and luminance data; or drive current values for temperatures, the predetermined function of drive current for the red LED represents that a control current value is constant for temperature, and the predetermined functions of drive current for green and blue LEDs represent that control current values are substantially linear functions of temperature, the predetermined functions of drive current for green and blue LEDs are set based on an actual measurement of the chromaticity of mixed light in order to adjust the chromaticity of mixed light to be a predetermined constant value, and the control portion sets a drive current value of red LED as constant, and controls drive currents value of green and blue LEDs adiustably based on the linear function of temperature variation.

13. An LED light emitting apparatus comprising:

LEDs of at least red, blue and green colors; and a control portion having a non-volatile memory capable of receiving or providing information for chromaticity and luminance maintenance for temperature of the LED light emitting apparatus; a control circuit that can read the information on respective colors and write control information into red, blue and green color setting registers at power startup;

a calculation circuit that performs calculation based on signals from the respective color setting registers and a temperature information signal that is received from a temperature measurement element through a temperature information processing portion, digital-analog converters for respective colors that converts output from the calculation circuit, and current sources for respective colors that provide drive currents for the red, blue and green LEDs, wherein the information for chromaticity and luminance maintenance for temperature that is received, provided by and from the non-volatile memory, contains predetermined functions of drive current, a temperature coefficient, and reference chromaticity and luminance data, the predetermined function of the LED with another chromaticity representing the drive current as a substantially linear function of the temperature, the predetermined functions of drive current for green and blue LEDs are set based on an actual measurement of the chromaticity of mixed light in order to adjust the chromaticity of mixed light to be a predetermined constant value, and the control portion sets a drive current value of red LED as constant, and controls drive currents value of green and blue LEDs adiustably based on the linear function of temperature variation.

14. An LED light emitting apparatus comprising:

LEDs of red, blue and green colors;

current sources for the LEDs of respective colors that are electrically connected to the LEDs;

digital-analog converters for respective colors that are electrically connected to the current sources;

setting registers for the LEDs of respective colors that are electrically connected to the digital-analog converters;

a control circuit that is electrically connected to the setting registers; and a non-volatile memory that is electrically connected to the control circuit, wherein the control circuit includes electrical input wire connection of temperature information through a temperature information processing portion from a temperature sensing element of the LEDs, wherein the control circuit calculates control current values for LEDs of respective colors, based on current setting data for temperature stored in the setting registers, based on predetermined functions of drive current stored in the non-volatile memory, and the temperature information that is provided therein, and thus performs light emission control drive of the LEDs, the predetermined function expressing the drive current as a substantially linear function of the temperature, the predetermined functions are set based on an actual measurement of the chromaticity of mixed light in order to adjust the chromaticity of mixed light to be a predetermined constant value, and the control circuit sets one drive current value of one LED with one chromaticity as constant, and controls another drive current value of another LED with another chromaticity adjustably based on the linear function of temperature variation.

15. The LED light emitting apparatus according to claim 12, wherein the red LED is composed of a AlInGaP group semiconductor material, and the blue and green LEDs are composed of a nitride group semiconductor material.

16. A control method of a light emitting apparatus that comprises at least two light emitting elements with different chromaticities, and a light emitting element controller that controls light emitted from the light emitting apparatus, the light mixed by at least two light with different chromaticities respectively, so as to be a desired chromaticity of the emitted light which is mixed by at least two lights with different chromaticities, wherein the light emitting element controller controls the light emitting elements based on a predetermined function of light emitting element temperature variation and drive current, the predetermined function expressing the drive current as a substantially linear function of the temperature, the predetermined function is set based on an actual measurement of the chromaticity of mixed light in order to adjust the chromaticity of mixed light to be a predetermined constant value, and the light emitting element controller sets one drive current value of one light emitting element with one chromaticity as constant, and controls another drive current value of another light emitting element with another chromaticity adjustably based on the linear function of temperature variation.

17. A light emitting apparatus comprising:

at least two light emitting elements with different chromaticities; and a light emitting element controller that controls light emitted from the light emitting apparatus so as to be a desired chromaticity of the emitted light which is mixed by at least two lights with different chromaticities, wherein the light emitting element controller controls drive currents of the light emitting elements based on pre-stored data representing a relation between temperature and current on condition that a chromaticity of mixed light emitted from the light emitting apparatus is kept constant for temperature variation, and the light emitting element controller sets one drive current value of one light emitting element with one chromaticity as constant, and controls another drive current value of another light emitting element with another chromaticity adjustably based on the pre-stored data.

* * * * *